US009441461B2

(12) United States Patent
Williams et al.

(10) Patent No.: US 9,441,461 B2
(45) Date of Patent: Sep. 13, 2016

(54) METHODS FOR RETRIEVAL AND REPLACEMENT OF SUBSEA PRODUCTION AND PROCESSING EQUIPMENT

(75) Inventors: Michael R. Williams, Fredericksburg, TX (US); Thomas L. Hergarden, Spring, TX (US); Howard J. Hartley, Tomball, TX (US); Andrei Strikovski, Spring, TX (US); Eric Randall Smedstad, League City, TX (US); Harold Brian Skeels, Kingwood, TX (US); John D. Dafler, Jr., Manvel, TX (US); Jimmy D. Andrews, Montgomery, TX (US)

(73) Assignee: FMC Technologies, Inc., Houston, TX (US)

( * ) Notice: Subject to any disclaimer, the term of this patent is extended or adjusted under 35 U.S.C. 154(b) by 0 days.

(21) Appl. No.: 14/423,667

(22) PCT Filed: Aug. 24, 2012

(86) PCT No.: PCT/US2012/052203

§ 371 (c)(1),
(2), (4) Date: Jul. 23, 2015

(87) PCT Pub. No.: WO2014/031123

PCT Pub. Date: Feb. 27, 2014

(65) Prior Publication Data

US 2015/0315879 A1 Nov. 5, 2015

(51) Int. Cl.
*E21B 43/01* (2006.01)
*E21B 41/00* (2006.01)
(Continued)

(52) U.S. Cl.
CPC ..... *E21B 43/01* (2013.01); *E21B 7/124* (2013.01); *E21B 33/035* (2013.01); *E21B 41/0007* (2013.01); *E21B 41/04* (2013.01)

(58) Field of Classification Search
CPC .. E21B 33/0355; E21B 33/076; E21B 37/06; E21B 7/124; E21B 41/02; E21B 43/01; E21B 43/017; E21B 43/36
USPC ..... 166/311, 90.1, 368, 267, 335, 366, 166/75.12
See application file for complete search history.

(56) References Cited

U.S. PATENT DOCUMENTS 3,500,907 A * 3/1970 Gentry ..... E21B 33/076 166/351
6,422,315 B1 7/2002 Dean
(Continued)

FOREIGN PATENT DOCUMENTS

WO 2011/048213 A2 4/2011

OTHER PUBLICATIONS

PCT International Search Report and Written Opinion dated May 21, 2013 for International Application No. PCT/US2012/052197.
(Continued)

*Primary Examiner* — James G Sayre
(74) *Attorney, Agent, or Firm* — Amerson Law Firm, PLLC

(57) ABSTRACT

Generally, the present disclosure is directed to systems that may be used to facilitate the retrieval and/or replacement of production and/or processing equipment that may be used for subsea oil and gas operations. In one illustrative embodiment, a method is disclosed that includes, among other things, removing at least a portion of trapped production fluid (101*a*, 101*b*) from subsea equipment (100) while the subsea equipment (100) is connected to a subsea equipment installation (185) in a subsea environment (180), and storing at least the removed portion of the trapped production fluid (101*a*, 101*b*) in a subsea containment structure (120, 120*a*, 120*b*, 132) that is positioned in the subsea environment (180). Additionally, the disclosed method also includes disconnecting the subsea equipment (100) from the subsea equipment installation (185) and retrieving the subsea equipment (100) from the subsea environment (180).

25 Claims, 47 Drawing Sheets

(51) Int. Cl.

| | |
|---|---|
| ***E21B 33/035*** | (2006.01) |
| ***E21B 41/04*** | (2006.01) |
| ***E21B 7/124*** | (2006.01) |

(56) References Cited

U.S. PATENT DOCUMENTS

| | | | | |
|---|---|---|---|---|
| 6,640,901 | B1 * | 11/2003 | Appleford | B01D 17/00 166/267 |
| 7,628,207 | B2 | 12/2009 | Leonardi et al. | |
| 2003/0170077 | A1 | 9/2003 | Herd et al. | |
| 2004/0168811 | A1 | 9/2004 | Shaw et al. | |
| 2005/0178560 | A1 | 8/2005 | Johansen et al. | |
| 2010/0032163 | A1 * | 2/2010 | Richards | E21B 33/076 166/344 |
| 2010/0084588 | A1 | 4/2010 | Curtiss, III et al. | |
| 2010/0193194 | A1 * | 8/2010 | Stoisits | E21B 37/06 166/335 |
| 2010/0294383 | A1 | 11/2010 | Melbo et al. | |
| 2011/0011593 | A1 * | 1/2011 | Borhaug | E21B 7/124 166/311 |
| 2011/0114329 | A1 * | 5/2011 | Emecheta | E21B 33/0355 166/350 |
| 2011/0186301 | A1 | 8/2011 | Childers et al. | |

OTHER PUBLICATIONS

PCT International Search Report and Written Opinion dated May 21, 2013 for International Application No. PCT/US2012/052203.

* cited by examiner

METHODS FOR RETRIEVAL AND REPLACEMENT OF SUBSEA PRODUCTION AND PROCESSING EQUIPMENT

BACKGROUND OF THE INVENTION

1. Field of the Invention

Generally, the present invention relates to equipment that is used for subsea oil and gas operations, and more particularly to methods that may be used to facilitate the retrieval and replacement of subsea oil and gas production and/or processing equipment.

2. Description of the Related Art

One of the most challenging activities associated with offshore oil and gas operations is the retrieval and/or replacement of equipment that may be positioned on or near the sea floor, such as subsea production and processing equipment and the like. As may be appreciated, subsea production and processing equipment, hereafter generally and collectively referred to as subsea equipment, may occasionally require routine maintenance or repair due to regular wear and tear, or due to the damage and/or failure of the subsea equipment that may be associated with unanticipated operational upsets or shutdowns, and the like. In such cases, operations must be performed to retrieve the subsea equipment from its location at the sea floor for repair, and to replace the subsea equipment so that production and/or processing operations may continue with substantially limited interruption.

In many applications, various cost and logistical design considerations may lead to configuring at least some subsea equipment components as part of one or more subsea production or processing equipment skid packages, generally referred to herein as subsea equipment packages or subsea equipment skid packages. For example, various mechanical equipment components, such as vessels, pumps, separators, compressors, and the like, may be combined in a common skid package with various interconnecting piping and flow control components, such as pipe, fittings, flanges, valves and the like. However, while skid packaging of subsea equipment generally provides many fabrication and handling benefits, it may present at least some challenges during hydrocarbon removal, depressurization, and retrieval of the equipment to the surface, as will be described below.

Depending on the size and complexity of a given subsea equipment skid package, the various equipment and piping components making up the skid package may contain many hundreds of gallons of hydrocarbons, or even more, during normal operation. In general, this volume of hydrocarbons in the subsea equipment skid package must be properly handled and/or contained during the equipment retrieval process so as to avoid an undesirable release of hydrocarbons to the surrounding subsea environment.

In many applications, subsea systems often operate in water depths of 5000 feet or greater, and under internal pressures in excess of 10,000 psi or more. It should be appreciated that while it may be technically feasible to shut in subsea equipment and retrieve it from those depths to the surface while maintaining the equipment under such high pressure, it can be difficult to safely handle and move the equipment package on and around an offshore platform or intervention vessel, as may be the case, while it is under such high pressure. Moreover, and depending on local regulatory requirements, it may not be permissible to move or transport such equipment and/or equipment skid packages while under internal pressure.

Yet another concern with subsea equipment is that problems can sometimes arise when flow through the equipment is stopped, for one reason or another, while the equipment is present in the subsea environment. For example, in some cases, flow through a given piece of subsea equipment may be intentionally stopped so that the equipment can be shut in and isolated for retrieval to the surface. In other cases, flow may inadvertently cease during inadvertent system shutdowns that occur as a result of operational upsets and/or equipment failures. Regardless of the reasons, when flow through the subsea equipment is stopped, hydrates and/or other undesirable hydrocarbon precipitates, such as asphaltenes, resins, paraffins, and the like, can sometimes form inside of the equipment. In such cases, the presence of any unwanted precipitates or hydrates can potentially foul the equipment and prevent a system restart after an inadvertent shut down, or they can complicate maintenance and/or repair efforts after the equipment has been retrieved to the surface. These issues must therefore generally be addressed during such times as when flow through the equipment ceases, such as by removal and/or neutralization of the constituents that may cause such problems.

In other cases, potentially damaging constituents, such as carbon dioxide ($CO_2$) or hydrogen sulfide ($H_2S$) and the like, may be present in solution in the liquid hydrocarbons that may be trapped inside of the equipment during shutdown. For example, hydrogen sulfide can potentially form sulfuric acid ($H_2SO_4$) in the presence of water, which may attack the materials of the some subsea equipment, particularly when flow through the equipment is stopped and the sulfuric acid may remain in contact with the wetted parts of the equipment for an extended period of time. Furthermore, it is well known that carbon dioxide may also be present in the trapped hydrocarbons, and can sometimes come out of solution and combine with any produced water that may be present in the equipment so as to form carbonic acid ($H_2CO_3$), which can also be damaging the materials that make up the wetted parts of the equipment during prolonged exposure. As with the above-described problems associated with hydrates and hydrocarbon precipitates, remedial measures are sometimes required to address such issues that are related to the various constituents that can cause material damage to wetted components when flow through the equipment is stopped.

Accordingly, there is a need to develop systems and equipment configurations that may be used to overcome, or at least mitigate, one or more of the above-described problems that may be associated with the retrieval and/or replacement of subsea oil and gas equipment.

SUMMARY OF THE DISCLOSURE

The following presents a simplified summary of the present disclosure in order to provide a basic understanding of some aspects disclosed herein. This summary is not an exhaustive overview of the disclosure, nor is it intended to identify key or critical elements of the subject matter disclosed here. Its sole purpose is to present some concepts in a simplified form as a prelude to the more detailed description that is discussed later.

Generally, the present disclosure is directed to systems that may be used to facilitate the retrieval and/or replacement of production and/or processing equipment that may be used for subsea oil and gas operations. In one illustrative embodiment, a method is disclosed that includes, among other things, removing at least a portion of trapped production fluid from subsea equipment while the subsea equipment is operatively connected to a subsea equipment installation in a subsea environment, and storing at least the removed portion of the trapped production fluid in a subsea containment structure that is positioned in the subsea environment. Additionally, the disclosed method also includes disconnecting the subsea equipment from the subsea equipment installation and retrieving the subsea equipment from the subsea environment.

Also disclosed herein is another illustrative method that includes positioning subsea equipment in a subsea environment adjacent to a subsea equipment installation, connecting an adjustable-volume subsea containment structure to the subsea equipment, the adjustable-volume subsea containment structure containing a stored quantity of at least a production fluid, and injecting at least a portion of the stored quantity of production fluid into the subsea equipment.

In another illustrative embodiment disclosed herein, a method includes, among other things, connecting a subsea processing package to subsea equipment, the subsea processing package including a separator vessel and a circulation pump, wherein the separator vessel contains a first quantity of flow assurance chemicals, and wherein the subsea equipment is operatively connected to a subsea equipment installation in a subsea environment and contains at least a quantity of a trapped production fluid. Furthermore, the disclosed method also includes circulating, with the circulation pump 139, a first flow of a fluid mixture through the subsea equipment and the subsea processing package, the fluid mixture including at least the first quantity of flow assurance chemicals and at least the quantity of trapped production fluid. Additionally, the method includes, among other things, separating, with the separator vessel, at least a portion of a gas portion of the quantity of trapped production fluid from the first flow.

In yet a further exemplary embodiment, a method is disclosed that includes trapping a quantity of production fluid in subsea equipment that is operatively connected to a flowline of a subsea equipment installation, wherein trapping the quantity of production fluid includes, among other things, bypassing the subsea equipment with a flow of the production fluid that is flowing through the flowline. Furthermore, the disclosed method includes forcing, i.e. bullheading, at least a portion of the trapped quantity of production fluid into the flowline either with or without the flow of the production fluid bypassing the subsea equipment.

Another illustrative method disclosed herein includes, among other things, isolating subsea equipment from a flow of a production fluid flowing through a subsea flowline that is operatively connected to the subsea equipment, wherein isolating the subsea equipment includes trapping a quantity of the production fluid in the subsea equipment. The method also includes, after isolating the subsea equipment, connecting a subsea pump to the subsea equipment so that a suction side of the subsea pump is in fluid communication with the subsea equipment, and operating the subsea pump so as to pump a least a portion of the trapped quantity of production fluid out of said subsea equipment.

Also disclosed herein is yet another exemplary embodiment that includes deploying an adjustable-volume subsea containment structure containing a quantity of flow assurance chemicals from a surface to a subsea environment, and connecting the adjustable-volume subsea containment structure to subsea equipment in the subsea environment. Furthermore, the disclosed method also includes, among other things, generating a flow of at least a portion the quantity of flow assurance chemicals from the adjustable-volume subsea containment structure to the subsea equipment so as to displace at least a portion of a trapped quantity of a production fluid from the subsea equipment and into a subsea flowline connected to the subsea equipment.

BRIEF DESCRIPTION OF THE DRAWINGS

The disclosure may be understood by reference to the following description taken in conjunction with the accompanying drawings, in which like reference numerals identify like elements, and in which:

FIGS. 3I and 3J schematically illustrate yet another method that may be used to replace subsea equipment in accordance with further illustrative embodiments of the present disclosure;

FIGS. 6A-6I schematically depict additional illustrative methods that may be used to retrieve subsea equipment according to certain embodiments disclosed herein;

FIGS. 7A-7I schematically illustrate other exemplary methods that may be used to retrieve subsea equipment according to some illustrative embodiments of the present disclosure.

Figure 1:
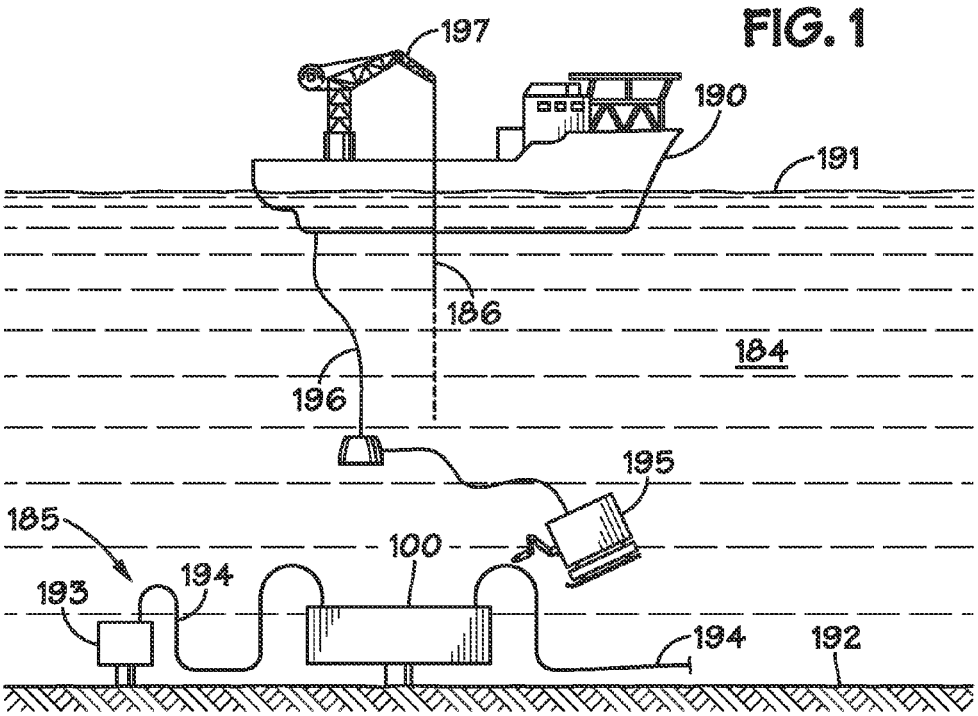
FIG. 1 schematically illustrates an intervention system that may be used for the retrieval and replacement of subsea equipment in accordance with some illustrative embodiments of the present disclosure.

While the subject matter disclosed herein is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION

Various illustrative embodiments of the present subject matter are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The present subject matter will now be described with reference to the attached figures. Various structures and devices are schematically depicted in the drawings for purposes of explanation only and so as to not obscure the present disclosure with details that are well known to those skilled in the art. Nevertheless, the attached drawings are included to describe and explain illustrative examples of the present disclosure. The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase.

Generally, the present disclosure is directed to various methods and systems that may be used to facilitate the retrieval and replacement of equipment that may be used for subsea oil and gas operations. In some illustrative embodiments of the present subject matter, various methods for retrieving subsea equipment are disclosed that include, among other things, removal of most, or substantially all, of the hydrocarbons from the subsea equipment prior to retrieval of the equipment from its subsea position to the surface. In certain embodiments, the removed hydrocarbons may be pumped, or forced by hydrostatic pressure, into the adjacent production/processing equipment and/or flowlines to which the subsea equipment is connected. In other embodiments, the removed hydrocarbons may be temporarily stored at or near the installation location of the retrieved subsea equipment for later re-injection into replacement subsea equipment.

In some illustrative embodiments disclosed herein, the hydrocarbons that are substantially removed from the subsea equipment may be replaced inside of the subsea equipment prior to retrieval by, among other things, a substantially incompressible liquid such as seawater, flow assurance chemicals, or a mixture thereof, and/or a compressible gas such as air or nitrogen. Furthermore, in certain embodiments, the subsea equipment may also be at least partially depressurized prior to its retrieval to the surface, whereas in other illustrative embodiments disclosed herein, the subsea equipment may be at least partially depressurized while it is being raised from its position subsea to the surface. In still further embodiments, at least some of the fluids that may be present in the subsea equipment prior to retrieval, which may include sea water, flow assurance chemicals, and/or compressible gases and the like, may be vented to the subsea environment while the equipment is being raised to the surface.

In further illustrative embodiments of the present disclosure, various methods are also disclosed for replacing subsea equipment that may have been retrieved from a subsea environment in accordance with one or more of the subsea equipment retrieval methods disclosed herein. In certain embodiments, the replacement subsea equipment may be filled with a substantially incompressible liquid, such as, for example, seawater, flow assurance chemicals, or a mixture thereof, prior to lowering the replacement subsea equipment from the surface down to the installation location of the retrieved subsea equipment. In other embodiments, the replacement subsea equipment may be filled with a compressible gas, such as air or nitrogen and the like, prior to being lowered from the surface. In at least some embodiments, one or more valves on the replacement subsea equipment may be left open while the replacement subsea equipment is being lowered from the surface, so as to equalize the changing hydrostatic pressure of the subsea environment with the contents of the replacement subsea equipment.

In certain embodiments, the fluid or fluids that are contained within the replacement subsea equipment may be purged or flushed from the replacement subsea equipment after it has been deployed to the subsea installation location and connected to the adjacent subsea equipment and/or flowlines. In some embodiments, and depending on the nature of the fluids contained within the replacement subsea equipment prior to equipment deployment, the fluids may be flushed into the subsea environment, whereas in other embodiments the fluids may be pumped, or forced under hydrostatic pressure, into the adjacent subsea equipment and/or flowlines. In those illustrative embodiments wherein the hydrocarbons that may have been removed from the retrieved subsea equipment may have been temporarily stored near the subsea installation location, the stored hydrocarbons may be injected into the replacement subsea equipment by pumping, or under action of the local hydrostatic pressure, after the replacement equipment has been attached to the adjacent subsea production/processing equipment and/or flowlines.

Turning now to the above-listed figures, FIG. 1 is a schematic representation of an intervention system that may be used to retrieve and replace subsea production and/or processing equipment, such as a subsea equipment package 100, in accordance with some illustrative embodiments of the present disclosure. FIG. 1 illustrates an intervention ship 190 at the surface 191 of a body of water 184, such as a gulf, ocean, or sea and the like, where it may be positioned substantially above a subsea equipment installation 185. As shown in FIG. 1, the subsea equipment installation 185 may be located on or near the sea floor 192, and may include, among other things, subsea well or manifold 193, to which is connected a flowline 194 that may be used to direct the production flow from the subsea well or manifold 193 to a subsea equipment package 100. The subsea equipment package 100 may be any illustrative subsea production or processing equipment package, which in turn may be connected via the flowline 194 to a subsea riser or other subsea equipment (not shown).

The intervention vessel 190 may include a suitably sized crane 197, which may be adapted to retrieve the subsea equipment package 100 from the sea floor 192, as well as to deploy a replacement equipment package (not shown) down to the subsea equipment installation 185, using the lift line 186. The intervention vessel 190 may also be equipped with one or more remotely operated underwater vehicles (ROV's) 195, which may be controlled from the intervention ship 190 by way of the control umbilical 196. In certain embodiments, the ROV (or ROV's) 195 may be used to perform one or more of the various steps that may be required during the retrieval of the subsea equipment package 100, as well as during the deployment of the replacement subsea equipment package, as will be further described with respect to the various figures included herein.

Figure 2A:
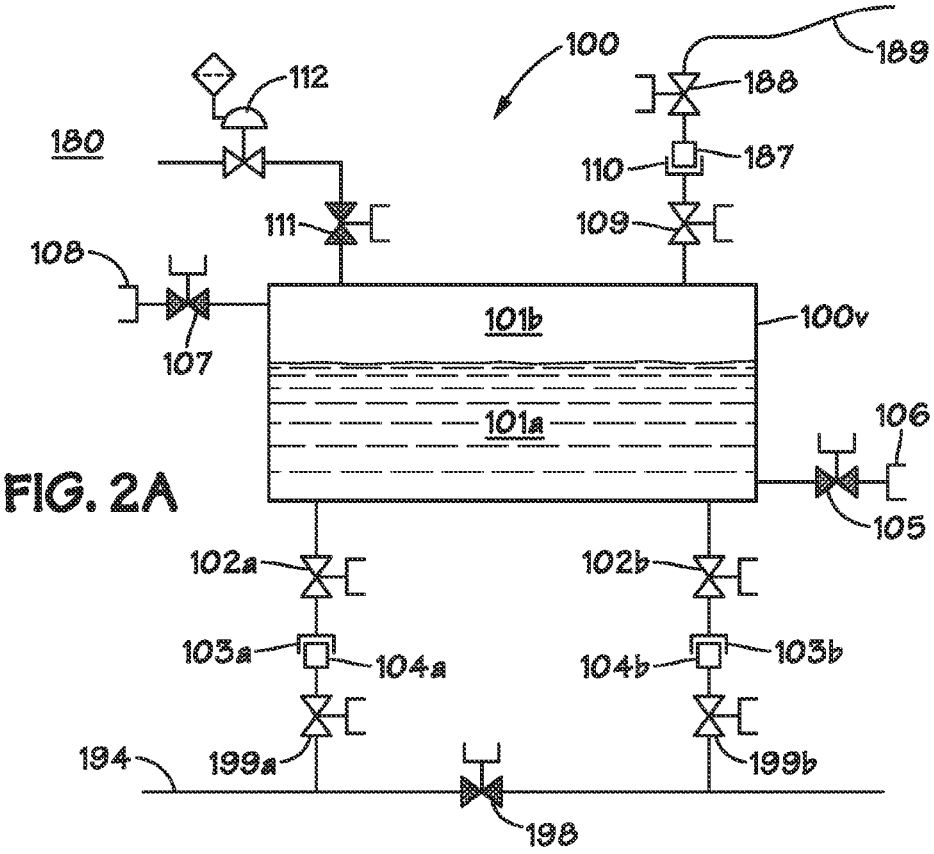
FIGS. 2A-2F schematically depict various illustrative embodiments of a method that may be used to retrieve subsea equipment according to subject matter disclosed herein.

FIG. 2A is a schematic flow diagram of one embodiment of an illustrative subsea equipment package 100 of the present disclosure during a typical equipment operation stage. As shown FIG. 2A, the subsea equipment package 100 may be made up of, among other things, a separator vessel 100*v*, which may contain, for example, a separated liquid 101*a* and a separated gas 101*b*. The separated liquid 101*a* may be a mixture of liquid phase hydrocarbons and produced water, as well as some amount of sand and/or other solids particulate matter. The separated gas 101*b* may be substantially made up of gaseous hydrocarbons that have been separated out of the liquid hydrocarbons that may be present in the separated liquid 101*a*, but may also include other produced gases, such as carbon dioxide, hydrogen sulfide and the like, depending on the specific formation from which the hydrocarbons were produced.

In at least some embodiments, the subsea equipment package 100 may include first and second equipment isolation valves 102*a* and 102*b*, which, when open as shown in FIG. 2A, may provide fluid communication between respective first and second equipment connections 103*a* and 103*b* and the separator vessel 100*v*. Additionally, first and second flowline isolation valves 199*a* and 199*b* may be attached to the flowline 194, and may similarly provide fluid communication between the flowline 194 and respective first and second flowline connections 104*a* and 104*b* when the respective flowline isolation valves 199*a* and/or 199*b* are open, as shown in FIG. 2A. In certain embodiments, the first and second equipment connections 103*a*, 103*b* on the subsea equipment package 100 may be matingly and sealingly engaged with the respective first and second flowline connections 104*a*, 104*b* on the flowline 194, thereby providing fluid communication between the flowline 194 and the subsea equipment package 100 when at least one pair of isolation valves 102*a*/199*a* or 102*b*/199*b* is open.

During the typical operational stage of the subsea equipment package 100 illustrated in FIG. 2A, both pairs of isolation valves 102*a*/199*a* and 102*b*/199*b* are open and a flowline bypass valve 198 is closed so that substantially all of the production flow passing through the flowline 194 is sent through subsea equipment package 100. Accordingly, for those illustrative embodiments of the present disclosure wherein the subsea equipment package 100 includes, for example, a separator vessel 100*v*, the gas and liquid phases of the flow can be separated into separated liquid 101*a* and separated gas 101*b* as shown in FIG. 2A during normal equipment operation.

The subsea equipment package 100 may include an upper connection 108 that is connected to the separator vessel 100*v* by way of an upper isolation valve 107. In some embodiments, the upper connection 108 may be positioned at or near a high point of the subsea equipment package 100, such that it may be in fluid communication with the separated gas 101*b* when the upper isolation valve 107 is open. However, as shown in the illustrative operating configuration of the subsea equipment package 100 depicted in FIG. 2A, the upper isolation valve 107 is in a closed position, since there is nothing presently attached to the upper connection 108.

In certain embodiments, the subsea equipment package 100 may also include a lower connection 106 that is connected to the separator vessel 100*v* by way of a lower isolation valve 106. As shown in FIG. 2A, the upper connection 108 may positioned at or near a low point of the subsea equipment package 100, such that it may be in fluid communication with the separated liquid 101*a* when the lower isolation valve 105 is open. However, as previously noted with respect to the upper isolation valve 107, the lower isolation valve 105 is in a closed position during the illustrative operation configuration of FIG. 2A, since there is also nothing attached to the lower connection 106.

The subsea equipment package 100 may also include a chemical injection connection 110 that is connected to the separator vessel 100*v* by a chemical injection valve 109, and which may provide fluid communication between the separator vessel 100*v* and the chemical injection connection 110 when in the open position, as shown in FIG. 2A. In some embodiments a chemical injection line 189, which may include a chemical injection line isolation valve 188, may be attached to the chemical injection connection 110 by way of a chemical injection line connection 187. Depending on the operating requirements of the subsea equipment package 100, the chemical injection line 189 may include a single injection line or multiple individual injection lines, each of which may be used to inject one or more various chemicals, such as flow assurance chemicals and/or material protection chemicals and the like, into the subsea equipment package 100 from a chemical injection package (not shown), which may be a part of the subsea equipment installation 185 (see, FIG. 1). In at least some embodiments, the chemical injection connection 110 may be positioned at or near a high point of the subsea equipment package 100, such that it may be in fluid communication with the separated gas 101*b* when the chemical injection valve 109 is open, as shown in FIG. 2A. It should be appreciated that the location of the chemical injection connection 110 shown in FIG. 2A is illustrative only, as the connection 110 may be located at any one of several appropriate point or fluid levels on the separator vessel 100*v*. Moreover, multiple chemical injection connections 110 may also be used.

In certain exemplary embodiments, the subsea equipment package 100 may also include a pressure relief valve 112, which may be used to vent trapped gases and/or high pressure liquids directly into the subsea environment 180 during at least some equipment retrieval methods disclosed herein, and as will be further discussed below. The pressure relief valve 112 may connected to the separator vessel 100*v* by way of a relief isolation valve 111, and may also be positioned at or near a high point of the subsea equipment package 100, such that it may be in fluid communication with the separated gas 101*b* when the relief isolation valve 111 is open. However, as shown in FIG. 2A, the relief isolation valve 111 is typically kept in the closed position so as to avoid any inadvertent leakage through the pressure relief valve 112 during normal operation, and would typically only be opened during some equipment retrieval or installation operations.

In certain illustrative embodiments, any one or all of the various valves 102*a/b*, 199*a/b*, 105, 107, 109 and 111 shown in FIG. 2A may be manually operable. In other embodiments, any one or even all of the valves 102*a/b*, 199*a/b*, 105, 107, 109 and 111 may be remotely actuated, depending on the specific operational and control scheme of the subsea equipment package 100, whereas in still further embodiments the package 100 may include a combination of manually operable and remotely actuated valves. Furthermore, in at least some embodiment, any one or all of the above-listed valves may also have a mechanical override for operation via an ROV 195. Additionally, it should be noted that the various valves, piping components, and subsea connections shown in FIG. 2A and described above are associated with the various hydrocarbon removal and equipment depressurization, retrieval and replacement operations disclosed herein, and may not be the only such elements that may be a part of the subsea equipment package 100.

Accordingly, while the following descriptions of the systems and methods described herein may generally refer to the use of an ROV, such as the ROV 195, to perform valve actuation operations, it should be understood that such operations may not be so strictly limited, as it is well within the scope of the present disclosure to perform at least some, or even all, such operations manually and/or remotely, depending on the specific actuation capabilities of each individual valve, and the relevant circumstances associated with the subsea activities. Therefore, it should be appreciated that any reference herein to valve operation via an ROV should also be understood to include any other suitable method that may commonly be used to actuate valves in a subsea environment, e.g., manually and/or remotely.

It should be understood that the exemplary subsea equipment package 100 shown in FIG. 2A is depicted as including a single separator vessel 100*v* for purposes of illustrative simplicity only. As will be appreciated by one of ordinary skill in the art after having the benefit of a full reading of the present disclosure, the methods disclosed herein may be equally applicable to subsea equipment packages 100 that may also include, either additionally or alternatively, one or more other types of subsea equipment, such as pump(s), knockout drum(s), compressor(s), flow meter(s), and/or flow conditioner(s) and the like, as well various interconnecting piping and flow control components, such as pipe, fittings, flanges, valves and the like. Furthermore, it should also be appreciated that any illustrative embodiments of the subsea equipment packages 100 disclosed herein are not limited to any certain types of applications, but may be associated with subsea production or processing operations, as may be the case depending on the specific application requirements.

Figure 2B:
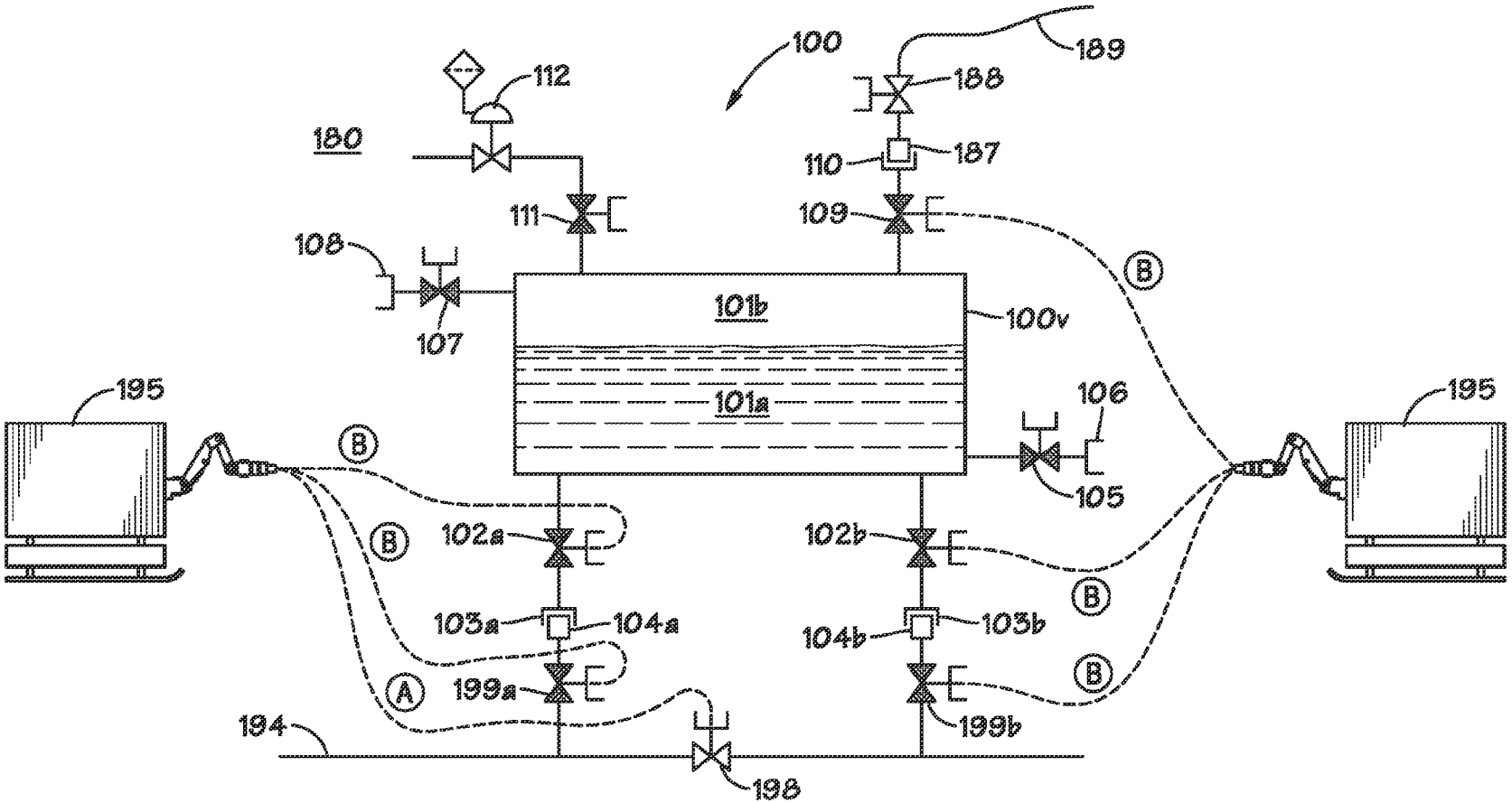

FIG. 2B schematically depicts some initial illustrative method steps that may be performed in preparation for the separation and removal of the subsea equipment package 100, wherein the package 100 may be isolated from the production flow passing through the flowline 194. As shown in FIG. 2B, isolation of the subsea equipment package 100 may proceed based on the following sequence:

A. Open flowline bypass valve 198 by operation of an ROV 195.

B. Close flowline isolation valves 199*a/b*, equipment isolation valves 102*a/b*, and chemical injection valve 109 by operation of an ROV 195.

In the equipment configuration illustrated in FIG. 2B, no production flow is passing through the subsea equipment package 100 after the flowline and isolation valves 199*a/b*, 102*a/b* have been closed (Step B). Instead, all of the production flow may be bypassing the package 100 and flowing through the previously opened flowline bypass valve 198 (Step A).

Figure 2C:
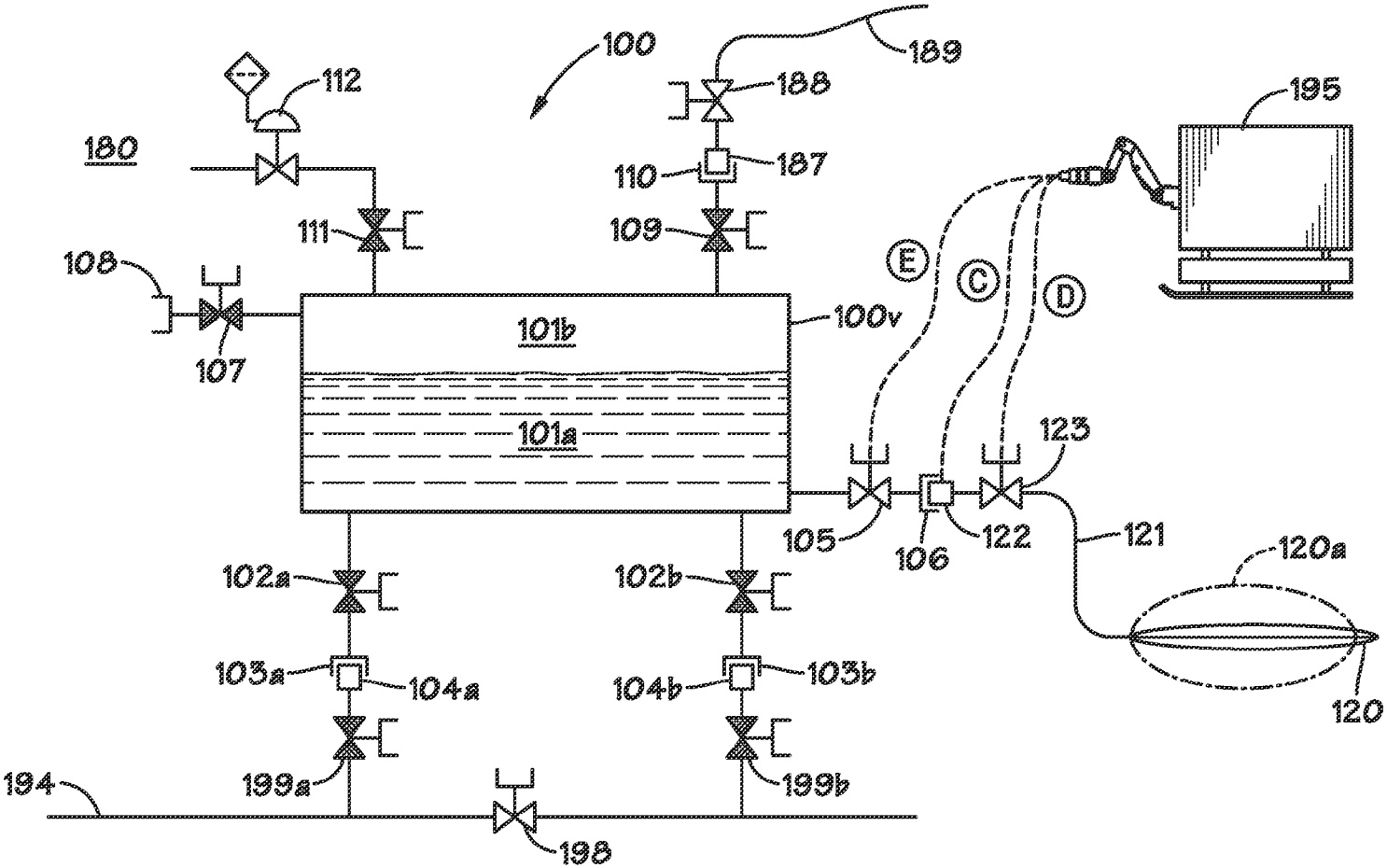

FIG. 2C schematically illustrates subsequent method steps that may be performed after the subsea equipment package 100 has been isolated from the flowline 194, and wherein at least a portion of the separated liquid 101*a* may be removed from the package 100, which may proceed based on the following steps:

C. Position an adjustable-volume subsea containment structure 120 adjacent to the subsea equipment package 100, and connect a containment structure connection 122 on the structure 120 to the lower connection 106 on the package 100 by operation of an ROV 195.

D. Open the lower isolation valve 105 by operation of an ROV 195.

E. Open a containment structure isolation valve 123 on the adjustable-volume subsea containment structure 120 by operation of an ROV 195.

In some embodiments of the present disclosure, the adjustable-volume subsea containment structure 120 may be configured in such a manner that the contained volume of the adjustable-volume subsea containment structure 120 may be flexible and/or adjustable. Furthermore, the adjustable-volume subsea containment structure 120 may also be configured so that the local hydrostatic pressure of the subsea environment 180 surrounding the structure 120 may have some amount of influence on the size of the adjustably-contained volume of the structure 120. For example, in some embodiments, the adjustable-volume subsea containment structure 120 may be a flexible subsea containment bag that is adapted to inflate or expand in a balloon-like manner as a fluid is introduced into the flexible subsea containment bag, and to contract back to its uninflated shape as the fluid is removed. In certain embodiments, the flexible subsea containment bag may be configured in substantially any suitable shape that may be capable of expanding and collapsing so as to adjust to the volume of fluid contained therein. For example, in some embodiments, a respective flexible subsea containment bag may be configured so as to have a roughly spherical shape when fully expanded, whereas in other embodiments the flexible subsea containment bag may be rectangularly configured so that it may have a roughly pillow-like shape when fully expanded. In still other embodiments a respective flexible subsea containment bag may be cylindrically configured so as to have a substantially hose-like shape when fully expanded. It should be appreciated, however, that above-described configurations are illustrative only, as other shapes may also be used, depending on various parameters such as the volume of fluid to be contained, handling considerations in both full and empty conditions, and the like.

In other embodiments, the adjustable-volume subsea containment structure 120 may be configured as an accumulator vessel, such as a bladder-type or piston-type accumulator, and the like. For example, when a bladder-type accumulator is used, fluid may be introduced to the inside of the accumulator bladder, whereas the outside of the accumulator bladder may be exposed to the local hydrostatic pressure of the subsea environment, so that the hydrostatic pressure may have some degree of influence on the size of, i.e., the volume that can be contained in, the accumulator bladder. On the other hand, when a piston-type accumulator is used, fluid may be introduced into the piston-type accumulator on one side of a movable piston, whereas the other side of the movable piston may be exposed to the subsea hydrostatic pressure, thereby allowing the hydrostatic pressure to influence the amount of fluid that can be contained on the fluid side of the movable piston.

Accordingly, the adjustable-volume subsea containment structure 120 may therefore be configured as any one of the several embodiments described above, or in any other configuration that may allow an adjustable or flexible volume of fluid to be contained under the influence of the local hydrostatic pressure of the subsea environment 180. However, for convenience of illustration and description, each of the various adjustable-volume subsea containment structures 120 shown in the attached figures and described herein may be substantially representative of a flexible subsea containment bag. Nonetheless, and in view of the above-noted illustrative and descriptive convenience, it should be understood that any reference herein to an "adjustable-volume subsea containment structure" may be equally applicable to any one or more of the adjustable-volume subsea containment structures described above, even though some aspects of a particular description, such as references to an "expanded" or "collapsed" containment structure, may imply the functionality of a flexible subsea containment bag.

In certain embodiments, the adjustable-volume subsea containment structure 120 may be substantially empty prior to being connected to the subsea equipment package 100 (Step C), and may therefore be substantially completely collapsed under the local hydrostatic pressure of the subsea environment. Additionally, the adjustable-volume subsea containment structure 120 may be of an appropriate size and strength so as to contain at least the separated liquid 101*a*, and furthermore may be of any appropriate shape or configuration so as to be readily handled by the ROV 195.

In some embodiments, the operating pressure inside of the subsea equipment package 100 may be greater than the local hydrostatic pressure of the subsea environment 180. In such cases, after the lower isolation valve 105 and the containment structure isolation valve 123 have been opened by the ROV 195 (Steps D and E), the higher pressure inside of the subsea equipment package 100 may cause at least a portion of the separated liquid 101*a* to flow through a containment structure flowline 121, which may be a flexible hose and the like, and into the adjustable-volume subsea containment structure 120. Furthermore, as a portion of the separated liquid 101*a* flows into the adjustable-volume subsea containment structure 120, the pressure inside of the subsea equipment package 100 may drop and an additional quantity of gas phase hydrocarbons may expand out of the liquid phase hydrocarbons present in the separated liquid 101*a*, thereby increasing the amount of separated gas 101*b* present in the separator vessel 100*v*. In certain embodiments, the adjustable-volume subsea containment structure 120 may therefore be at least partially filled with separated liquid 101*a*, and at least partially expanded until the pressure inside of the subsea equipment package 100 and the structure 120 is substantially balanced with the local hydrostatic pressure of the subsea environment 180, as is indicated by the dashed-line containment structure outline 120*a*.

Figure 2D:
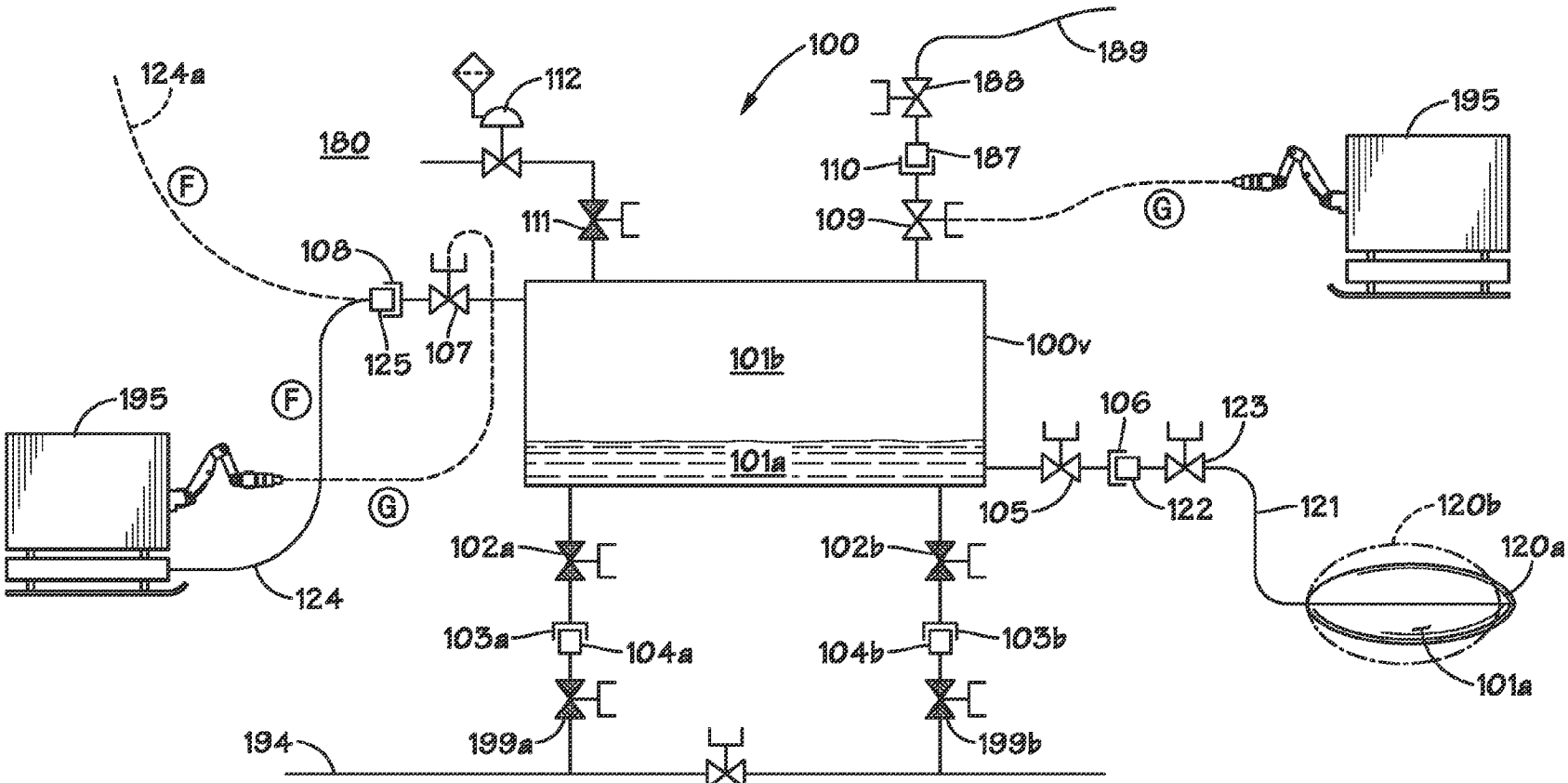

FIG. 2D schematically illustrates further hydrocarbon removal steps that may be performed after the pressure differential between the subsea equipment package 100 and the subsea environment 180 has caused at least a portion of the separated liquid 101*a* to flow into the expanded adjustable-volume subsea containment structure 120*a*. Thereafter, in some embodiments the following additional steps may be performed so as to flush and substantially remove the remaining portion of separated liquid 101*a* from the subsea equipment package 100, which may proceed based on the following steps:

F. Position an ROV 195 adjacent to the subsea equipment package 100 and connect an umbilical connection 125 of an umbilical line 124 to the upper connection 108 on the package 100 by operation of the ROV 195. Alternatively, connect an umbilical connection 125 of a drop line umbilical 124*a* to the upper connection 108 by operation of an ROV 195.

G. Open the upper isolation valve 107 by operation of an ROV 195.

In some illustrative embodiments, an ROV 195 may carry a quantity of flow assurance chemicals, such as MeOH and/or MEG and the like, in a tank positioned in a belly skid (not shown) of the ROV 195. Once the umbilical line 124 has been connected to the upper connection 108 via the umbilical connection 125 (Step F) and the upper isolation valve 107 has been opened (Step G), the flow assurance chemicals carried by the ROV 195 may be pumped through the umbilical line 124 and into the subsea equipment package 100 so as to flush substantially all of the remaining portion of separated liquid 101*a* from the separator vessel 100*v* and into the expanded adjustable-volume subsea containment structure 120*a*, which is thereby further expanded as is indicated by the dashed-line containment structure outline 120*b* shown in FIG. 2D. Alternatively, and depending on the quantity of flow assurance chemicals that may be required to flush substantially all of the remaining portion of separated liquid 101*a* from the subsea equipment package 100, the flow assurance chemicals may be pumped through the drop line umbilical 124*a* that has been dropped from the surface 191 (see, FIG. 1), e.g., from a tank (not shown) containing flow assurance chemicals that is positioned on the intervention vessel 190 (see, FIG. 1).

In at least some illustrative embodiments of the present disclosure, the flow assurance chemicals used to flush substantially all of the remaining portion of separated liquid 101*a* from the subsea equipment package 100 may not be pumped through the upper connection 108. Instead, it may be desirable to use an existing chemical injection package (not shown) that may already be a part of the subsea equipment installation 185 (see, FIG. 1) to pump a quantity of flow assurance chemicals through the chemical injection line 189 and into the subsea equipment package 100 by way of the chemical injection connection 110. Accordingly, an alternate Step G may be performed as shown in FIG. 2D, which would involve opening the chemical injection valve 109 by operation of an ROV 195, after which flow assurance chemicals may be pumped into the subsea equipment package 100 so as to flush substantially all of the remaining portion of separated liquid 101*a* into the expanded adjustable-volume subsea containment structure 120*a* as previously described.

Figure 2E:
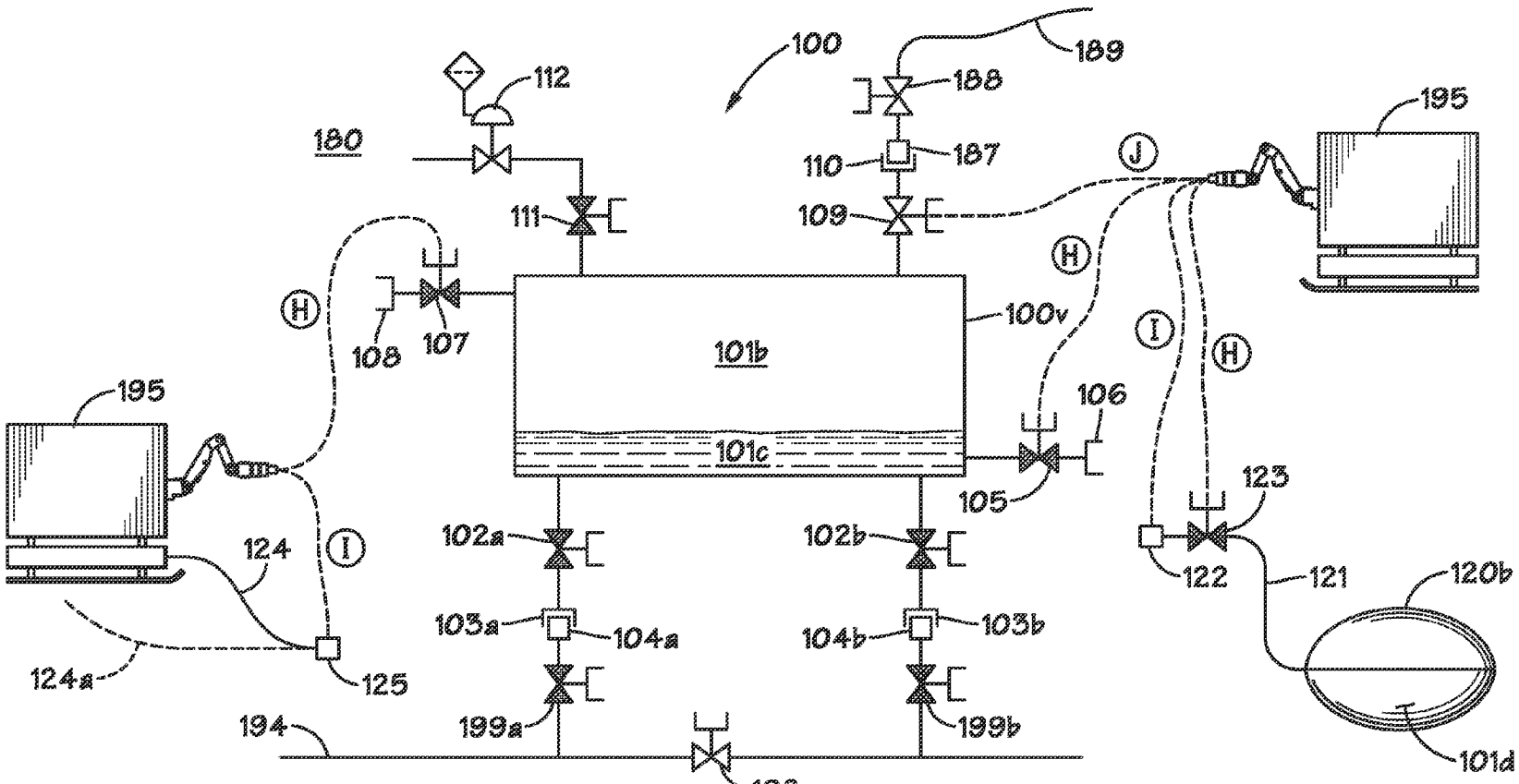

FIG. 2E schematically illustrates the subsea equipment package 100 of FIG. 2D after substantially all of the remaining portion of separated liquid 101*a* has been flushed from the package 100 and into a further expanded adjustable-volume subsea containment structure 120*b*. As shown in FIG. 2E, the separator vessel 100*v* may then contain the separated gas 101*b* and a quantity of flow assurance chemicals 101*c*, which may in certain embodiments contain an amount of separated liquid 101*a* that may not have been fully flushed from the separator vessel 100*v*. Additionally, the further expanded adjustable-volume subsea containment structure 120*b* may contain a mixture 101*d* that includes, among other things, the separated liquid 101*a* (e.g., liquid phase hydrocarbons and produced water) and some amount of the flow assurance chemicals 101*c* that were used to flush the subsea equipment package 100.

FIG. 2E also depicts at least some further illustrative steps that may be performed in conjunction with the equipment depressurization and retrieval process, which may include the following steps:

H. Close the upper and lower isolation valves 107 and 105 and the containment structure isolation valve 123 by operation of an ROV 195.

I. Disconnect the containment structure connection 122 from the lower connection 106 and the umbilical line connection 125 from the upper connection 103 by operation of an ROV 195.

J. Open the chemical injection valve 109 by operation of an ROV 195.

In those illustrative embodiments wherein the flow assurance chemicals used to flush the subsea equipment package 100 are pumped through the upper connection 108, the upper isolation valve 107 first closed (Step H), and the umbilical line connection 125 on the umbilical line 124 (or alternatively, on the drop line umbilical 124*a*) may then be disconnected from the connection 108 (Step I). Thereafter, the chemical injection valve 109 may be opened (Step J) and the pressure inside of the subsea equipment package 100 may be lowered to substantially equal the local hydrostatic pressure of the subsea environment 180 by bleeding the pressure down through the chemical injection line 189 prior to separating the package 100 from the flowline 194, as will be further described with respect to FIG. 2F below. In other illustrative embodiments, such as when the chemical injection line 189 is used to flush substantially all of the remaining portion of the separated liquid 101*a* from the separator vessel 100*v* (see, FIG. 2D and alternate Step G, described above), the chemical injection valve 109 may remain open so that the pressure bleeding operation on the subsea equipment package 100 may be performed as described above.

Figure 2F:
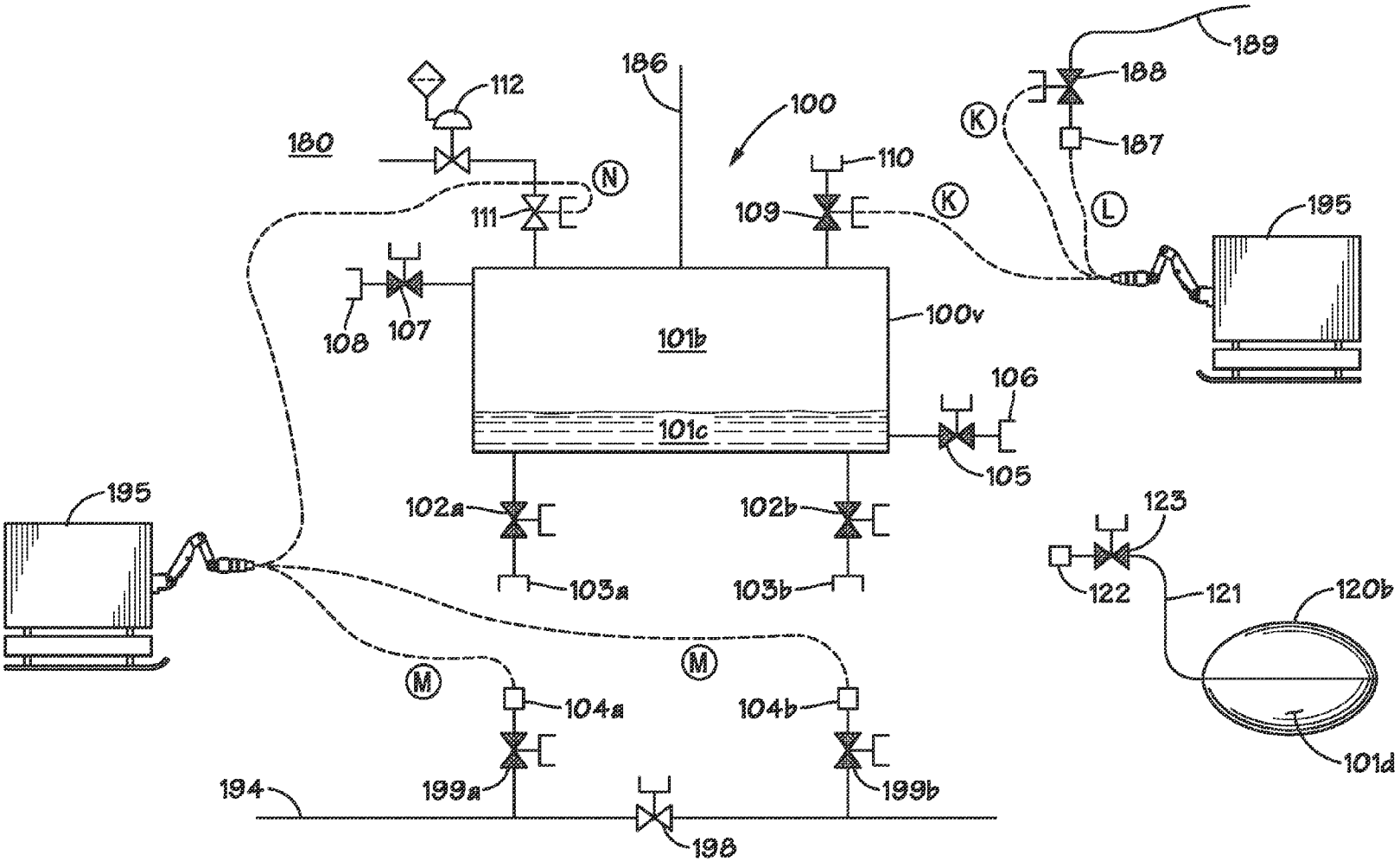

FIG. 2F illustrates some additional steps that may be performed so as to separate the subsea equipment package 100 from the flowline 194 and retrieve the package 100 to the intervention vessel 190 at the surface 191 (see, FIG. 1), which may include, among other things, the following:

K. Close the chemical injection valve 109 and the chemical injection line isolation valve 188 by operation of an ROV 195.

L. Disconnect the chemical injection line connection 187 from the chemical injection connection 110 by operation of an ROV 195.

M. Disconnect the first and second equipment connections 103*a/b* from the respective flowline connections 104*a/b* by operation of an ROV 195.

As shown in FIG. 2F, once the chemical injection valve 109 has been closed (Step K) and the chemical injection line 189 has been disconnected from the subsea equipment package 100 (Step L), the package 100 may be separated from the flowline 194 by disconnecting the equipment connections 103*a/b* from the respective flowline connections 104*a/b* (Step M). Thereafter, the lift line 186 may be attached to the subsea equipment package 100, which may then be retrieved to surface 191 by use of the crane 197 positioned on the intervention vessel 190 (see, FIG. 1). In certain embodiments, the subsea equipment package 100 may be lifted to the surface 191 with all valves closed, such that pressure is trapped in package 100 at a level that is substantially the same as the local hydrostatic pressure of the subsea environment 180 at the installation position of the package 100. In such embodiments, the pressure in the equipment may be released and at least a portion of the separated gas 101*b* vented from the subsea equipment package 100 after it has reached the intervention vessel 190.

In other illustrative embodiments, at least one valve on the subsea equipment package 100, such as, for example, the chemical injection valve 109 or the upper isolation valve 107, may be opened prior to raising the package 100 to the surface 191. In this way, the internal pressure in the subsea equipment package 100 may self-adjust to the changing hydrostatic pressure of the subsea environment 180 as it is raised to the surface 191, so that pressure in the package 100 may be at substantially ambient conditions once it reaches the intervention vessel 190. However, in such embodiments, any separated gas 101*b* present in the subsea equipment package 100 may be vented through the open valve or valves in a substantially uncontrolled manner.

As shown in FIG. 2F, in at least some embodiments, additional steps may be taken prior to lifting the subsea equipment package 100 from its installation location at or near the sea floor 192 so that: 1) pressure is not trapped in the package 100 when it arrives at the intervention vessel 190; or 2) the separated gas 101*b* in the package 100 is not vented to the subsea environment 180 in a substantially uncontrolled manner. These additional steps include, but may not necessarily be limited to, the following:

N. Open the relief isolation valve 111 by operation of an ROV 195.

When the relief isolation valve 111 is opened prior to equipment retrieval to the surface 191 (Step N), the pressure relief valve 112 may then release pressure and vent at least a portion of the separated gas 101*b* from the subsea equipment package 100 in a highly controllable manner. For example, in some embodiments, the relief valve 112 may adjusted so that venting occurs substantially throughout the raising operation that is performed using the crane 197 and the lift line 186. In other embodiments, the relief valve 112 may be adjusted so that venting does not commence until a certain hydrostatic pressure level has been reached, i.e., after the subsea equipment package 100 has been raised to a pre-determined water depth. In still other embodiments, venting may not occur until a specific command signal is received by the pressure relief valve 112. It should be appreciated that these venting schemes are illustrative only, as other schemes may also be employed.

Figure 2G:
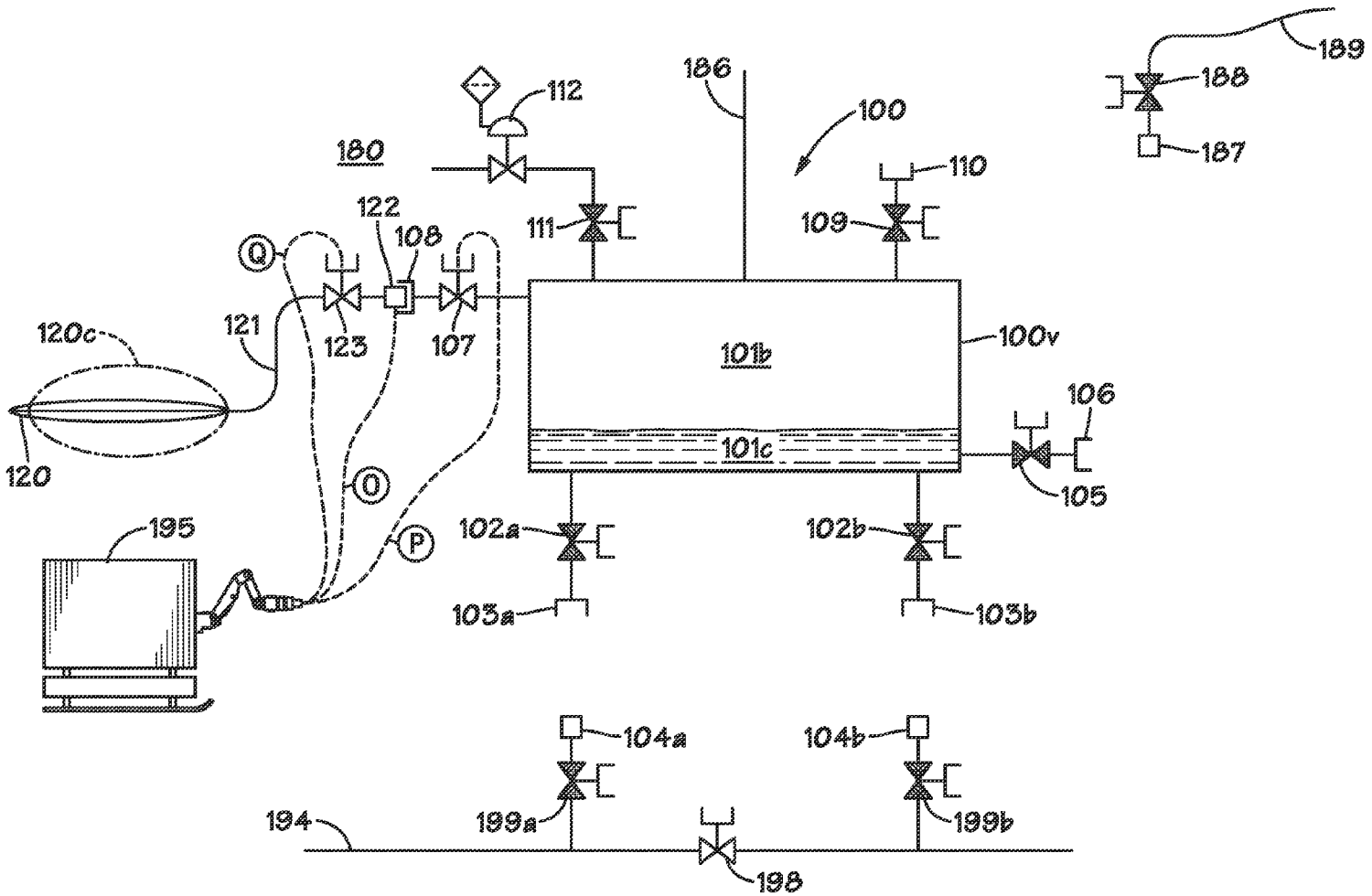
FIG. 2G schematically illustrates an alternative embodiment of the illustrative equipment retrieval methods shown in FIGS. 2A-2F.

FIG. 2G schematically illustrates an alternative approach that may be used in some embodiments to retrieve the subsea equipment package 100 to the surface 191 at a substantially reduced internal pressure, and without venting any of the separated gas 101*b* to the subsea environment 180 while the package 100 is being lifted to the intervention ship 190. The alternative equipment retrieval method shown in FIG. 2G may include the following steps:

O. Position an adjustable-volume subsea containment structure 120 adjacent to the subsea equipment package 100, and connect a containment structure connection 122 on the structure 120 to the upper connection 108 on the package 100 by operation of an ROV 195.

P. Open the upper isolation valve 107 by operation of an ROV 195.

Q. Open a containment structure isolation valve 123 on the adjustable-volume subsea containment structure 120 by operation of an ROV 195.

In certain embodiments, the adjustable-volume subsea containment structure 120 may be substantially empty prior to being connected to the subsea equipment package 100 (Step O), and may therefore be substantially completely collapsed under the local hydrostatic pressure of the subsea environment. After the upper isolation valve 107 and the containment structure isolation valve 123 have been opened (Steps P and Q), the adjustable-volume subsea containment structure 120 may be in fluid communication with the subsea equipment package 100, with both the structure 120 and the package 100 at substantially the same hydrostatic equilibrium pressure, since the pressure in the package may have been previously reduced to the local hydrostatic pressure of the subsea environment (see, FIG. 2E and Step J above). Therefore, as the subsea equipment package 100 and the adjustable-volume subsea containment structure 120 are raised to the surface 191 by lift line 186, and the local hydrostatic pressure of the surrounding subsea environment 180 gradually drops, the higher pressure inside of the package 100—which was initially trapped in the package 100 at the hydrostatic pressure level near the sea floor 192—will cause at least a portion of the separated gas 101*b* to expand into the structure 120, thereby causing the structure 120 to expand (indicated by the dashed-line containment structure outline 120*c* shown in FIG. 2G) so as to maintain pressure equilibrium. In this way, the pressure in the subsea equipment package 100 may be gradually reduced as the package 100 and the attached adjustable-volume subsea containment structure 120 are raised to the surface. Furthermore, in at least some illustrative embodiments, and depending on the amount of separated gas 101*b* trapped in the subsea equipment package 100, the adjustable-volume subsea containment structure 120 used during equipment retrieval may be appropriately sized so as to contain a sufficient quantity of expanding gas such that the package 100 and expanded adjustable-volume subsea containment structure 120*c* may be at or near substantially ambient pressure conditions once the equipment has reached the surface.

In at least some embodiments disclosed herein, such as the embodiment illustrated in FIG. 2F, the further expanded adjustable-volume subsea containment structure 120*b* containing the mixture 101*d* of separated liquid 101*a* and flow assurance chemicals 101*c* (see, FIG. 2E) may be left at or near the sea floor 192 (see, FIG. 1) and adjacent to the installation position of the subsea equipment package 100. In this way, the adjustable-volume subsea containment structure 120*b* may later be connected to a replacement subsea equipment package, such as the replacement subsea equipment package 200 shown in FIGS. 3A-3J, so that the mixture 101*d* contained therein can be injected into the replacement package 200 prior to bringing the replacement package 200 into service, as will be further discussed below.

Figure 3A:
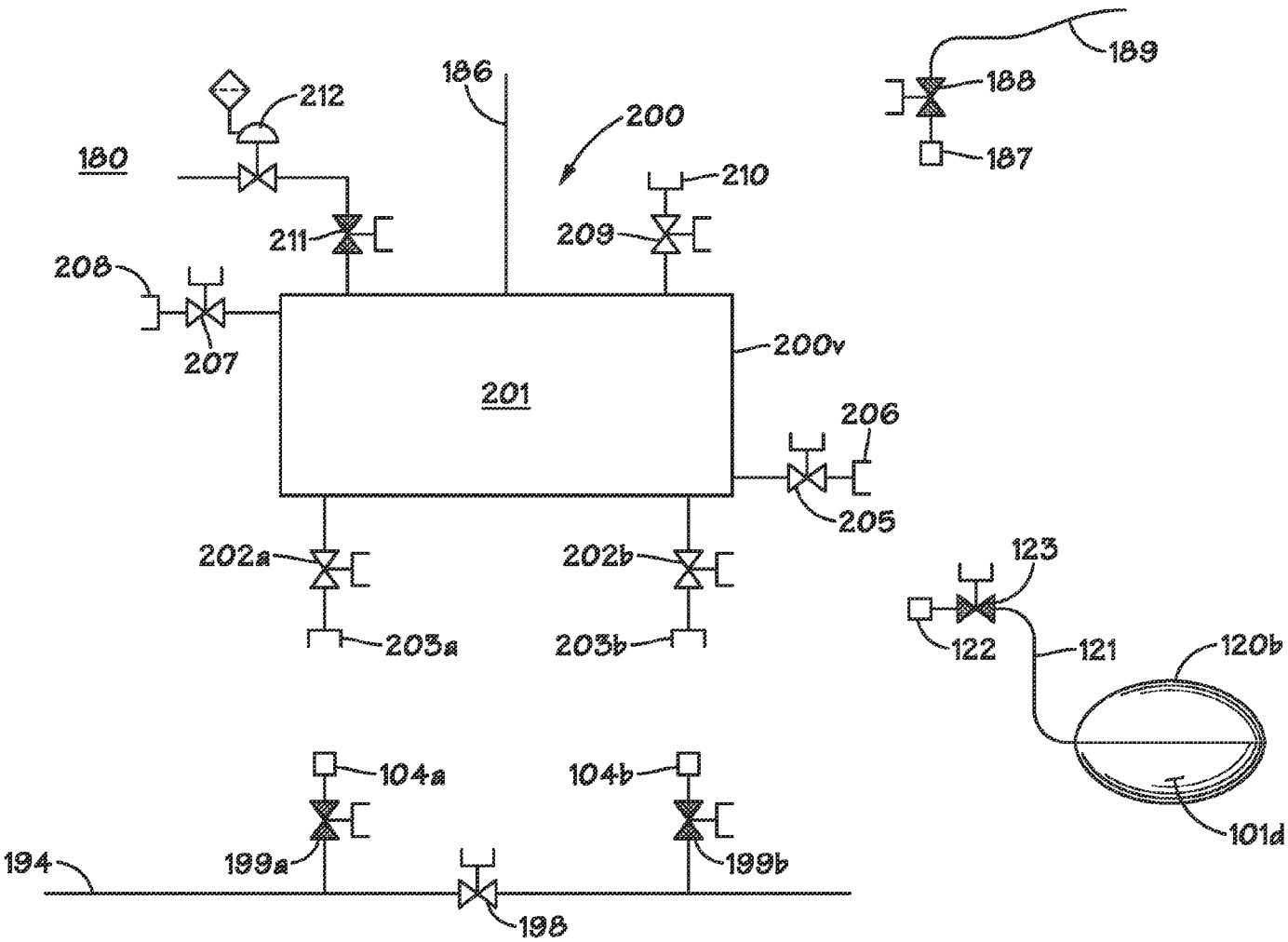
FIGS. 3A-3E schematically illustrate one exemplary method that may be used to replace subsea equipment in accordance with at least some embodiments disclosed herein.

FIGS. 3A-3J schematically depict various exemplary methods that may be used to deploy a replacement subsea equipment package 200 to a subsea equipment installation 185 (see, FIG. 1) in accordance with illustrative embodiments of the present disclosure. In at least some embodiments, the replacement subsea equipment package 200 may be substantially similar to the previously retrieved subsea equipment package 100 illustrated in FIGS. 2A-2G and described above. Accordingly, the various valve and piping tie-in elements shown on the replacement subsea equipment package 200 are similarly configured and illustrated as the corresponding elements shown on subsea equipment package 100 of FIGS. 2A-2G. Furthermore, the reference numbers used to identify the various elements of the replacement subsea equipment package 200 illustrated in FIG. 3A are the same as like elements of the subsea equipment package 100 shown in FIGS. 2A-2G, except that the leading numeral has been changed from a "1" to a "2," as may be appropriate. For example, the separator vessel "100*v*" on the subsea equipment package 100 corresponds to, and is substantially similar to, the separator vessel "200*v*" on the replacement subsea equipment package 200, the upper connection "108" on the package 100 corresponds to, and is substantially similar to, the upper connection "208" on the package 200, and so on. Accordingly, the reference number designations used to identify some elements of the replacement subsea equipment package 200 may be illustrated in FIGS. 3A-3J, but may not be specifically described in the following disclosure. In those instances, it should be understood that the various numbered elements shown in FIGS. 3A-3J which may not be described in detail below substantially correspond with their like-numbered counterparts of the subsea equipment package 100 illustrated in FIGS. 2A-2G and described in the associated disclosure set forth above.

Turning now to the referenced figures, FIGS. 3A-3E schematically depict various steps in an illustrative method that may be used to deploy and install a replacement subsea equipment package 200. More specifically, FIG. 3A shows an illustrative replacement subsea equipment package 200 that is positioned near a subsea equipment location where the subsea equipment package 100 described above may have been removed from service and retrieved to the surface 191 (see, FIG. 1) by using one or more of the methods described with respect to FIGS. 2A-2G above. As shown in FIG. 3A, the replacement subsea equipment package 200 may be lowered into the appropriate position adjacent to the flowline connections 104*a/b* on the flowline 194 by the lift line 186 by operation of the crane 197 on the intervention vessel 190 (see, FIG. 1). In certain embodiments, the adjustable-volume subsea containment structure 120*b*, which may contain the mixture 101*d* that was previously removed from the subsea equipment package 100 prior to it retrieval, is also positioned adjacent to the subsea equipment location, as previously noted with respect to FIG. 2F above. Furthermore, in those embodiments where a chemical injection package (not shown) may be used to inject one or more various flow assurance chemicals into the replacement subsea equipment package 200 through the chemical injection connection 210 during the equipment replacement process and/or during normal equipment operation, the chemical injection line 189 may not yet be connected to package 200, but may be positioned adjacent thereto as the package 200 is lowered into position.

As shown in FIG. 3A, in certain illustrative embodiments, the replacement subsea equipment package 200 may be deployed to the subsea equipment location with at least two or more valves open to the subsea environment. In this way, any air inside of the replacement subsea equipment package 200 may substantially escape as the package 200 is being lowered to the sea floor 192 (see, FIG. 1), so that the package substantially fills with seawater 201, and so that the pressure inside of the package 200 substantially adjusts to the local hydrostatic pressure of the subsea environment 180. For example, as illustrated in FIG. 3A, each of the equipment isolation valves 202*a/b*, the upper and lower isolation valves 207 and 205, and chemical injection valve 209 are all open to the subsea environment 180. On the other hand, the relief isolation valve 211 may remain closed, as is typically the case for most operating conditions of the subsea equipment package 200, except for some instances when the relief isolation valve 211 may be opened during certain retrieval operations (see, FIG. 2F and Step N, described above).

Figure 3B:
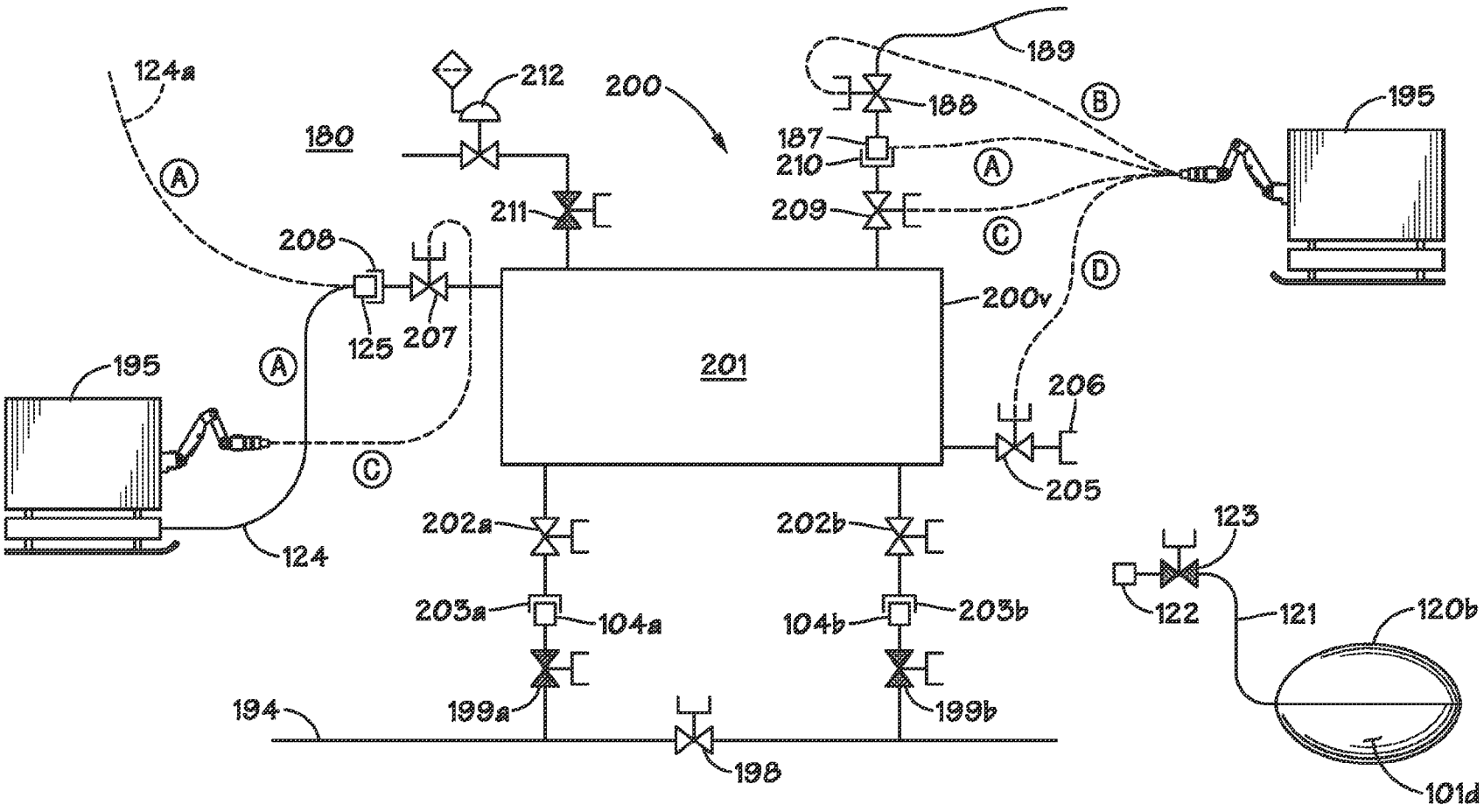

FIG. 3B schematically depicts the replacement subsea equipment package 200 of FIG. 3A after the package 200 has been landed on the flowline 194, and the first and second equipment connections 203*a* and 203*b* have been sealingly connected to the respective first and second flowline connections 104*a* and 104*b*. During the landing and connection operation, all valves may remain open so as to provide adequate pressure adjustment and/or sufficient venting of the seawater 201 to facilitate the make-up of the equipment connections 203*a/b* to the flowline connections 104*a/b*. Thereafter, all valves may be closed except for the first and second equipment isolation valves 202*a* and 202*b*. In the operating configuration shown in FIG. 3B, the first and second flowline isolation valves 199*a* and 199*b* are both closed and the flowline bypass valve 198 is open so that any produced fluids may flow through the flowline 194 but bypass the replacement subsea equipment package 200.

FIG. 3B further illustrates some initial equipment replacement steps that may be used to begin the integration of the replacement subsea equipment package 200 into service, which may include, among other things, the following:

A. Connect the chemical injection line connection 187 on the chemical injection line 189 to the chemical injection connection 210 on the replacement subsea equipment package by operation of an ROV 195.

B. Open the chemical injection line isolation valve 188 by operation of an ROV 195.

C. Open the chemical injection valve 209 by operation of an ROV 195.

D. Open the lower isolation valve 205 by operation of an ROV 195.

After chemical injection line 189 has been connected to the replacement subsea equipment package 200 (Step A) each of the valves 188, 209 and 205 have been opened (Steps B, C, and D), one or more appropriate flow assurance chemicals, such as MeOH, MEG and the like, may be pumped into the package 200 through the chemical injection line 189 so as to mix with at least a portion of the seawater 201 inside of the separator vessel 200*v*, and to displace at least another portion of the seawater out of the separator vessel 200*v* through the open lower isolation valve 205 and the lower connection 206. In this way, hydrate formation may be substantially avoided, or at least minimized, when liquid phase hydrocarbons are later introduced in into the replacement subsea equipment package 200, such as from the adjustable-volume subsea containment structure 120*b*, due to the presence of flow assurance chemicals in the seawater 201.

In an alternative method to injecting flow assurance chemicals into the replacement subsea equipment package 200 through the chemical injection connection 210, an ROV 195 may be used to inject the required quantity of flow assurance chemicals into the package 200 in a substantially same manner as described above. For example, in some illustrative embodiments, the ROV 195 may carry a quantity of flow assurance chemicals in a tank positioned in a belly skid (not shown) of the ROV 195, which, in an alternate Step A shown in FIG. 3B, may then be connected via an umbilical line 124 and umbilical connection 125 to the upper connection 208 on the subsea equipment package 200. Thereafter, in an alternate Step C, the ROV may be used to open the upper isolation valve 207, and the flow assurance chemicals carried by the ROV 195 may be pumped through the umbilical line 124 and into the replacement subsea equipment package 200 so as to mix with at least a portion of the seawater 201, and to displace at least another portion of the seawater 201 out of the lower connection 206 as previously described. As yet another alternative approach, instead of pumping flow assurance chemicals into the replacement subsea equipment package from an ROV 195, a drop line umbilical 124*a* may be dropped from the intervention vessel 190 at the surface 191 (see, FIG. 1), which may then be connected via an umbilical connection 125 to the upper connection 208. Thereafter, the ROV 195 may be used to open the upper isolation valve 207 as per alternate Step C above, and flow assurance chemicals may then be pumped through the drop line umbilical 124*a* from the surface 191 and into the replacement subsea equipment package 200 as previously described.

Figure 3C:
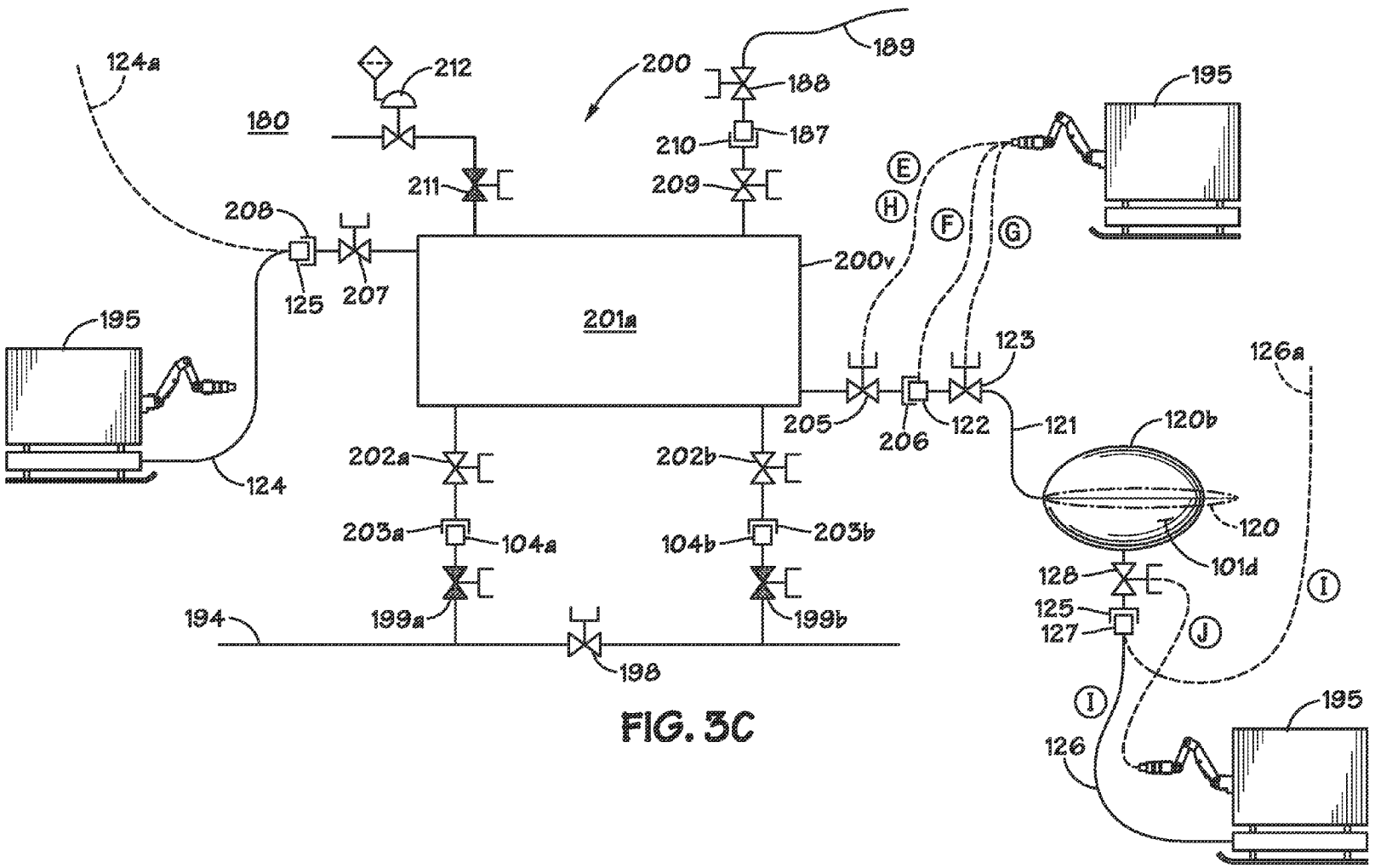

FIG. 3C schematically illustrates the replacement subsea equipment package 200 after completion of the steps shown in FIG. 3B and described above, wherein package 200 is substantially filled with a mixture 201*a* that may be made up of at least a portion of the seawater 201 that entered the package 200 as it was lowered from the surface 191 (see, FIG. 1) and flow assurance chemicals that were injected into the package 200 as described above. FIG. 3C further illustrates at least some additional operational steps that may be used to inject the mixture 101*d* that was previously removed from the subsea equipment package 100 (see, FIGS. 2C and 2D, described above) back into the replacement subsea equipment package 200, and which may include the following:

E. Close the lower isolation valve 205 by operation of an ROV 195.

F. Position the adjustable-volume subsea containment structure 120*b* adjacent to the replacement subsea equipment package 200, and connect the containment structure connection 122 on the structure 120*b* to the lower connection 205 by operation of an ROV 195.

G. Open the containment structure isolation valve 123 on the adjustable-volume subsea containment structure 120*b* by operation of an ROV 195.

H. Re-open the lower isolation valve 205 by operation of an ROV 195.

In certain embodiments, after the adjustable-volume subsea containment structure 120*b* containing the mixture 101*d* of separated liquid 101*a* and flow assurance chemicals 101*c* has been connected to the replacement subsea equipment package 200 (Step F), the pressure between the package 200 and the structure 120*b* may be substantially equalized across the lower isolation valve 205 prior to re-opening the valve 205 (Step H). In some illustrative embodiments, pressure equalization across the lower isolation valve 205 may be accomplished by adjusting the pressure in the package 200 through the chemical injection line 189 that is connected to the chemical injection connection 210. In other embodiments, such as when a chemical injection line 189 and chemical injection system (not shown) may not even be a part of the subsea equipment installation 185 (see FIG. 1), pressure equalization may be accomplished by adjusting pressure in the replacement subsea equipment package 200 through the umbilical line 124 on the ROV 195 (or through the alternate drop line umbilical 124*a*) that may be connected to the upper connection 208.

After the pressure between the replacement subsea equipment package 200 and the adjustable-volume subsea containment structure 120*b* has been substantially equalized through the chemical injection connection 210 or the upper connection 208 as described above, the lower isolation valve 205 may then be re-opened (Step H) so as to provide fluid communication between the package 200 and the structure 120*b*. Thereafter, the pressure inside of the replacement subsea equipment package 200 and the adjustable-volume subsea containment structure 120*b* may be lowered to a pressure that is less than the local hydrostatic pressure of the subsea environment 180, which may thus cause the structure 120*b* to collapse, the contents 101*d* of the structure 120*b* to be transferred into the separator vessel 200*v*, and the mixture 201*a* to be displaced into one of the chemical injection line 189, the umbilical line 124, or the drop line umbilical 124*a*, depending on which line is being used to draw down the pressure in the package 200. During this operation, the adjustable-volume subsea containment structure 120*b* may collapse back to a substantially empty condition, as is indicated by the dashed-line containment structure outline 120 shown in FIG. 3C.

In certain embodiments, the pressure in the replacement subsea equipment package 200 and the adjustable-volume subsea containment structure 120*b* may be lowered by using a suitably designed pump and/or choke (not shown) that may be mounted on the separator vessel 200*v*, whereas in other embodiments the pressure may be drawn down on the package 200 and structure 120*b* through the chemical injection line 189 by operation of a chemical injection system (not shown). In still other embodiments, the pressure in the replacement subsea equipment package 200 and the adjustable-volume subsea containment structure 120*b* may be drawn down through the upper connection 208, e.g., through the umbilical line 124 by using a pump (not shown) on the ROV 195, or through the drop line umbilical 124*a* by way of a pump positioned on the intervention vessel 190 at the surface 191 (see, FIG. 1).

After the above-described steps have been completed, additional steps may be taken in certain illustrative embodiments in order to ensure that substantially all of the mixture 101*d* has been pushed out of the adjustable-volume subsea containment structure 120*b* and the containment structure flowline 121 and into the replacement subsea equipment package 200, which steps may include, among other things, the following:

I. Position an ROV 195 adjacent to the adjustable-volume subsea containment structure 120*b* and connect an umbilical connection 127 of an umbilical line 126 to a second containment structure connection 125 on the structure 120*b* by operation of the ROV 195. Alternatively, connect an umbilical connection 125 of a drop line umbilical 126*a* to the second containment structure connection 125 by operation of an ROV 195.

J. Open a second containment structure isolation valve 128 by operation of an ROV 195.

After the umbilical line 126 (or drop line umbilical 126*a*) has been connected to the adjustable-volume subsea containment structure 120*b* (Step I) and the second containment structure isolation valve 128 opened (Step J), flow assurance chemicals may be pumped through the structure 120*b*, the containment structure flowline 121, and the lower isolation valve 205 and into the replacement subsea equipment package 200, thereby flushing substantially all of the remaining portion of the mixture 101*d* into the package 200.

Figure 3D:
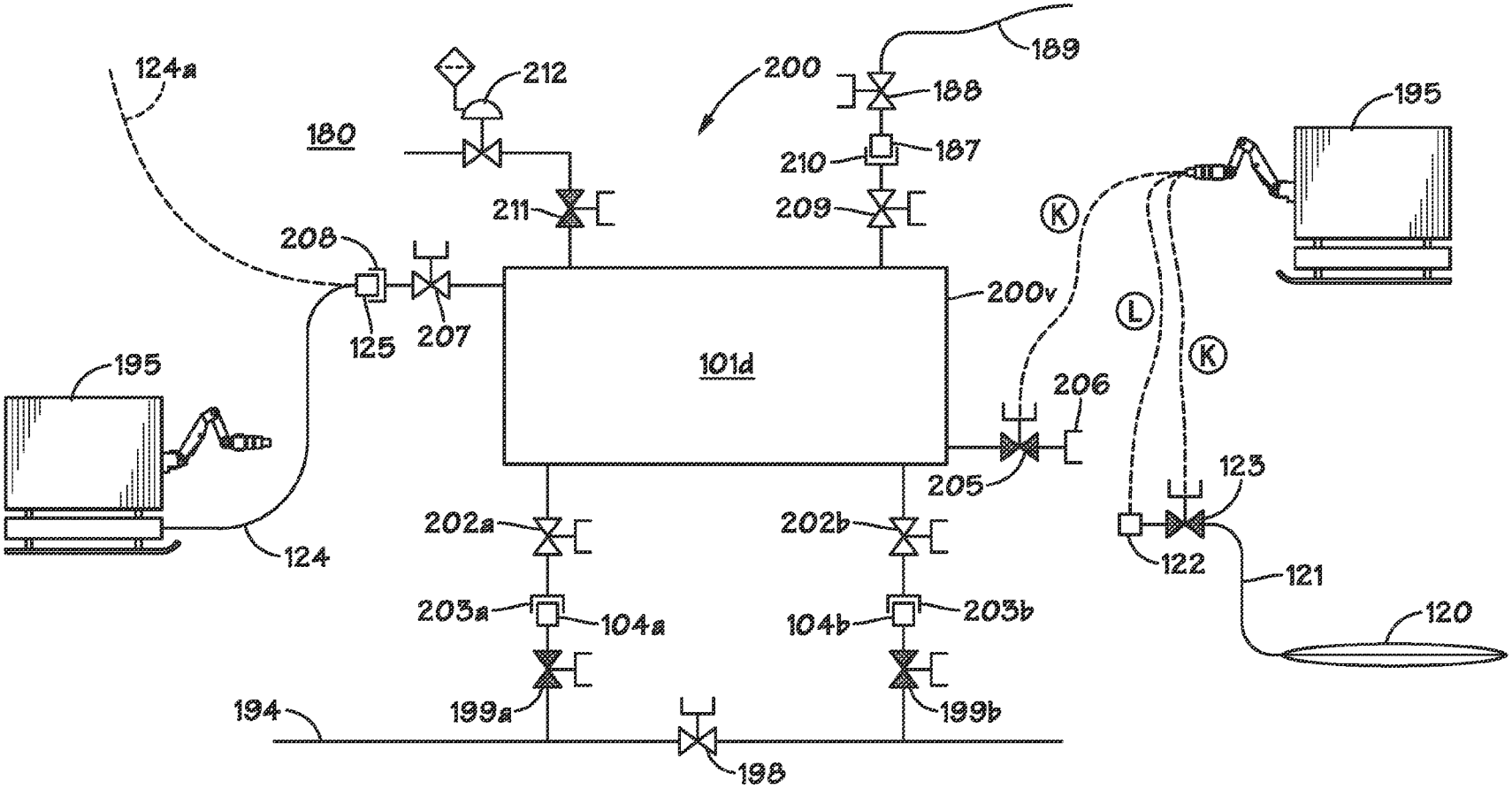

FIG. 3D schematically depicts the replacement subsea equipment package 200 of FIGS. 3A-3C after completion of the above-described steps, wherein, in certain embodiments, the package 200 may be substantially filled with the mixture 101*d* of separated liquid 101*a* (which may include, among other things, liquid phase hydrocarbons and produced water) and flow assurance chemicals 101*c* (see, FIGS. 2C-2E). FIG. 3D further shows additional steps that may be performed in preparation for bringing the replacement subsea equipment package 200 on line, which steps may include the following:

K. Close the lower isolation valve 205 by operation of an ROV 195. Alternatively, the containment structure isolation valve 123 on the now-substantially empty adjustable-volume subsea containment structure 120 may also be closed by operation of an ROV 195.

L. Disconnect the containment structure connection 122 from the lower connection 206 by operation of an ROV 195.

In certain embodiments, after the lower isolation valve 205 has been closed (Step K) and the fully-collapsed adjustable-volume subsea containment structure 120 has been removed from the replacement subsea equipment package 200 (Step L), pressure may then be equalized between the package 200 and the flowline 194 across the flowline isolation valves 199*a/b*. As previously described, this may be accomplished by adjusting the pressure in the replacement subsea equipment package 200 through the chemical injection connection 210 by operation of a chemical injection package (not shown), or through the upper connection 208 by operation of a pump (not shown) on the ROV 195 via the umbilical line 124, or a pump (not shown) on the intervention vessel 190 (not shown) via the drop line umbilical 124*a*.

Figure 3E:
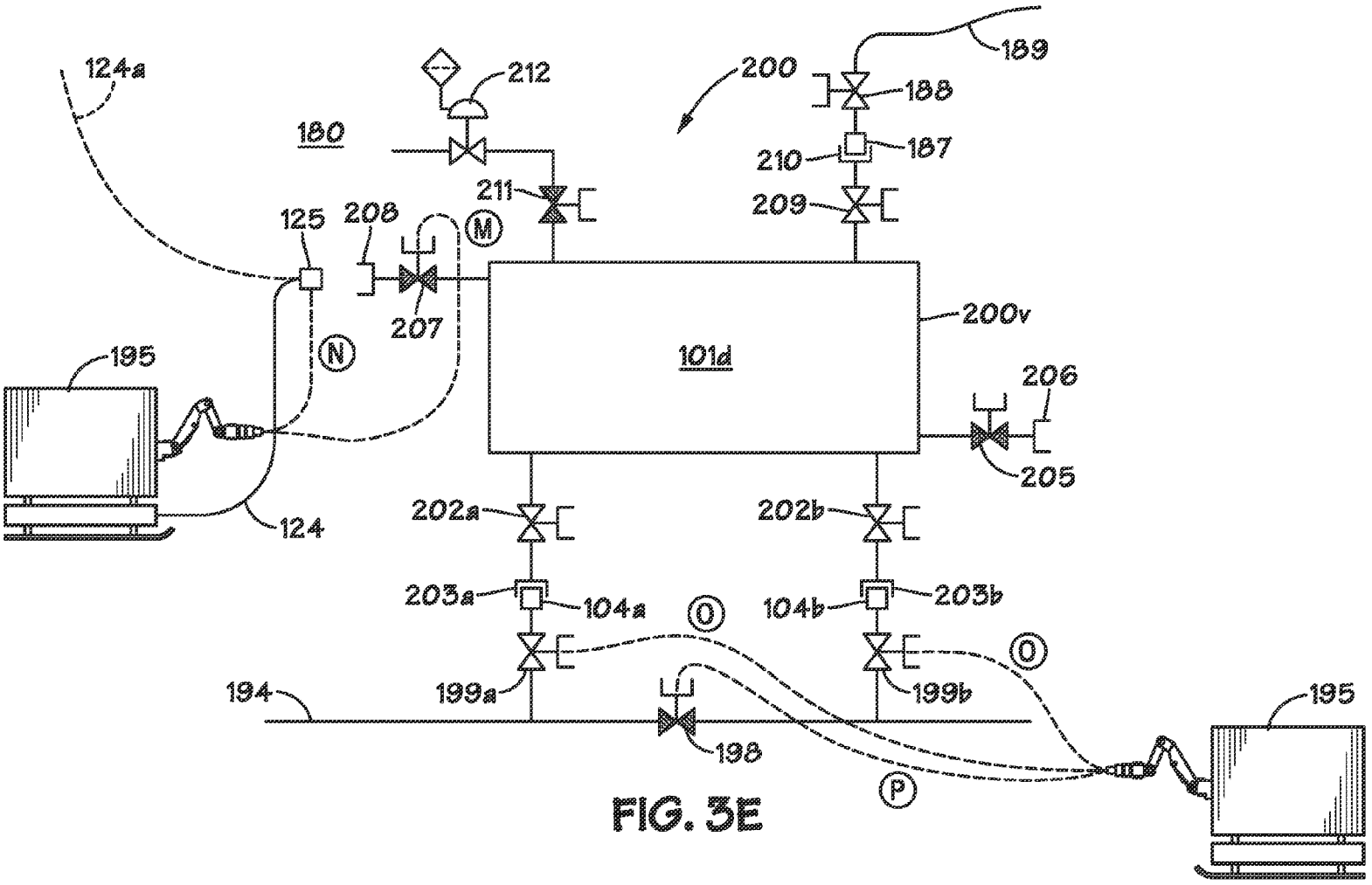

FIG. 3E schematically illustrates further additional steps that may be performed so as to bring the replacement subsea equipment package 200 online by creating fluid communication between the flowline 194 and the package 200, which, in some embodiments, may include the following:

M. Close the upper isolation valve 207 by operation of an ROV 195.

N. Disconnect the umbilical line connection 125 from the upper connection 208 by operation of an ROV 195.

O. Open the first and second flowline isolation valves 199*a* and 199*b* by operation of an ROV 195.

P. Close the flowline bypass valve 198 by operation of an ROV 195.

It should be understood that the above-listed steps of closing the upper isolation valve (Step M) and disconnecting the umbilical line 124 (or the drop line umbilical 124*a*) from the replacement subsea equipment package 200 (Step N) may only be performed in those illustrative embodiments wherein the upper connection 208 may have been used to: 1) inject flow assurance chemicals into the package 200; 2) draw the pressure in the package 200 and the adjustable-volume subsea containment structure 120*b* down; and/or 3) equalize the pressure between the package 200 and the structure 120*b* or the flowline 194. Otherwise, the replacement subsea equipment package 200 may be brought back on line by opening the flowline isolation valves 199*a/b* (Step O) so as to create fluid communication between the flowline 194 and the package 200, and by closing the flowline bypass valve 198 (Step P) so as to direct the production flow from the subsea well or manifold 193 through the package 200.

Figure 3F:
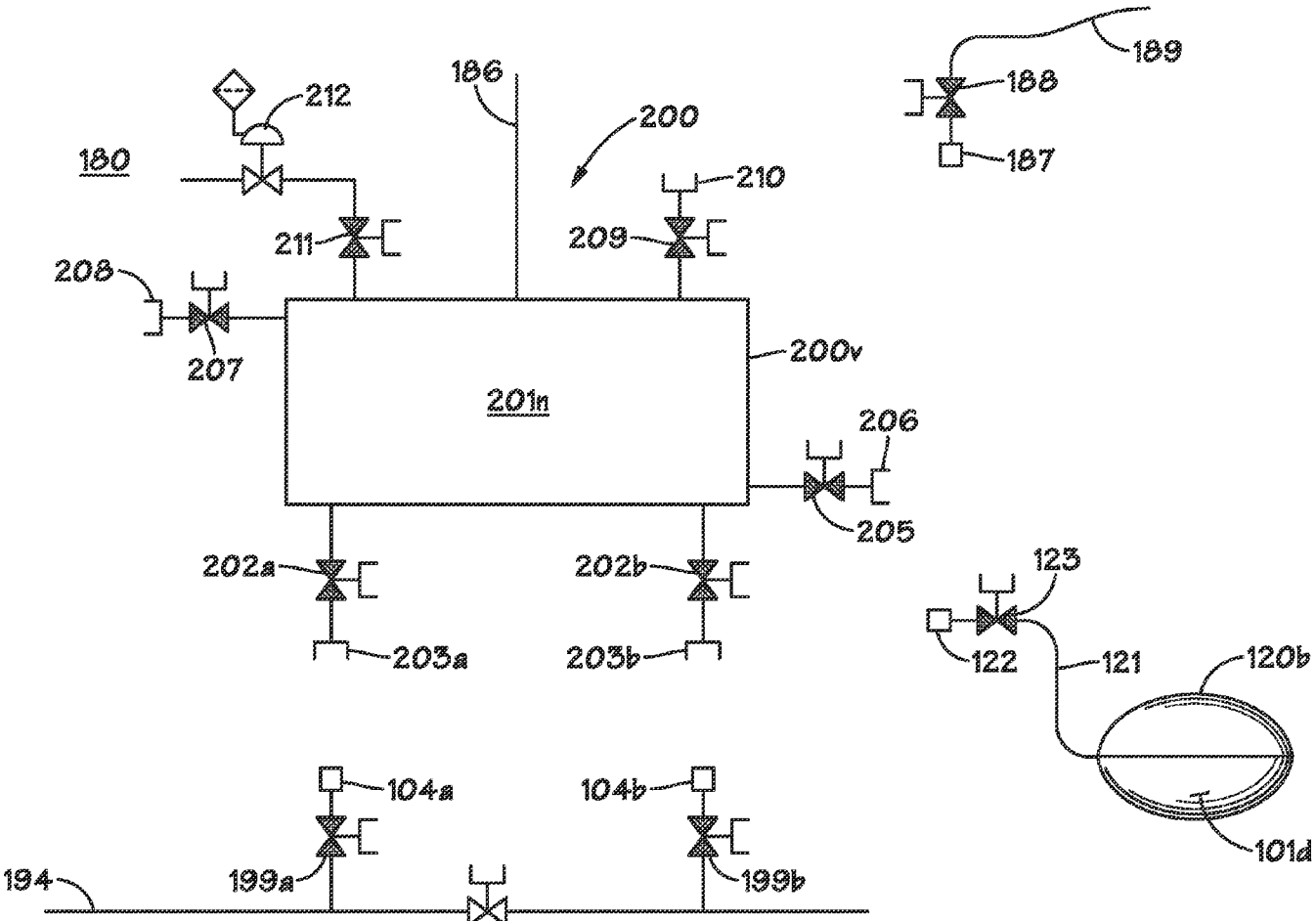
FIGS. 3F-3H schematically depict another illustrative method in accordance with the other embodiment of the subject matter disclosed herein that may be used to replace subsea equipment.
Figure 3G:
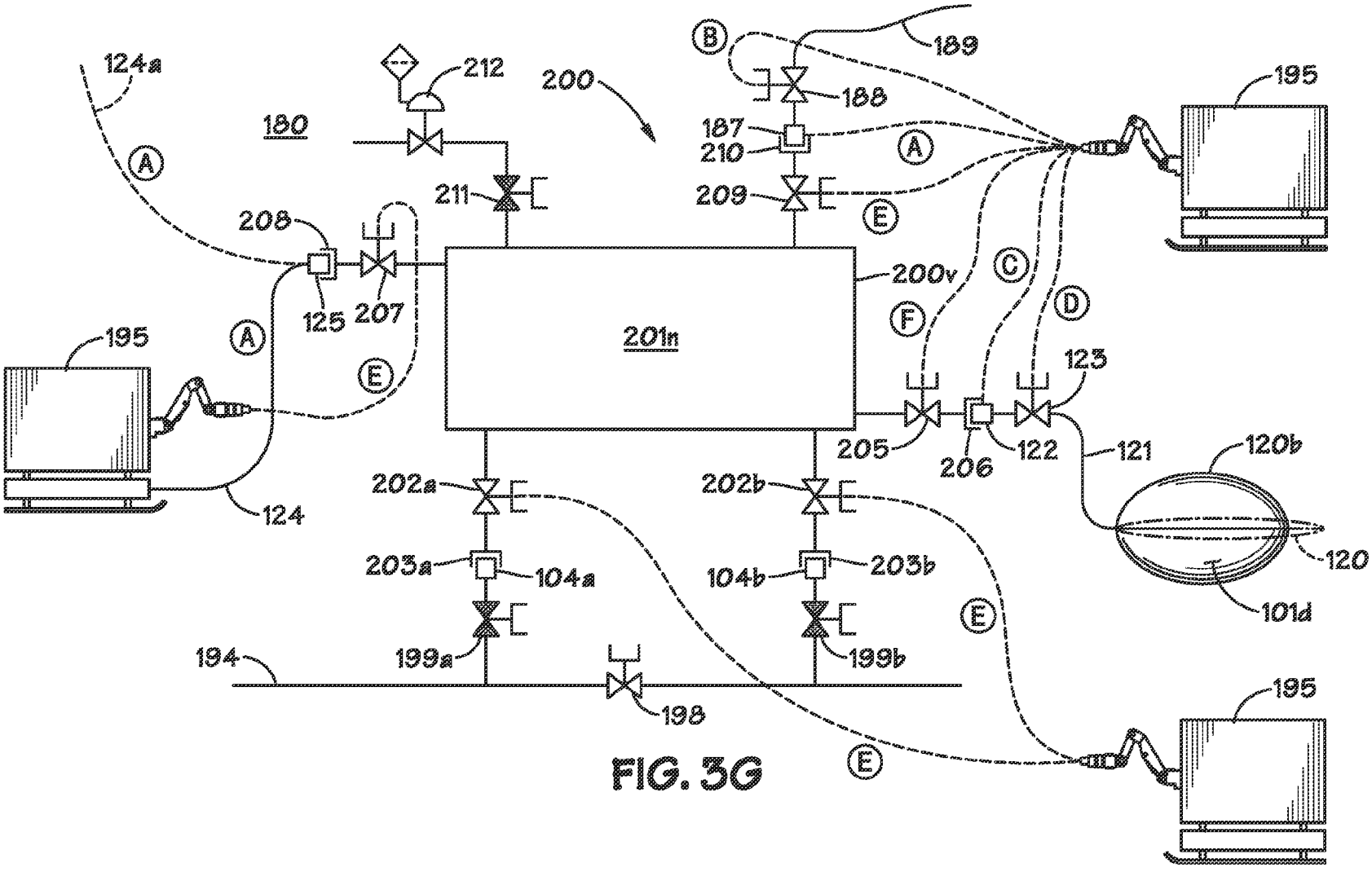
Figure 3H:
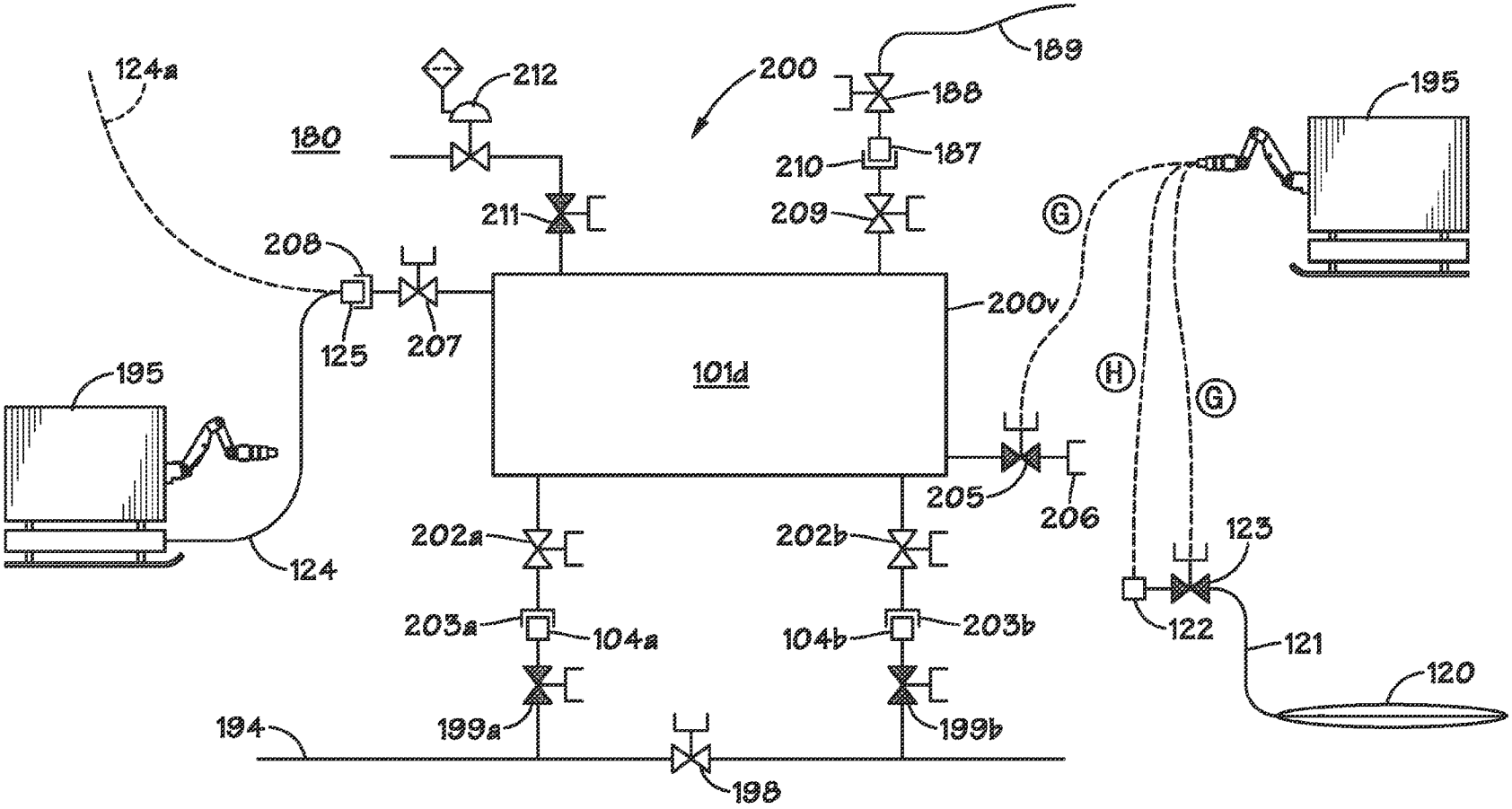
Figure 51:
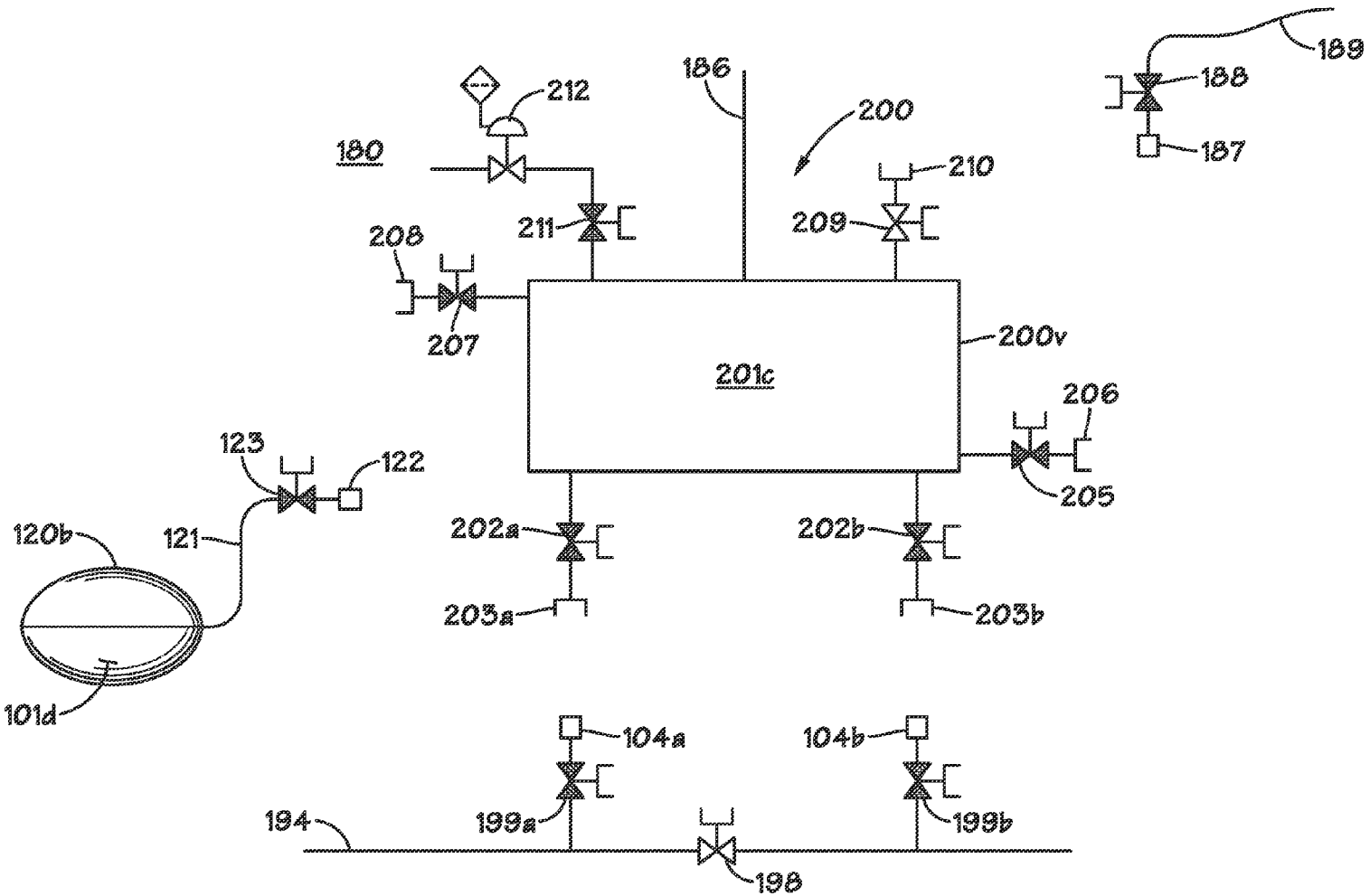

FIGS. 3F-3H schematically illustrate various steps of another exemplary method that may be used to deploy and install a replacement subsea equipment package 200. The configuration of the replacement subsea equipment package 200 shown in FIG. 3F is substantially the same as the corresponding configuration shown in FIG. 3A and described above, wherein however the package 200 has been deployed from the surface 191 (see, FIG. 1) with a trapped gas 201*n*, such as air or nitrogen and the like, contained therein, and with all of the valves 202*a/b*, 205, 207, 209 and 211 in a closed position. Accordingly, in the illustrative embodiment depicted in FIG. 3F, the trapped gas 201*n* contained within the package 200 may be at substantially ambient pressure conditions, whereas the local hydrostatic pressure conditions of the subsea environment 180 may be significantly higher.

FIG. 3G schematically illustrates the replacement subsea equipment package 200 of FIG. 3F after the package 200 has been landed on the flowline 194, and the first and second equipment connections 203*a* and 203*b* have been sealingly connected to the respective first and second flowline connections 104*a* and 104*b*. FIG. 3G additionally depicts several preliminary steps that may be performed during an overall method that may be used to remove the gas 201*n* from the replacement subsea equipment package 200 and bring the package 200 on line, which steps may include the following:

A. Connect the chemical injection line connection 187 on the chemical injection line 189 to the chemical injection connection 210 by operation of an ROV 195.

B. Open the chemical injection line isolation valve 188 by operation of an ROV 195.

C. Position the adjustable-volume subsea containment structure 120*b* adjacent to the replacement subsea equipment package 200, and connect the containment structure connection 122 on the structure 120*b* to the lower connection 205 by operation of an ROV 195.

D. Open the containment structure isolation valve 123 on the adjustable-volume subsea containment structure 120*b* by operation of an ROV 195.

E. Open the chemical injection valve 209 and the first and second equipment isolation valves 202*a* and 202*b* by operation of an ROV 195.

F. Open the lower isolation valve 205 by operation of an ROV 195.

In certain embodiments, after the adjustable-volume subsea containment structure 120*b* containing the mixture 101*d* of separated liquid 101*a* and flow assurance chemicals 101*c* has been connected to the replacement subsea equipment package 200 (Step C), the pressure between the package 200 and the structure 120*b* may be substantially equalized across the lower isolation valve 205 prior to opening the valve 205 (Step F). In at least some illustrative embodiments, pressure equalization across the lower isolation valve 205 may be accomplished by adjusting the pressure in the package 200 through the chemical injection line 189 that is connected to the chemical injection connection 210.

In other embodiments, such as when a chemical injection line 189 and chemical injection system (not shown) may not even be a part of the subsea equipment installation 185 (see FIG. 1), pressure equalization may be accomplished in any one of several alternative fashions. For example, in some embodiments, an alternate Step A as shown in FIG. 3G may be performed wherein an ROV 195 is positioned adjacent to the replacement subsea equipment package 200, which may then connect an umbilical line 124 to the upper connection 208 using the umbilical connection 125. After performing an alternate Step E to open the upper isolation valve 207, the ROV 195 may then adjust the pressure in the package 200 through the umbilical line 124. In yet other embodiments, the ROV 195 may be used to perform yet a different alternate Step A by connecting a drop line umbilical 124*a* to the upper connection 208 via the umbilical connection 125 and to open the upper isolation valve 207 (alternate Step E), after which pressure in the replacement subsea equipment package 200 may be adjusted from the surface 191 (see, FIG. 1) so as to equalize pressure across the lower isolation valve 205 before it is opened (Step F).

After the lower isolation valve 205 has been opened by operation of an ROV 195, the pressure in the replacement subsea equipment package 200 and the adjustable-volume subsea containment structure 120*b* may then be reduced to a pressure that is below the local hydrostatic pressure of the subsea environment 180 in the manner previously described with respect to FIG. 3C, such as by operation of a pump and/or choke (not shown) mounted on the separator vessel 200*v*, or through the chemical injection line 189, the umbilical line 124, or the drop line umbilical 124*a*. During this operation, the local hydrostatic pressure of the subsea environment 180 may thereby cause the adjustable-volume subsea containment structure 120*b* to collapse and the contents 101*d* of the structure 120*b* to be transferred into the separator vessel 200*v*. During this operation, the adjustable-volume subsea containment structure 120*b* may collapse back to a substantially empty condition, as is indicated by the dashed-line containment structure outline 120 shown in FIG. 3G. Additional steps may also be taken to pump any remaining amounts of the mixture 101*d* out of the adjustable-volume subsea containment structure 120*b* and/or the containment structure flowline 121, e.g., Steps I and J as previously described with respect to the illustrative method shown in FIG. 3C.

FIG. 3H schematically illustrates the replacement subsea equipment package 200 of FIG. 3G after completion of the above-described steps, wherein the replacement subsea equipment package 200 may be substantially filled with the mixture 101*d* transferred from the adjustable-volume subsea containment structure 120*b*. Furthermore, FIG. 3H also shows some additional steps that may be performed in conjunction with the presently described method, including the following:

G. Close the lower isolation valve 205 by operation of an ROV 195. Alternatively, the containment structure isolation valve 123 on the now-substantially empty adjustable-volume subsea containment structure 120 may also be closed by operation of an ROV 195.

H. Disconnect the containment structure connection 122 from the lower connection 206 by operation of an ROV 195.

In certain embodiments, after the lower isolation valve 205 has been closed (Step G) and the fully-collapsed adjustable-volume subsea containment structure 120 has been removed from the replacement subsea equipment package 200 (Step H), pressure may then be equalized between the package 200 and the flowline 194 across the flowline isolation valves 199*a/b*. As previously described, this may be accomplished by adjusting the pressure in the replacement subsea equipment package 200 through the chemical injection connection 210 by operation of a chemical injection package (not shown), or through the upper connection 208 by operation of a pump (not shown) on the ROV 195 via the umbilical line 124, or a pump (not shown) on the intervention vessel 190 (see, FIG. 1) via the drop line umbilical 124*a*. Thereafter, further operations may be performed as previously described with respect to FIG. 3E above so as to bring the replacement subsea equipment package 200 on line by directing production flow from the flowline 194 through the package 200.

Figure 3J:
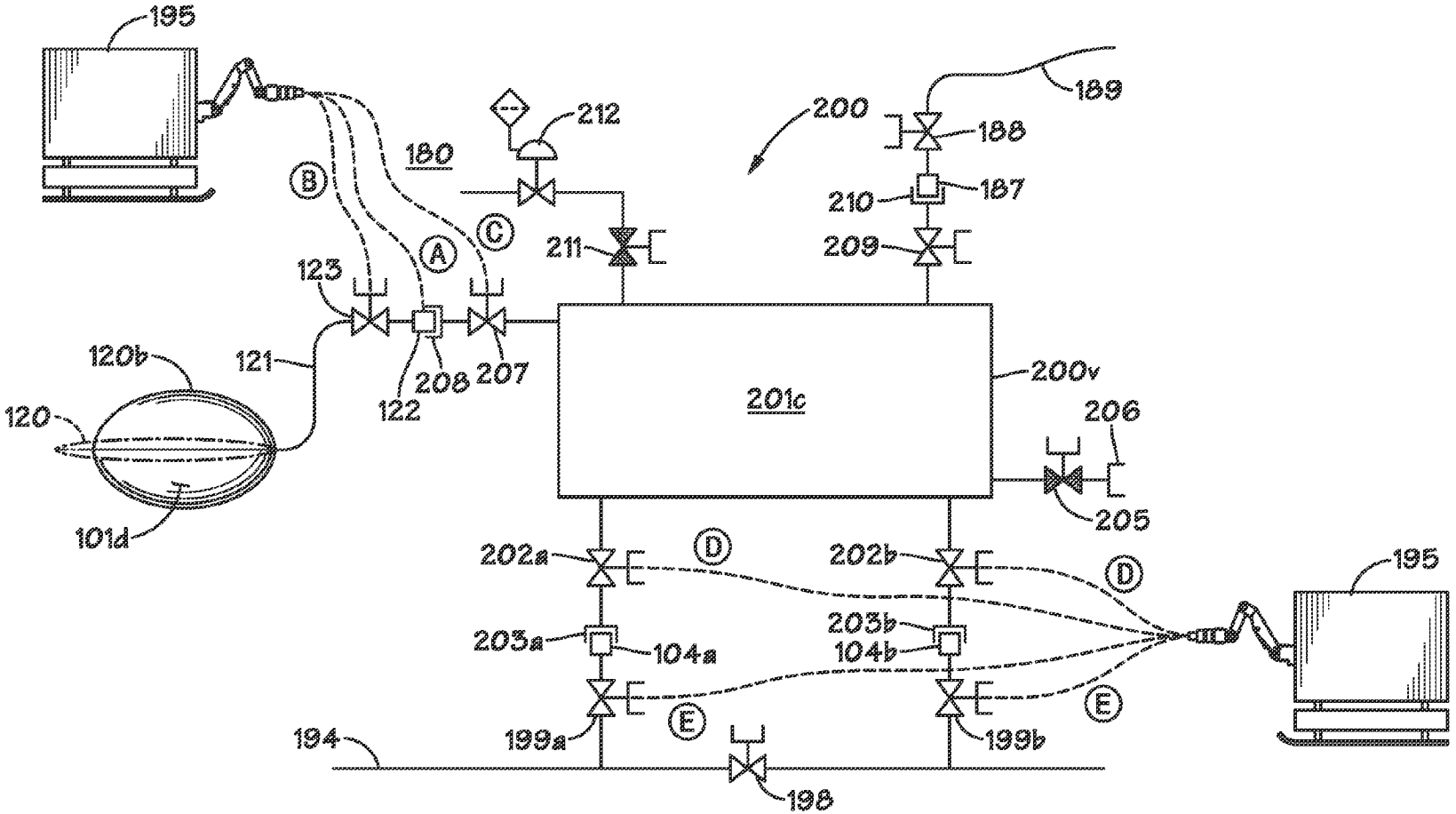

FIGS. 3I and 3J schematically illustrate yet a further exemplary method that may be used to deploy and install a replacement subsea equipment package 200 in those embodiments wherein the local hydrostatic pressure of the subsea environment 180 at the equipment installation location may be greater than the operating pressure of the flowline 194. The configuration of the replacement subsea equipment package 200 shown in FIG. 3I may be substantially the same as the corresponding configurations shown in FIGS. 3A and 3F described above, wherein however the package 200 has been substantially completely filled with flow assurance chemicals 201*c* prior to being deployed from the surface 191 (see, FIG. 1). Furthermore, the replacement subsea equipment package 200 may be lowered from surface 190 (see, FIG. 1) with at least one valve in an open position, such as the chemical injection valve 209 as shown in FIG. 3I, so that the flow assurance chemicals 201*c* in package 200 are exposed to the subsea environment 180, thus allowing the pressure in the package 200 to gradually adjust to the local hydrostatic pressure as it is being lowered by the lift line 186. However, in at least some embodiments, the replacement subsea equipment package 200 may be lowered with the remaining valves 202*a/b*, 205, 207 and 211 in the closed position as shown in FIG. 3I, so as to substantially minimize the loss of any flow assurance chemicals 201*c* to the subsea environment 180.

FIG. 3J schematically illustrates the replacement subsea equipment package 200 of FIG. 3I after the package 200 has been landed on the flowline 194 and the first and second equipment connections 203*a* and 203*b* have been sealingly connected to the respective first and second flowline connections 104*a* and 104*b*, and after the chemical injection line 189 has been connected to the chemical injection connection 210 using the chemical injection line connection 187. FIG. 3J additionally depicts at least some steps that may be performed during an overall method that may be used to bring the replacement subsea equipment package 200 on line, which may include the following:

A. Position the adjustable-volume subsea containment structure 120*b* adjacent to the replacement subsea equipment package 200, and connect the containment structure connection 122 on the structure 120*b* to the upper connection 207 by operation of an ROV 195.

B. Open the containment structure isolation valve 123 on the adjustable-volume subsea containment structure 120*b* by operation of an ROV 195.

C. Open the upper isolation valve 207 by operation of an ROV 195.

D. Open the first and second equipment isolation valves 202*a/b* by operation of an ROV 195.

E. Open the first and second flowline isolation valve 199*a/b* by operation of an ROV 195.

After the equipment and flowline isolation valves 202*a/b* and 199*a/b* have been opened (Steps D and E), the local hydrostatic pressure of the subsea environment 180—which, as noted above, is greater than operating pressure in the flowline 194—may therefore cause the adjustable-volume subsea containment structure 120*b* to collapse, and the contents 101*d* of the structure 120*b* to be transferred into the separator vessel 200*v*. Furthermore, it should be appreciated that the flow assurance chemicals 201*c*, which in many cases may have a higher specific gravity than liquid phase hydrocarbons e.g. the contents 101*d* of the adjustable-volume subsea containment structure 120*b*, may naturally flow downward into the flowline 194 in those embodiments wherein the replacement subsea equipment package 200 is positioned above the flowline 194. Accordingly, during this operation, the adjustable-volume subsea containment structure 120*b* may collapse back to a substantially empty condition, as is indicated by the dashed-line containment structure outline 120 shown in FIG. 3J, and the replacement subsea equipment package 200 may therefore be substantially filled with mixture 101*d*. Thereafter, additional steps may be performed to close the upper isolation valve 207, disconnect the adjustable-volume subsea containment structure 120*b*, and close the flowline bypass valve 198 so that the subsea equipment package 200 can be brought fully on line.

It should be understood by a person of ordinary skill having full benefit of the present subject that the methods described herein with respect to FIGS. 3A-3J may be equally applicable in situations other than those dealing with the deployment and installation of replacement subsea equipment packages. For example, it is well within the spirit and scope of the present disclosure to utilize at least some of the methods and steps illustrated in FIGS. 3A-3J in situations where a new subsea equipment package is being deployed to and installed in a new subsea equipment installation.

Figure 4A:
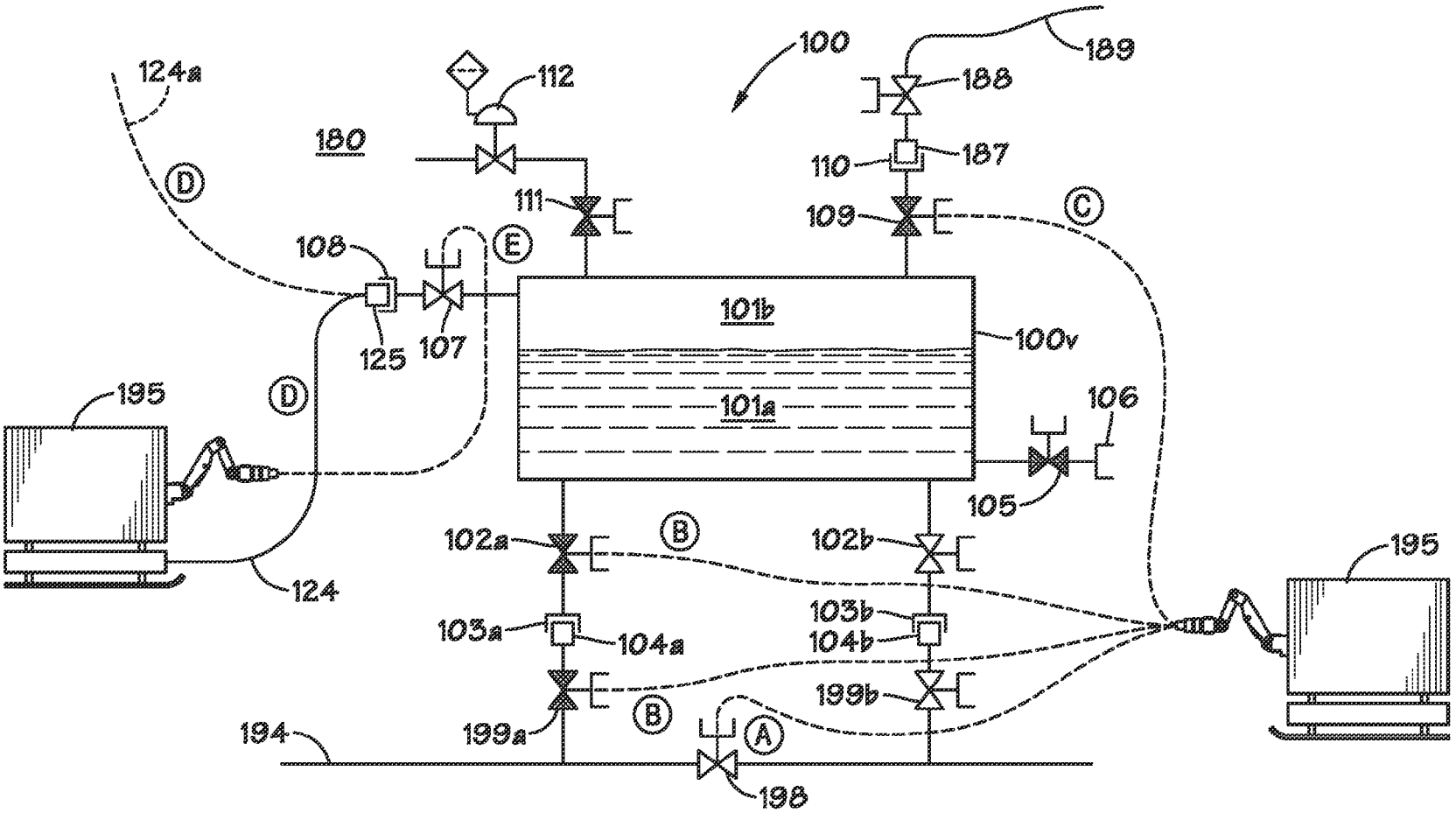
FIGS. 4A-4C schematically illustrate a further exemplary method that may be used to retrieve subsea equipment in accordance with at least some embodiments of the disclosed herein.
Figure 4B:
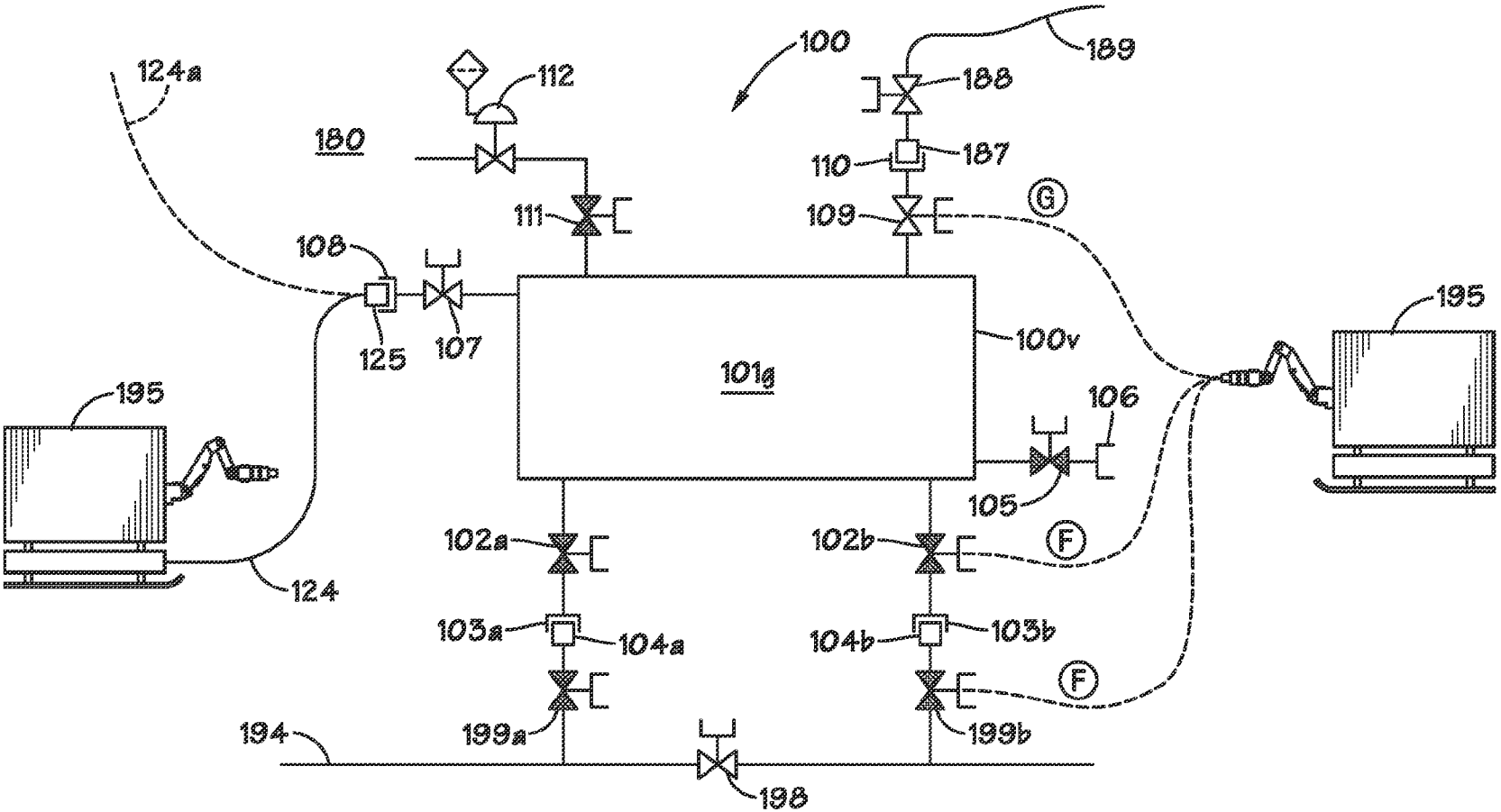
Figure 4C:
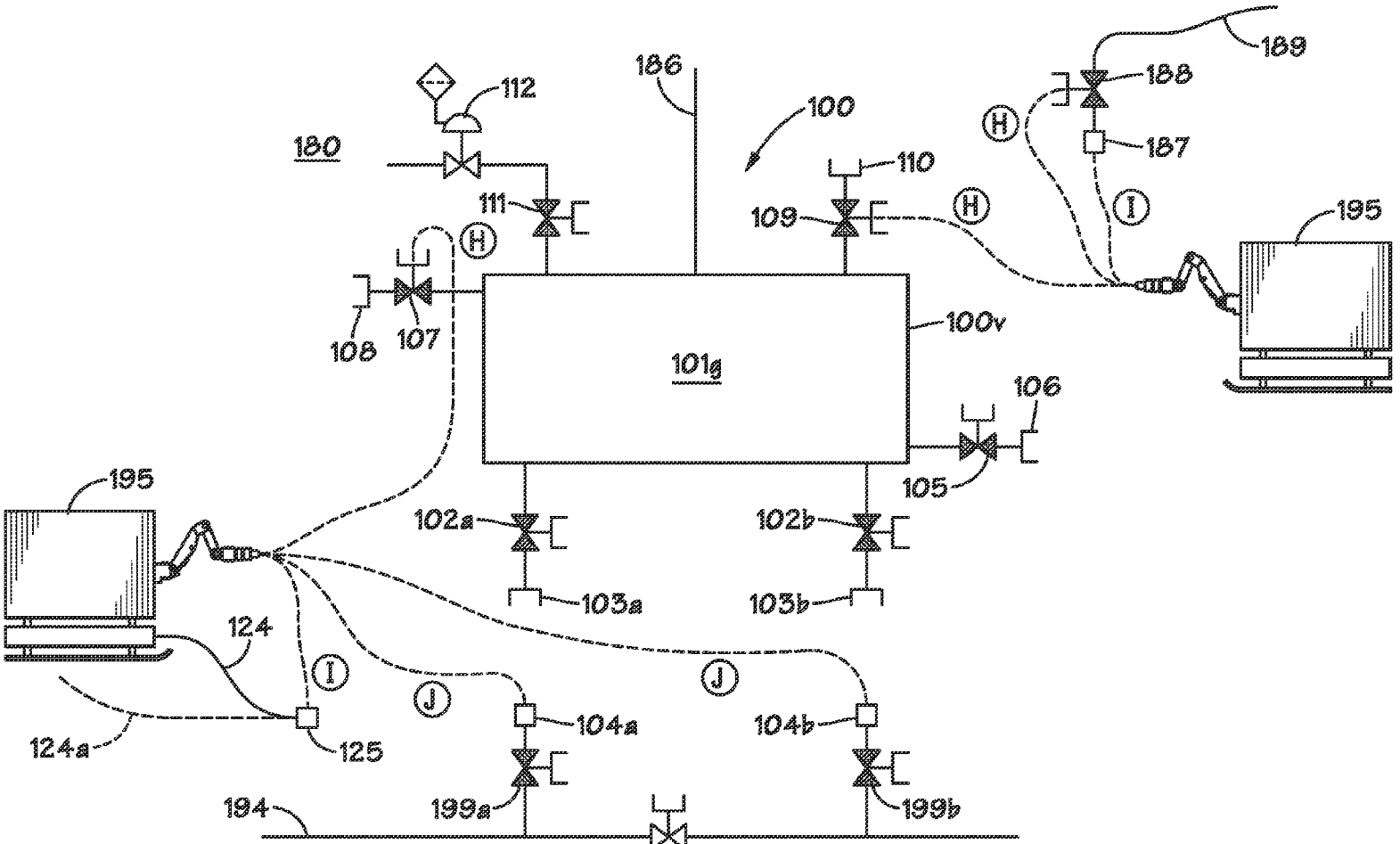

FIGS. 4A-4C schematically depict yet another illustrative method that may be used to retrieve a subsea equipment package 100 from a respective subsea equipment location. The subsea equipment package 100 shown in FIG. 4A may be configured in substantially the same manner as the subsea equipment package 100 shown in FIG. 2A and described above. Furthermore, the subsea equipment package 100 may contain a quantity of production fluid, which may contain both hydrocarbons and produced water, and which may be separated into, for example, a separated liquid 101*a* and a separated gas 101*b*. FIG. 4A further illustrates some exemplary method steps that may be performed so as to isolate the subsea equipment package 100 from the flowline 194, and remove the produced fluids, i.e., the separated liquid 101*a* and the separated gas 101*b*, from the package 100. In certain embodiments, the method steps shown in FIG. 4A may include, among other things, the following:

A. Open the flowline bypass valve 198 by operation of an ROV 195.

B. Close the first equipment isolation valve 102*a* and the first flowline isolation valve 199*a* by operation of an ROV 195.

C. Close the chemical injection valve 109 by operation of an ROV 195.

D. Position an ROV 195 adjacent to the subsea equipment package 100 and connect an umbilical connection 125 of an umbilical line 124 to the upper connection 108 on the package 100 by operation of the ROV 195. Alternatively, connect an umbilical connection 125 of a drop line umbilical 124*a* to the upper connection 108 by operation of an ROV 195.

E. Open the upper isolation valve 107 by operation of an ROV 195.

In some embodiments, after the umbilical line 124 (or alternatively, the drop line umbilical 124*a*) has been connected to the subsea equipment package 100 at the upper connection 108 (Step D) and the upper isolation valve 107 has been opened (Step E), a displacement fluid, which may be, for example, a high viscosity and/or immiscible fluid and the like, may be pumped into the subsea equipment package 100 through the upper connection 108 via the umbilical line 124 (or alternatively, the drop line umbilical 124*a*) at a higher pressure than that of the flowline 194. As used herein, a "high viscosity fluid" may be considered as any fluid having a viscosity that may be higher than that of the produced hydrocarbons and produced water in the subsea equipment package 100. In certain illustrative embodiments, the displacement fluid pumped into the subsea equipment package 100 may be adapted to substantially sweep or displace the separated liquid 101*a* and separated gas 101*b* from the package 100, and push those constituents into the flowline 194 through the second equipment and flowline isolation valves 102*b* and 199*b*. In at least some embodiments, the displacement fluid may be pumped by the ROV 195 (or a pump (not shown) connected to the drop line umbilical 124*a*) until an amount of fluid that is substantially the same as the volume of the subsea equipment package 100 has been pumped through the upper connection 108. In this way, the subsea equipment package 100 may then be substantially completely filled with the displacement fluid, while the amount of displacement fluid entering the flowline 194 during this operation may be substantially minimized.

Depending on the specific application, the displacement fluid used during this operation may be, in certain embodiments, a gelled fluid and the like, which may be formed by mixing, for example, a suitably designed polymer material with a suitable liquid, such as water and the like, as it is being pumped into the into the subsea equipment package 100. It should be understood, however, that other displacement fluids may also be used to sweep or displace the separated liquid 101*a* and separated gas 101*b* from the subsea equipment package 100 using the steps described above.

FIG. 4B schematically illustrates the subsea equipment package 100 of FIG. 4A after completion of the above-described steps, wherein the package 100 may be substantially filled with a gelled fluid 101*g*. FIG. 4B also depicts some further illustrative steps that may be performed so as to depressurize the subsea equipment package 100 prior to separating the package from the flowline 194 and retrieving it to the surface 191 (see, FIG. 1), which may include, among other things, the following:

F. Close the second equipment isolation valve 102*b* and the second flowline isolation valve 199*b* by operation of an ROV 195.

G. Open the chemical injection valve 109 by operation of an ROV 195.

In certain illustrative embodiments, after the second equipment and flowline isolation valves 102*b* and 199*b* have been closed (Step F) and the chemical injection valve 109 has been opened (Step G), the pressure of the gelled fluid 101*g* inside of the subsea equipment package 100 may be substantially equalized with the local hydrostatic pressure of the subsea environment 180 by adjusting the pressure through the chemical injection line 189 by operation of a chemical injection system (not shown). In other embodiments, the pressure level in the subsea equipment package 100 may be drawn down to substantially match the local hydrostatic pressure through the upper connection 108, e.g., through the umbilical line 124 by using a pump (not shown) on the ROV 195, or through the drop line umbilical 124*a* by way of a pump (not shown) positioned on the intervention vessel 190 at the surface 191 (see, FIG. 1). In still other embodiments, a suitably designed pump and/or choke (not shown) mounted on the separator vessel 100*v* may also be used.

FIG. 4C schematically depicts at least some further illustrative steps that may be used to separate and retrieve the subsea equipment package 100, which may include the following:

H. Close the chemical injection line isolation valve 188, the chemical injection valve 109, and the upper isolation valve 107 by operation of an ROV 195.

I. Disconnect the chemical injection line connection 187 and the umbilical line connection 125 from the chemical injection connection 110 and the upper connection 108, respectively, by operation of an ROV 195.

J. Disconnect the first and second equipment connections 103*a* and 103*b* from the first and second flowline connections 104*a* and 104*b*, respectively, by operation of an ROV 195.

After the subsea equipment package 100 has been separated from the flowline 194 by disconnecting the equipment connections 103*a/b* from the flowline connections 104*a/b* (Step J), the package 100 may be raised to the surface 191 (see, FIG. 1) using the lift line 186. In some illustrative embodiments, the subsea equipment package 100 may be raised to the surface 191 with all valves on the package 100 in the closed position as shown in FIG. 4C, so that pressure is trapped inside of the package 100. In such embodiments, the pressure may then be released after the package 100 has been raised to the surface 191 and positioned on the intervention vessel 190 (see, FIG. 1). In other embodiments, one or more valves on the subsea equipment package 100, such as the upper isolation valve 107 and/or the chemical injection valve 109, may be left open to the subsea environment 180 after the package 100 is separated from the flowline 194, so that the pressure on the gelled fluid 101*g* in the package 100 may gradually equalize to substantially ambient pressure as the package 100 is raised to the surface 191.

It should be understood that, in some embodiments, the separated liquid 101*a* and the separated gas 101*b* may be swept or displaced from the subsea equipment package 100 and into the flowline 194 through the first equipment isolation valve 102*a* and the first flowline isolation valve 199*a*, instead of through the second equipment isolation valve 102*b* and the second flowline isolation valve 199*b* as described above. For example, in an alternative Step B of FIG. 4A, the second equipment isolation valve 102*b* and the second flowline isolation valve 199*b* may be closed, whereas the first equipment isolation valve 102*a* and the first flowline isolation valve 199*a* may be left open. Accordingly, the first equipment isolation valve 102*a* and the first flowline isolation valve 199*a* may later be closed during an alternative Step F of FIG. 4B.

Figure 5A:
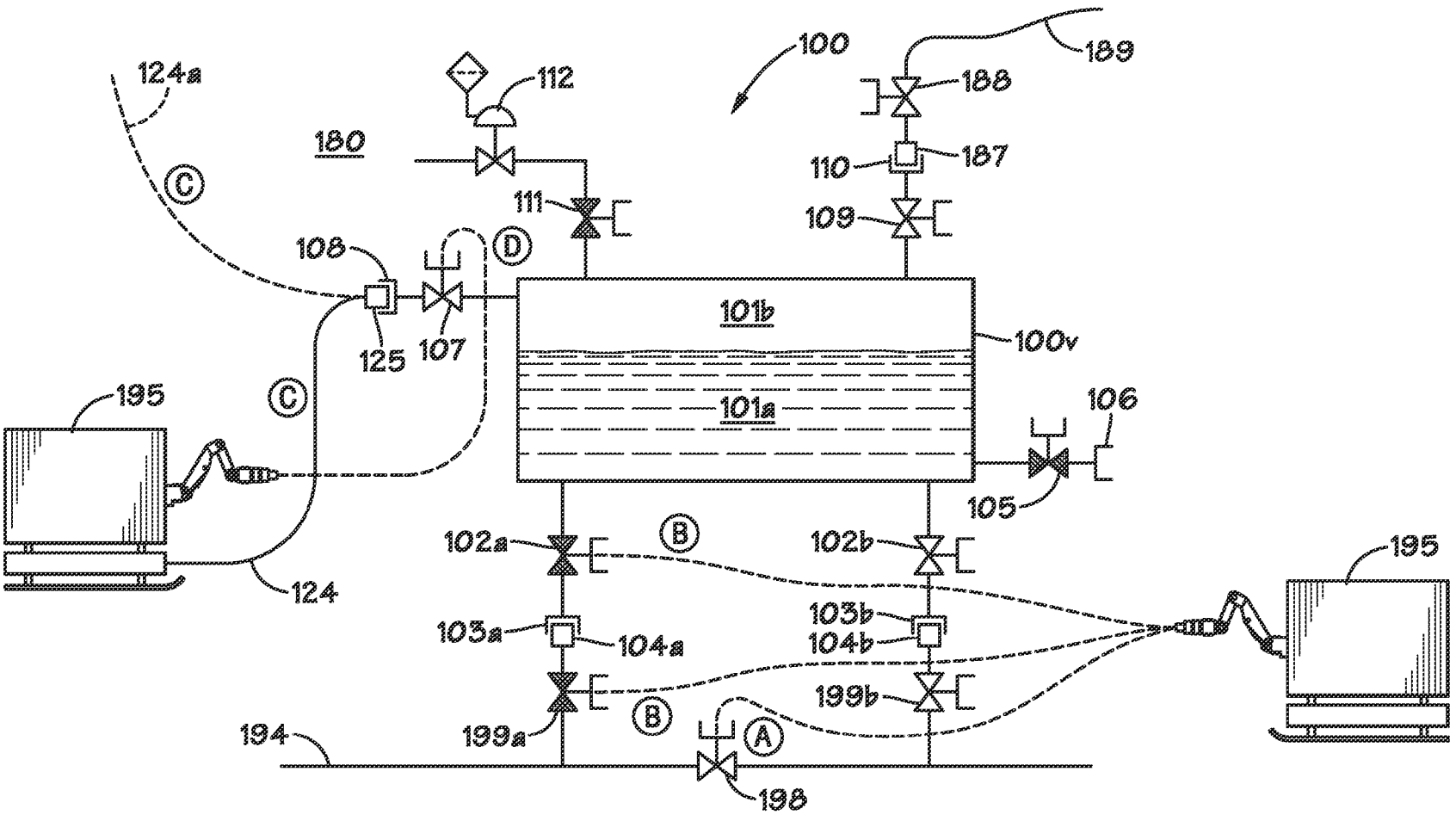
FIGS. 5A-5D schematically illustrate yet another method that may be used to retrieve subsea equipment in accordance with further exemplary embodiments of the present disclosure.

FIGS. 5A-5D schematically depict some additional illustrative methods that may be used to separate and retrieve a subsea equipment package 100 in accordance with further exemplary embodiments of the present disclosure. As shown in FIG. 5A, a subsea equipment package 100, which, in certain embodiments, may be substantially similar to any subsea equipment package disclosed herein, may be connected to the flowline 194 via equipment connections 103*a/b* and flowline connections 104*a/b*, and the package 100 may contain produced fluid (e.g., separated liquid 101*a* and separated gas 101*b*) as previously described. FIG. 5A further shows at least some illustrative methods steps that may be performed so as to bull head, i.e., force under high pressure, the separated liquid 101*a* and separated gas 101*b* into the flowline 194, which steps may include the following:

A. Open the flowline bypass valve 198 by operation of an ROV 195.

B. Close the first equipment isolation valve 102*a* and the first flowline isolation valve 199*a* by operation of an ROV 195.

C. Position an ROV 195 adjacent to the subsea equipment package 100 and connect an umbilical connection 125 of an umbilical line 124 to the upper connection 108 on the package 100 by operation of the ROV 195. Alternatively, connect an umbilical connection 125 of a drop line umbilical 124*a* to the upper connection 108 by operation of an ROV 195.

D. Open the upper isolation valve 107 by operation of an ROV 195.

Figure 5B:
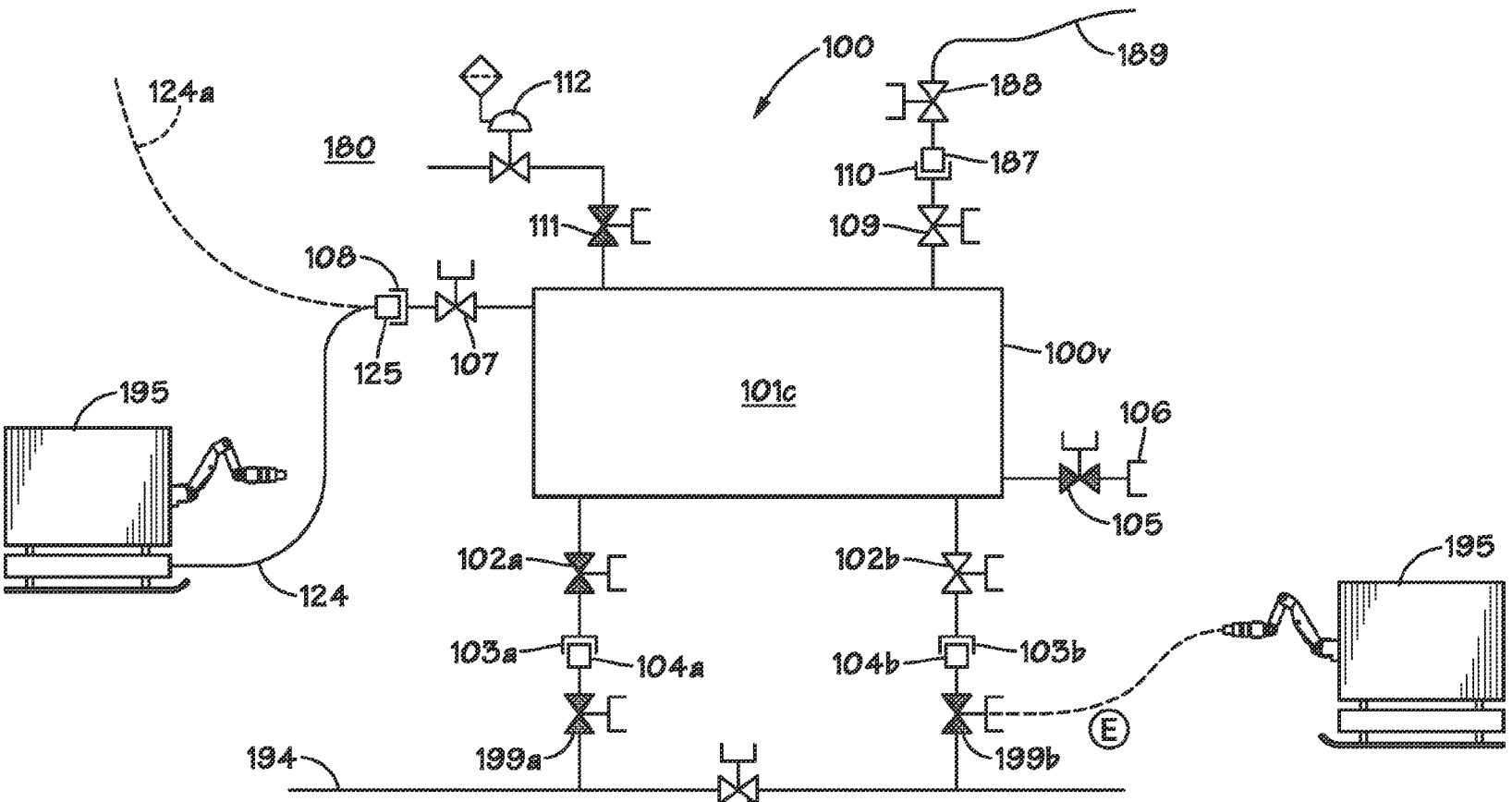
Figure 5C:
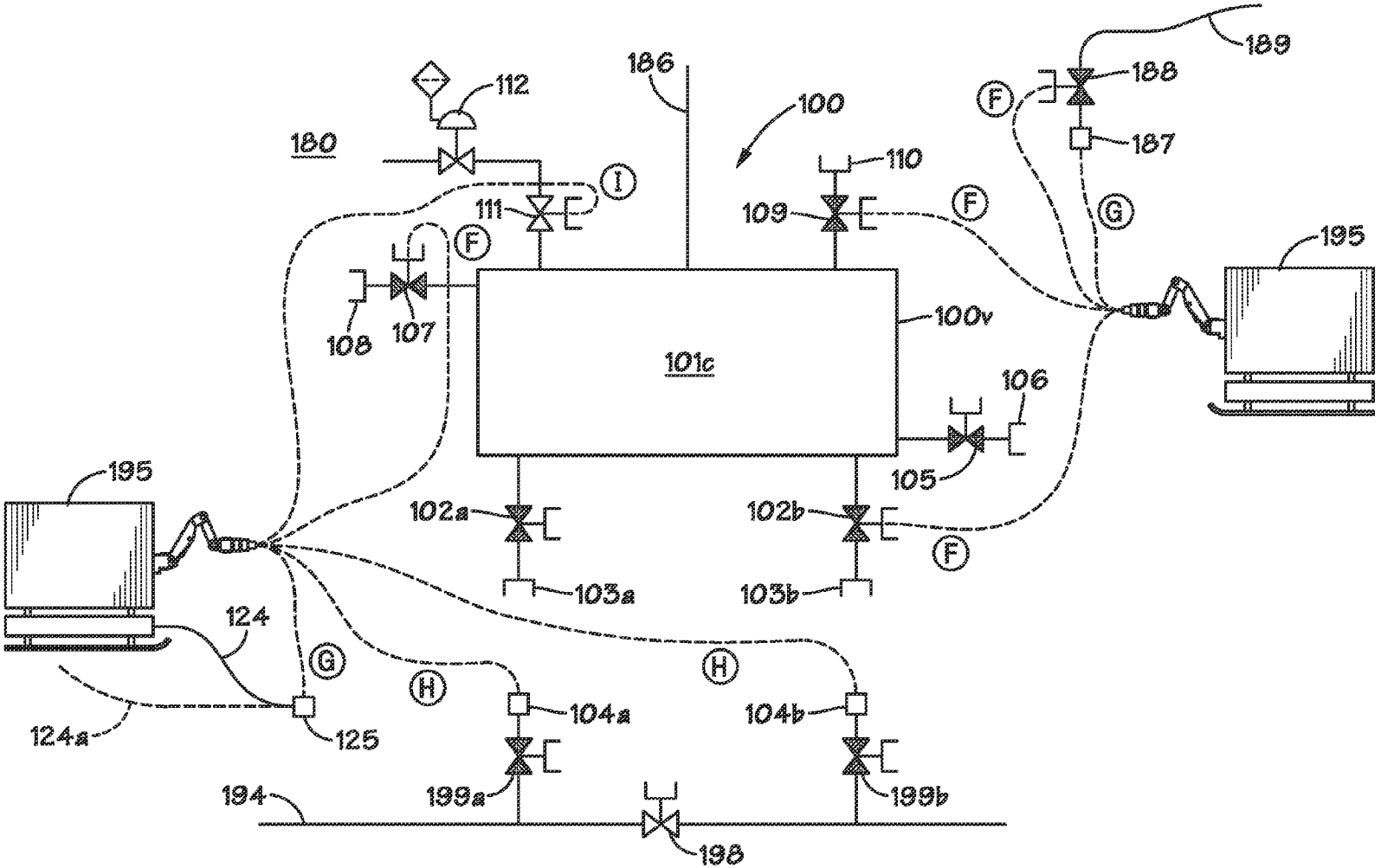

After the umbilical line 124 (or alternatively, the drop line umbilical 124*a*) has been connected to the subsea equipment package 100 at the upper connection 108 (Step C) and the upper isolation valve 107 has been opened (Step D), certain displacement fluids—which, in the embodiments shown in FIGS. 5A-5C may be, for example, flow assurance chemicals such as MeOH and/or MEG and the like—may be pumped into the subsea equipment package 100 through the upper connection 108 via the umbilical line 124 (or alternatively, the drop line umbilical 124*a*) at a higher pressure than that of the flowline 194. In certain embodiments, the flow assurance chemicals pumped into the subsea equipment package 100 through the upper connection 108 may substantially flush the separated liquid 101*a* and separated gas 101*b* out of the package 100, and push those constituents into flowline 194 through the second equipment and flowline isolation valves 102*b* and 199*b*. In other embodiments, rather than using the ROV umbilical 124 or the drop line umbilical 124*a* to pump flow assurance chemicals into the subsea equipment package 100, a chemical injection system (not shown) may be used to pump flow assurance chemicals through the chemical injection line 189 and the chemical injection connection 110 so as to flush the separated liquid 101*a* and separated gas 101*b* out of the package 100 in a substantially similar fashion.

FIG. 5B schematically illustrates the subsea equipment package 100 of FIG. 5A after completion of the bull heading operation outlined in the above-described steps, wherein the package 100 may now be substantially filled with flow assurance chemicals 101*c*. FIG. 5B also depicts additional steps that may be performed so as to depressurize the subsea equipment package 100 prior to separating the package from the flowline 194 and retrieving it to the surface 191 (see, FIG. 1), which may include the following:

E. Close the second flowline isolation valve 199*b* by operation of an ROV 195.

In certain illustrative embodiments, after the second flowline isolation valve 199*b* has been closed (Step E), the pressure of the flow assurance chemicals inside of the subsea equipment package 100 may be substantially equalized with the local hydrostatic pressure of the subsea environment 180 by bleeding the pressure down in subsea equipment package 100 by any method previously described herein, e.g., through the chemical injection line 189, the umbilical line 124, or the drop line umbilical 124*a*, or by operation of a suitably designed pump and/or choke (not shown) mounted on the separator vessel 100*v*.

FIG. 5C schematically illustrates additional method steps that may be performed to separate and retrieve the subsea equipment package 100 shown in FIG. 5B, which may include the following:

F. Close the second equipment isolation valve 102*b*, the chemical injection line isolation valve 188, the chemical injection valve 109, and the upper isolation valve 107 by operation of an ROV 195.

G. Disconnect the chemical injection line connection 187 and the umbilical line connection 125 from the chemical injection connection 110 and the upper connection 108, respectively, by operation of an ROV 195.

H. Disconnect the first and second equipment connections 103*a* and 103*b* from the first and second flowline connections 104*a* and 104*b*, respectively, by operation of an ROV 195.

After the subsea equipment package 100 has been separated from the flowline 194 by disconnecting the equipment connections 103*a/b* from the flowline connections 104*a/b* (Step H), the package 100 may be raised to the surface 191 (see, FIG. 1) using the lift line 186. In some embodiments, the subsea equipment package 100 may be raised to the surface 191 (see, FIG. 1) with all valves on the package 100 in the closed position so that pressure is trapped inside of the package 100. In such embodiments, the trapped pressure may be released after the package 100 has been raised and positioned on the intervention vessel 190 (see, FIG. 1). In other embodiments, one or more valves on the subsea equipment package 100, such as the upper isolation valve 107 and/or the chemical injection valve 109, may be left open to the subsea environment 180 after the package 100 is separated from the flowline 194, so that pressure on the flow assurance chemicals 101*c* contained in the package 100 may gradually equalize to substantially ambient pressure as the package 100 is raised to the surface 191.

In certain embodiments, some amount of liquid phase hydrocarbons may not have been completely removed from the subsea equipment package 100 during the bull heading process described above. In such embodiments, some amount of gas phase hydrocarbons may expand out of the remaining liquid phase hydrocarbons as the subsea equipment package 100 is raised to the surface 191 (see, FIG. 1) and the pressure on the package 100 is gradually reduced, as described above. Accordingly, in some embodiments of the illustrative methods depicted in FIGS. 5A-5C, the following additional step illustrated in FIG. 5C may also be performed prior to raising the subsea equipment package 100 to the surface 191 so as to address the presence of any expanded gas phase hydrocarbons in the package 100:

I. Open the relief isolation valve 111 by operation of an ROV 195.

Once the relief isolation valve 111 has been opened (Step I), any gases that may expand out of the liquid phase hydrocarbons present in the subsea equipment package 100 can therefore be vented through the pressure relief valve 112 and into the subsea environment in a controllable manner, as previously described with respect to the illustrative method shown in FIG. 2F above.

In certain illustrative embodiments, it may not be desirable to retrieve the subsea equipment package 100 to the surface 191 (see, FIG. 1) while it is substantially completely filled with flow assurance chemicals 101*c* as is shown in FIGS. 5B and 5C. For example, in some embodiments, the intervention vessel 190 (see, FIG. 1) may not be equipped to properly handle the flow assurance chemicals 101*c* once the subsea equipment package 100 reaches the surface 191, such as by bleeding off a portion of the chemicals 101*c* during depressurization of the package 100 (as would be required in some embodiments of FIG. 5C), and/or properly containing or disposing of the chemicals 101*c*.

Figure 5D:
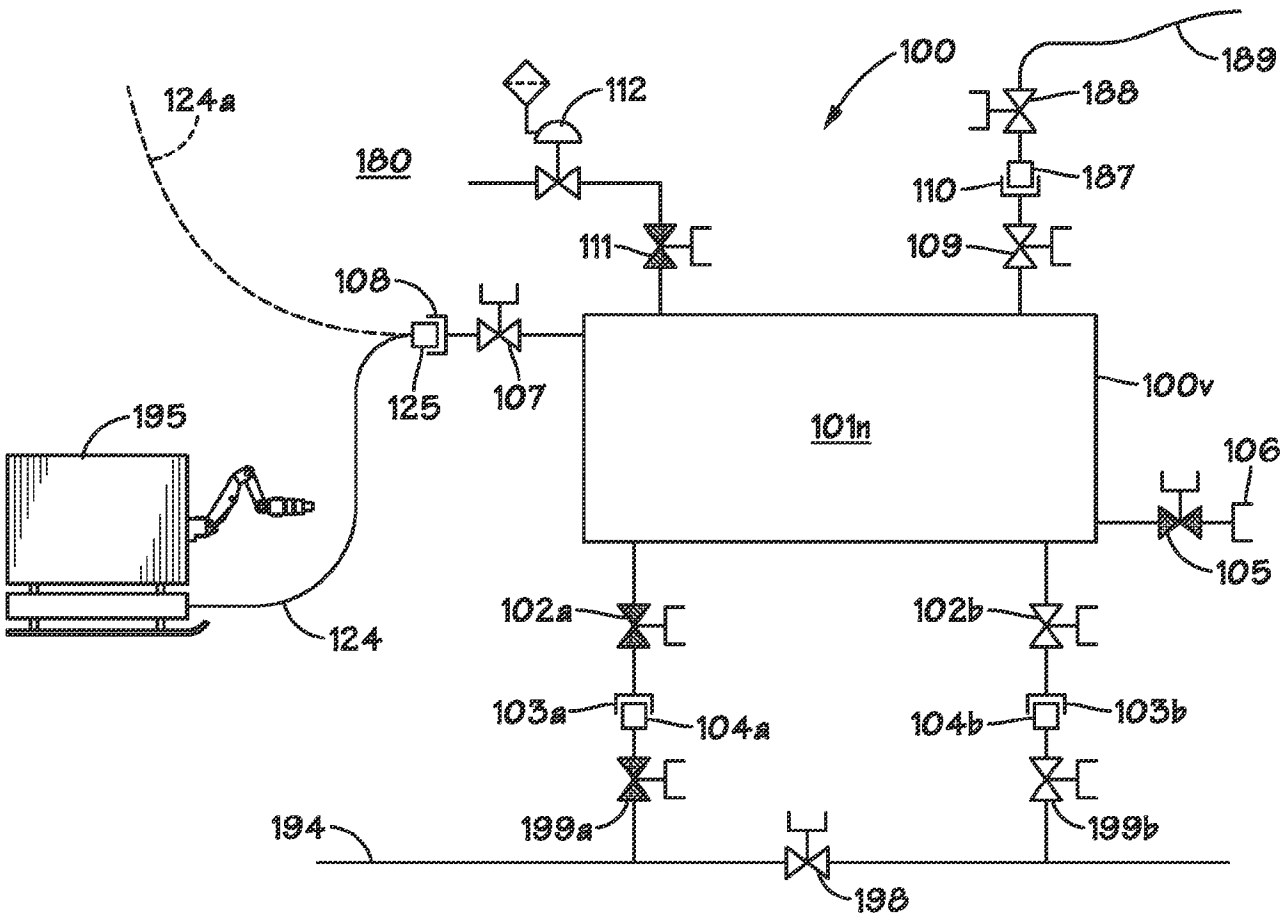

FIG. 5D schematically illustrates an embodiment wherein at least some intermediate steps may be performed on the subsea equipment package 100 shown in FIGS. 5A and 5B prior to separating the package 100 from the flowline 194 and retrieving the package 100 to the surface 191 (see, FIG. 1). For example, after bull heading the separated liquid 101*a* and separated gas 101*b* into the flowline 194 and replacing those constituents with flow assurance chemicals 101*c* in the manner described with respect to FIGS. 5A and 5B above, a second displacement fluid may be pumped into the subsea equipment package 100, thereby flushing the previous displacement fluid, e.g., the flow assurance chemicals 101*c*, into the flowline 194 and substantially filling the package 100 with the second displacement fluid. In certain illustrative embodiments, the second displacement fluid that is used during this stage may be, for example, an inert gas 101*n*, such as nitrogen and the like. Furthermore, the inert gas 101*n* may be pumped into the subsea equipment package 100 in any one of several ways, depending on various operational parameters, such as the size/volume of the subsea equipment package 100, the local hydrostatic pressure of the subsea environment 180 (i.e., water depth), the operating pressure in the flowline 194, the amount of inert gas 101*n* required to fully flush the flow assurance chemical 101*c* out of the package 100, and the like. Accordingly, in some embodiments, the inert gas 101*n* may be pumped into the subsea equipment package 100 through the chemical injection connection 110 via the chemical injection line. In other embodiments, the inert gas 101*n* may be pumped into the subsea equipment package 100 via the drop line umbilical 124*a*, which, in certain illustrative embodiments, may be a multi-line umbilical that includes at least a dedicated fluid line for pumping the flow assurance chemicals 101*c*, and a separate dedicate fluid line for pumping the inert gas 101*n*. In still other embodiments, such as, for example, when the operational parameters require only a relatively small quantity of inert gas 101*n*, the inert gas 101*n* may be pumped into the subsea equipment package 100 from an ROV 195 via an umbilical line 124.

After the inert gas 101*n* has been pumped into the subsea equipment package 100 so as to substantially flush the flow assurance chemicals 101*c* (see, FIG. 5B) out of the package 100 and into the flowline 194, the package 100 may be isolated from the flowline 194 by closing the second equipment isolation valve 102*b* and the second flowline isolation valve 199*b* by, for example, operation of an ROV 195. Thereafter, the pressure in the subsea equipment package 100 may be reduced to substantially equal the local hydrostatic pressure of the subsea environment 180 by any one of the several methods described herein, e.g., by bleeding the pressure down through the chemical injection line 189, the umbilical line 124, or the drop line umbilical 124*a*, or by operation of a suitably designed pump and/or choke (not shown) mounted on the separator vessel 100*v*.

Once the pressure of the inert gas 101*n* in the subsea equipment package 100 has been substantially equalized with the local hydrostatic pressure of the subsea environment 180, the package 100 may be separated from the flowline 194 and retrieved to the surface 191 (see, FIG. 1) in accordance with any one of the methods previously described herein, such as the methods illustrated in FIG. 2F. For example, in some embodiments, the subsea equipment package 100 may be raised to the surface with all valves closed and the inert gas 101*n* trapped under pressure in the package 100, after which it may be vented at the surface 191. In other embodiments, one or more valves, such as the chemical injection valve 109 and/or the upper isolation valve 107, may be left open to the subsea environment 180, so that the pressure in the subsea equipment package 100 equalizes with the hydrostatic pressure as the package 100 is raised, thereby potentially releasing at least some of the inert gas 101*n* into the subsea environment in a substantially uncontrolled manner. In still other embodiments, the subsea equipment package 100 may be raised to the surface 191 with all valves closed except for the relief isolation valve 111, in which case some quantity of the inert gas 101*n* may be released to the subsea environment 180 through the pressure relief valve 112 and in a substantially more controlled manner.

As with the illustrative embodiments illustrated in FIGS. 4A-4C and described above, it should be understood that, in accordance with at least some embodiments illustrated in FIGS. 5A-5D, the produced fluids present in the subsea equipment package 100 may be bull headed from the subsea equipment package 100 and into the flowline 194 through the first equipment isolation valve 102*a* and the first flowline isolation valve 199*a*, instead of through the second equipment isolation valve 102*b* and the second flowline isolation valve 199*b* as described above.

Figure 6A:
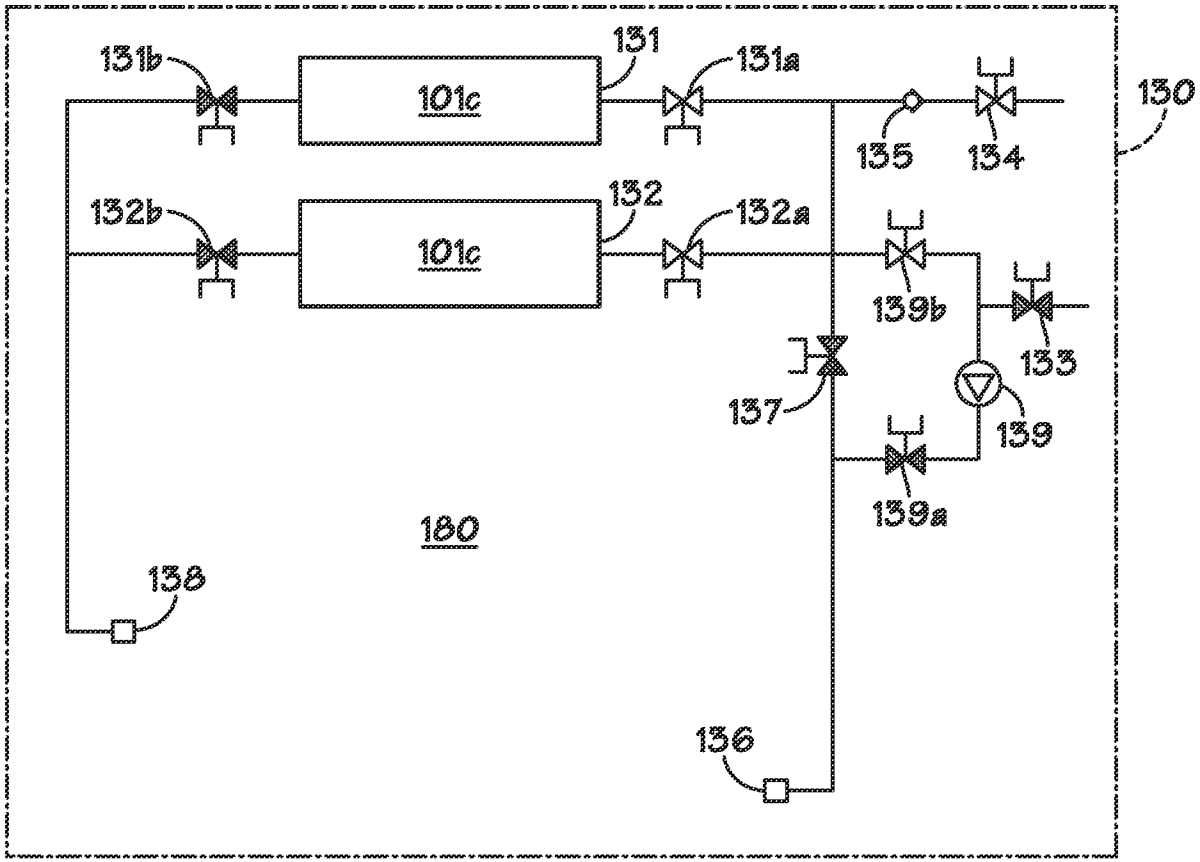

FIGS. 6A-6I schematically illustrate some systems and exemplary methods that may utilize a subsea containment structure such as a separate subsea processing package and the like to remove production fluid from a subsea equipment package 100 and depressurize the package 100 prior to separating the package 100 from a flowline 194 and retrieving the package 100 to the surface 191 (see, FIG. 1). More specifically, FIG. 6A is a schematic representation of an illustrative subsea processing package 130 that may be used in conjunction with the at least some of the exemplary methods illustrated in FIGS. 6B-6I and described below. In certain embodiments, the subsea processing package 130 may be deployed subsea adjacent to an operating subsea equipment package, such as the illustrative subsea equipment package 100 shown in FIG. 6B, which may be configured in a substantially similar fashion to any one of the subsea equipment packages 100 described herein. The subsea processing package 130 may then be connected to the subsea equipment package 100 in a manner as described herein so as to facilitate equipment retrieval operations.

Figure 6B:
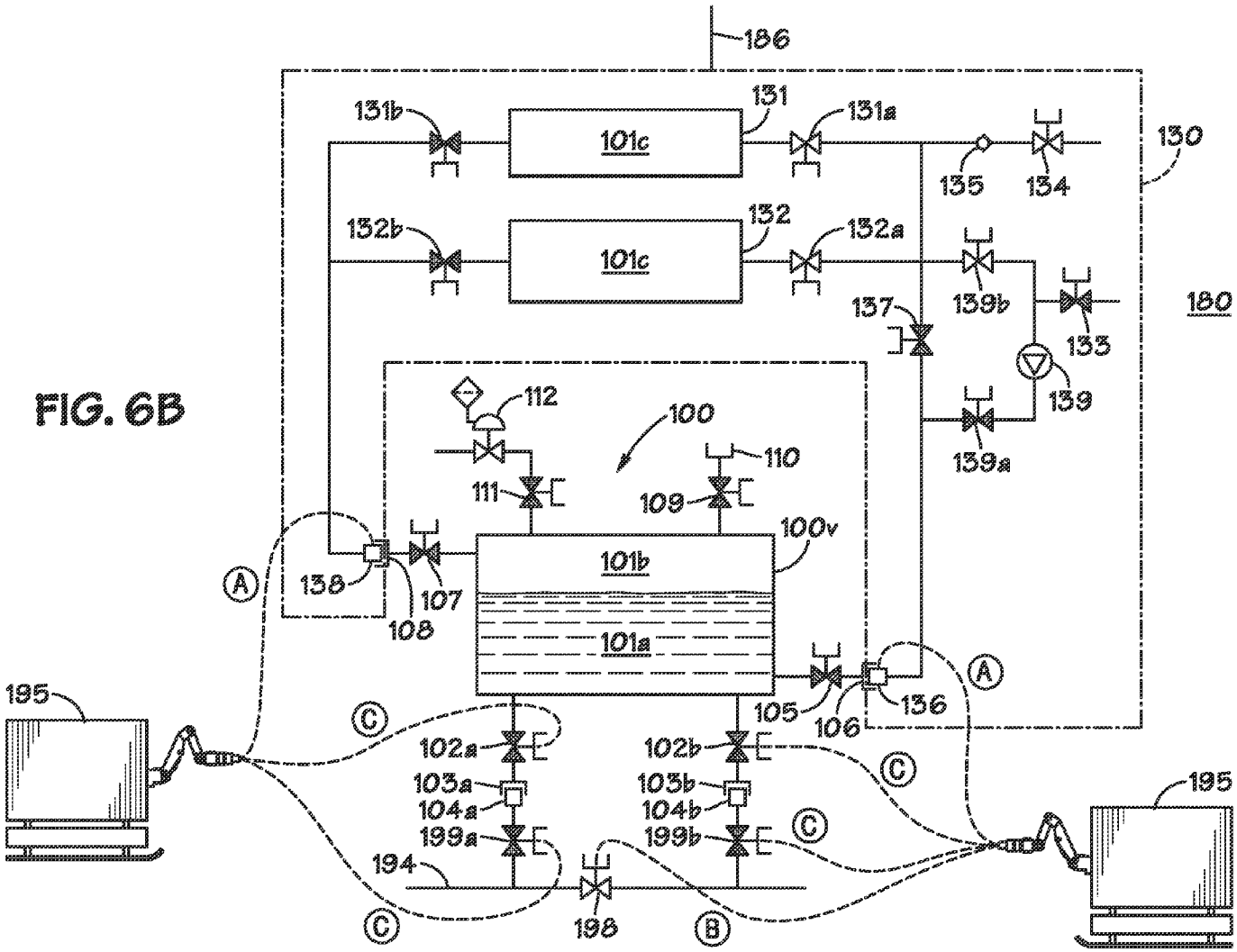

FIG. 6A shows the subsea processing package 130 in an illustrative configuration during a phase wherein the package 130 is being deployed to a subsea equipment installation, such as the subsea equipment installation 185 shown in FIG. 1, so as to be positioned adjacent to a subsea equipment package that will be removed from service, such as the subsea equipment package 100 shown in FIG. 6B. As shown in FIG. 6A, the processing equipment package 130 may include, among other things, a vessel 132, which may be used to facilitate the removal of at least a portion of the of the contents of the subsea equipment package 100. In at least some embodiments, the vessel 132 may be, for example, a separator vessel and the like (hereinafter referred to as a separator vessel 132), that may be used to remove gas phase hydrocarbons from the subsea equipment package 100 shown in FIG. 6B before the package 100 is retrieved to the surface 191, as will be further described below. Additionally, the subsea processing package 130 may include, for example, first and second separator isolation valves 132*a* and 132*b*, which may be positioned in fluid communication with either side of the separator vessel 132.

In at least some embodiments, the subsea processing package 130 may also include a first inlet valve 133 that is in fluid communication with the suction side of a circulation pump 139 and a second inlet valve 134. The subsea processing package 130 may also include a first circulation valve 139*a* that is in fluid communication with the discharge side of the circulation pump 139 and a second circulation valve 139*b* that is fluid communication with the suction side of the circulation pump 139, and a bypass valve 137 that is adapted to control the direction of fluid flow through the subsea processing package 130, as will be further described below. The subsea processing package 130 may also include first and second package connections 136 and 138, which may be adapted to connect to and sealingly engage with the lower and upper connections 106 and 108, respectively, on the subsea equipment package 100.

In other embodiments, such as those embodiments wherein a chemical injection package may not be provided or available to service the subsea equipment package 100 during normal equipment operation, the subsea processing package 130 may also include a tank 131, which may be used to store a quantity of flow assurance chemicals 101*c* and the like, and which may be used to facilitate a flushing operation that may be performed on the subsea equipment package 100 prior to equipment retrieval, as will be discussed in further detail below. In such embodiments, the subsea processing package 130 may also include first and second tank isolation valves 131*a* and 131*b*, which may be positioned to be in fluid communication with either side of the tank 131.

In some embodiments, at least some portions of the subsea processing package 130, including, for example, the tank 131 and the separator vessel 132 and the like, may be substantially filled with flow assurance chemicals 101*c* during the deployment of the subsea processing package 130 through the subsea environment 180. Additionally, in certain embodiments, the second tank isolation valve 131*b*, the second separator isolation valve 132*b*, the first inlet valve 133, first circulation valve 139*a*, and the bypass valve 137 may be closed during the subsea deployment of the subsea processing package 130 so as to substantially contain the flow assurance chemicals 101*c*. On the other hand, in at least some embodiments, the first tank isolation valve 131*a*, the first separator isolation valve 132*a*, the second inlet valve 134, and the second circulation valve 139*b* may be in an open position during package deployment so that the tank 131 and the separator vessel 132 are exposed to, and can equalize with, the hydrostatic pressure of the subsea environment 180 via the second inlet valve 134 as the subsea processing package 130 is being lowered into position near the sea floor 192 (see, FIG. 1). In at least one embodiment, the subsea processing package 130 may also include a check valve 135 that is positioned downstream of the second inlet valve 134 so as to substantially prevent, or at least minimize, the loss of any flow assurance chemicals 101*c* to the subsea environment 180 during package deployment.

Depending in the desired operational scheme of the subsea processing package 130, one or more of each of the various valves 131*a/b*, 132*a/b*, 133, 134, 137, and/or 139*a/b* included on the package 130 may be manually operable, or controllably operable via hydraulic, pneumatic, or electrical actuators. Furthermore, in some embodiments, any one or all of the above-listed valves may also have a mechanical override for operation via an ROV 195. Furthermore, in certain illustrative embodiments, the circulation pump 139 may also be operable by an ROV 195.

FIG. 6B schematically illustrates the subsea processing package 130 after it has been lowered into position adjacent to the subsea equipment package 100 using the lift line 186. During the operational phase shown in FIG. 6B, the subsea equipment package 100 may contain a quantity of production fluid, which may be in the form of separated liquid 101*a* and separated gas 101*b*. As previously noted, the separated liquid 101*a* may be a mixture of liquid phase hydrocarbons and produced water, and the separated gas 101*b* may contain an amount of gas phase hydrocarbons. FIG. 6B also shows various preliminary steps that may be performed in accordance with some illustrative methods disclosed herein to tie the subsea processing package 130 into the subsea equipment package 100, and to isolate the subsea equipment package 100 from the flowline 194. In certain embodiments, these preliminary step may include, but not necessarily be limited to, the following:

A. Connect the first and second package connections 136 and 138 on the subsea processing package 130 to the lower and upper connections 106 and 108, respectively, on the subsea equipment package 100 by operation of an ROV 195.

B. Open the flowline bypass valve 198 by operation of an ROV 195.

C. Close the first and second flowline isolation valves 199*a/b* and the first and second equipment isolation valves 102*a/b* by operation of an ROV 195.

Figure 6C:
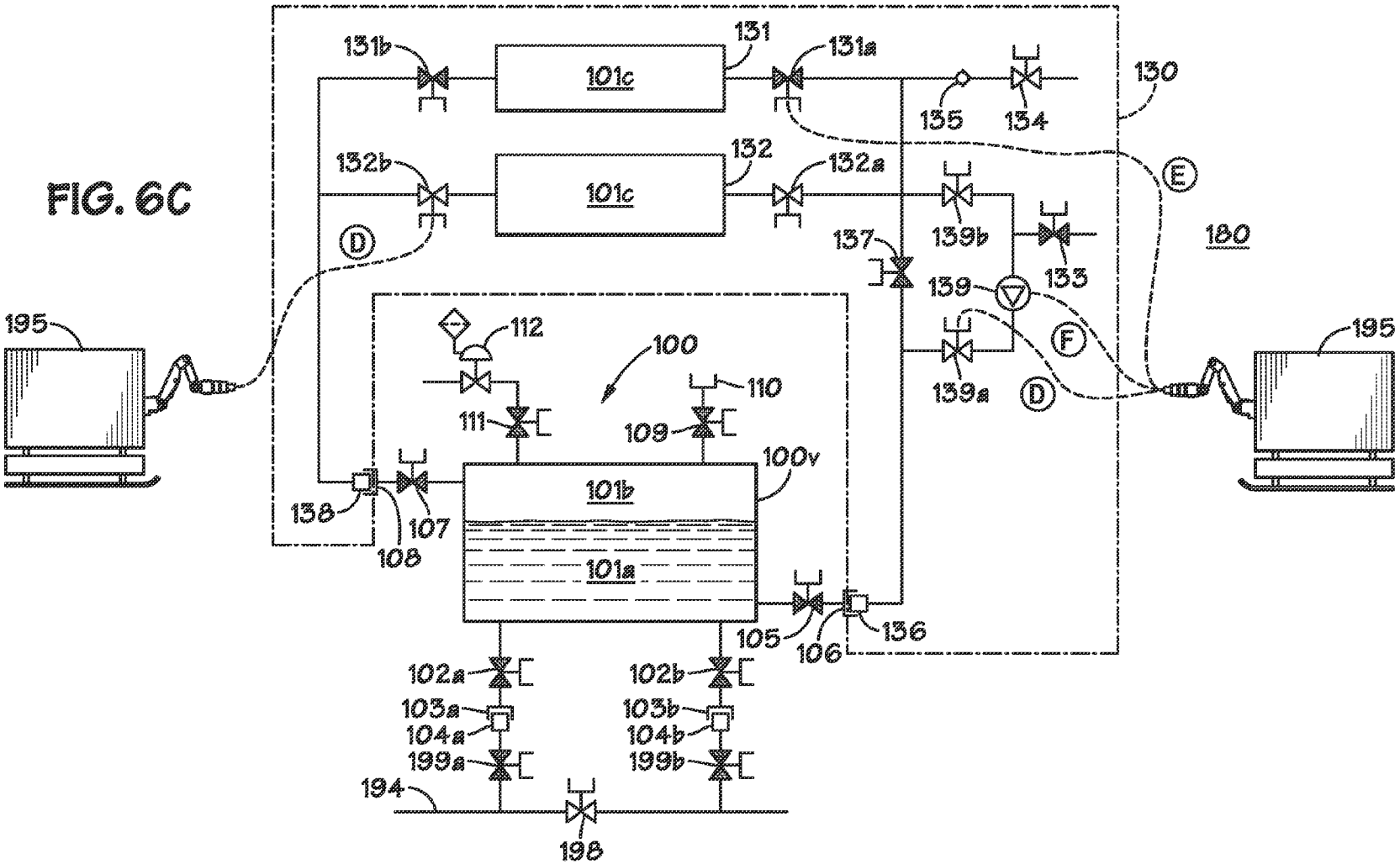
Figure 6D:
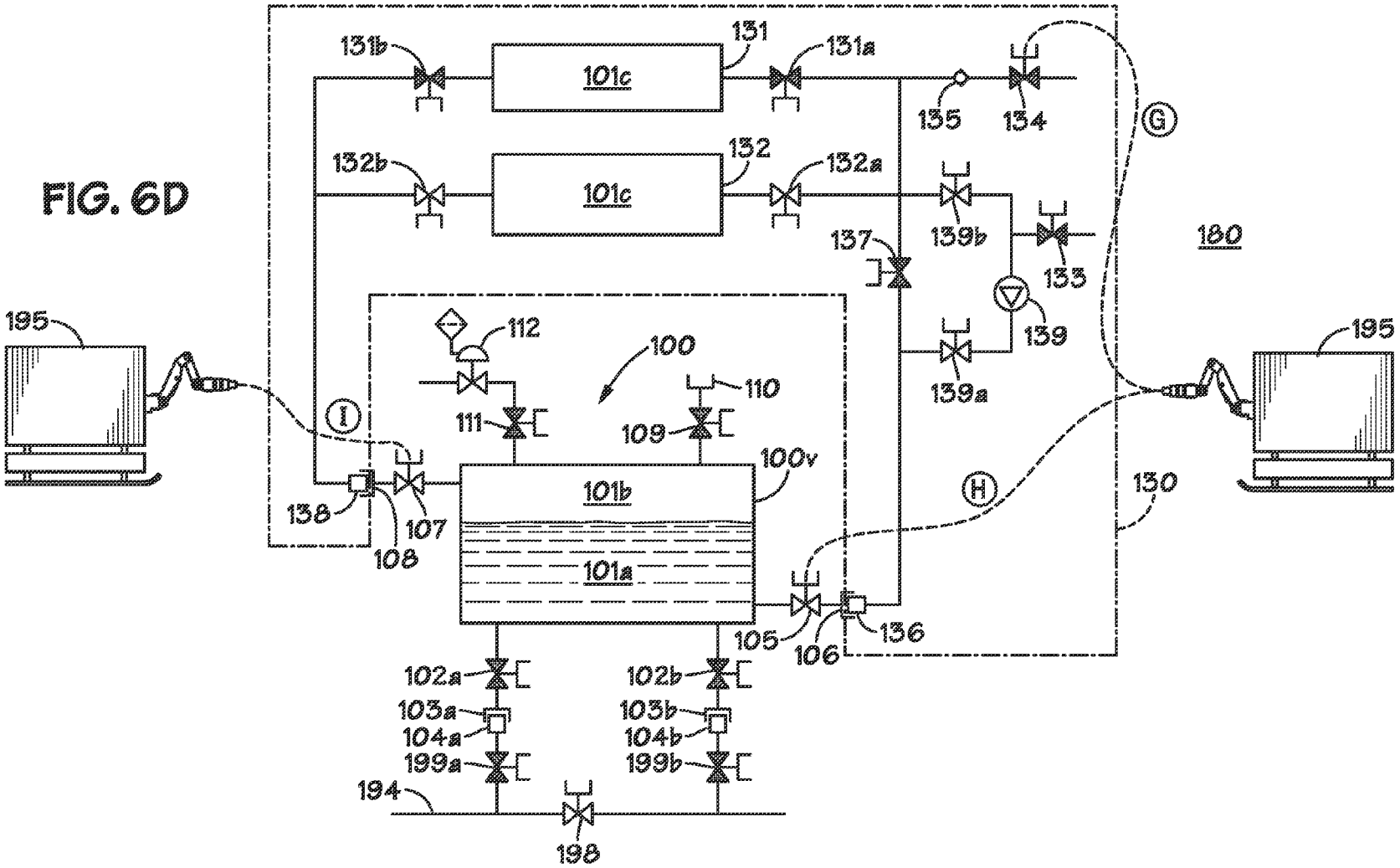

FIGS. 6C and 6D schematically illustrate various steps that may be performed in preparation for removing at least some hydrocarbons from the subsea equipment package 100, and transferring those removed hydrocarbons to the subsea processing package 130. In certain embodiments, these preparation steps may include the following:

D. Open the first circulation valve 139*a* and the second separator isolation valve 132*b* by operation of an ROV 195.

E. Close the first tank isolation valve 131*a* by operation of an ROV 195.

F. Start operation of the circulation pump 139 by operation of an ROV 195.

After the first circulation valve 139*a* and the second separator isolation valve 132*b* have been opened (Step D), the separator vessel 132 is substantially open to fluid circulation. On the other hand, after the first tank isolation valve 131*a* has been closed (Step E), the tank 131 is substantially closed off to fluid circulation. The circulation pump 139 is then operated (Step F) by drawing seawater from the subsea environment 180 through the second inlet valve 134, the check valve 135, and the second circulation valve 139*b* on the suction side of the circulation pump 139 and pumping the seawater through the first circulation valve 139*a* and the connections 136, 106 to the lower isolation valve 105 on the subsea equipment package 100 on the discharge side of the circulation pump 139.

Once the circulation pump 139 has been operated so as to achieve pressure equalization across the lower isolation valve 105—i.e., between the subsea processing package 130 and the subsea equipment package 100—the following further steps may be performed so as to generate a flow circulation through both the subsea equipment package 100 and the subsea processing package 130:

G. Close the second inlet valve 134 to the subsea processing package 130 by operation of an ROV 195.

H. Open the lower isolation valve 105 by operation of an ROV 195.

I. Open the upper isolation valve 107 by operation of an ROV 195.

Figure 6E:
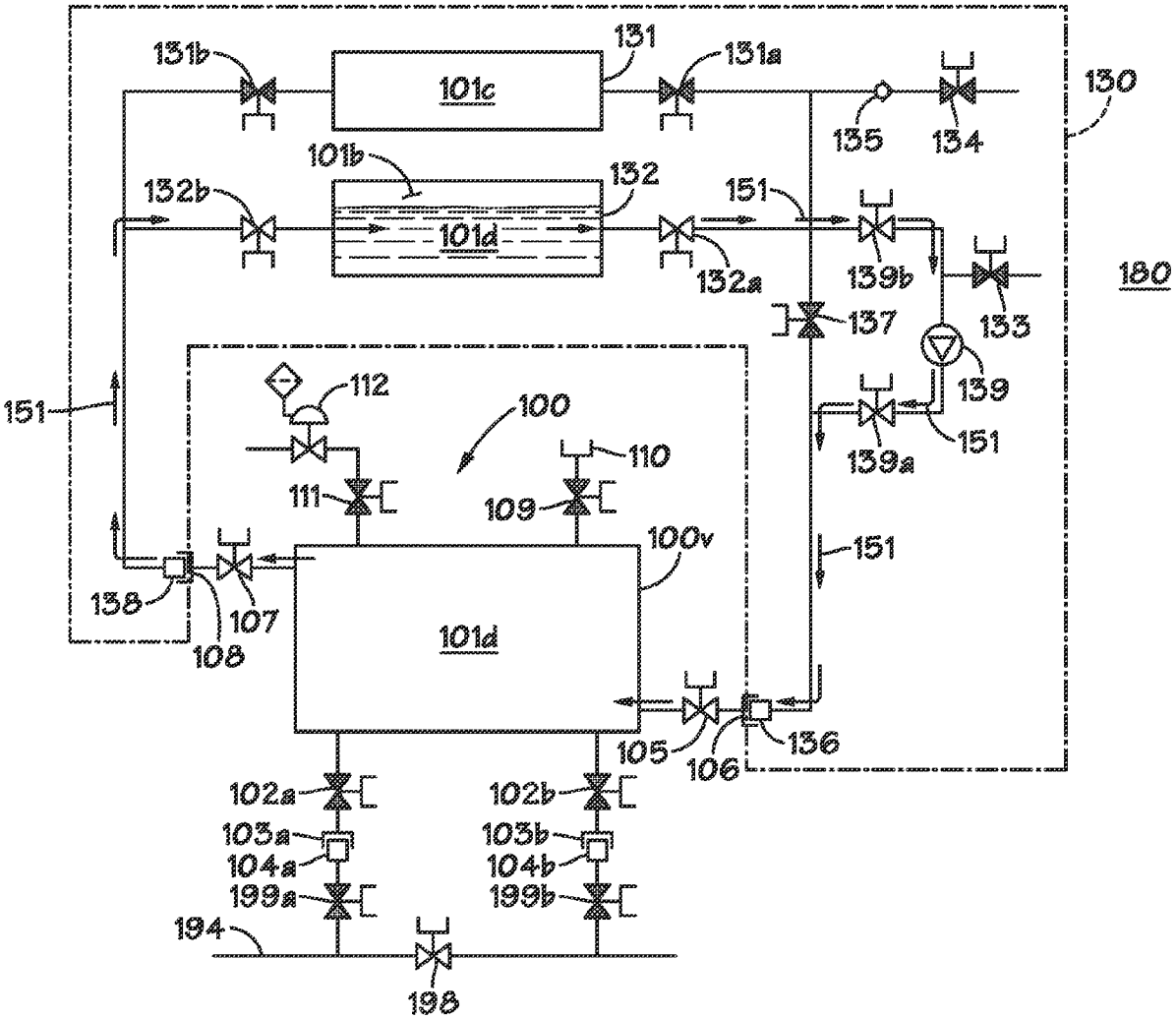

FIG. 6E schematically illustrates the circuit and direction of a fluid flow 151 flowing through both the subsea equipment package 100 and the subsea processing package 130 after the above listed steps have been performed. In certain embodiments, the fluid flow 151 may be made up of a fluid mixture that includes, among other things, seawater drawn in through the second inlet valve 134, flow assurance chemicals 101*c* from the separator vessel 132, and separated liquid 101*a* and separated gas 101*b* from the subsea equipment package 100. As shown in FIG. 6E, the fluid flow 151 is discharged from the circulation pump 139 and flows through the first circulation valve 139*a*, the connections 136 and 106, and the lower isolation valve 105, where it then enters the separator vessel 100*v*. The fluid flow 151 then exits the separator vessel 100*v*, where it passes through the upper isolation valve 107, the connections 108 and 138, and the second separator isolation valve 132*b* before entering the separator vessel 132. After exiting the separator vessel 132, the fluid flow 151 passes through the first separator isolation valve 132*a* and the second circulation valve 139*b* on the suction side of the circulation pump 139, as circulation of the fluid flow 151 thereafter continues in the same fashion. In some embodiments, a choke (not shown) or similar device may be positioned between the second separator isolation valve 132*b* and the separator vessel 132 to create pressure differential between the fluid pressure entering the separator vessel 132, and fluid pressure exiting the separator vessel 132.

In at least some embodiments, as the fluid flow 151 circulates through the subsea equipment package 100 and the subsea processing package 130 in the manner described above, at least a portion of the separated gas 101*b* that was initially contained in the subsea equipment package 100 into the separator vessel 132. Simultaneously, the fluid flow 151 may also circulate at least a portion of the flow assurance chemicals 101*c* the were initially present in the separator vessel 131, thereby treating the separated liquid 101*a* (e.g., liquid phase hydrocarbons and produced water) so as to substantially prevent, or at least minimize, the formation of hydrates and/or undesirable hydrocarbon precipitates.

In certain embodiments, circulation of the fluid flow 151 may continue in the manner described above until substantially most of the separated gas 101*b* has been transferred to the separator vessel 132, as shown in FIG. 6E. Additionally, once substantially most of the separated gas 101*b* has been transferred to the separator vessel, the subsea equipment package 100 may be substantially filled with a mixture 101*d* that is made up of at least the separated liquid 101*a* and the flow assurance chemicals 101*c*, although some amount of separated gas 101*b* may still be present in the subsea equipment package 100, depending on the overall efficiency of the separation process. Furthermore, in at least some embodiments, an amount of the mixture 101*d* containing, among other things, the flow assurance chemicals 101*c*, may also be present in the separator vessel 132, thus enabling the recovery of at least a portion of the flow assurance chemicals 101*c* during the above-described process.

Figure 6F:
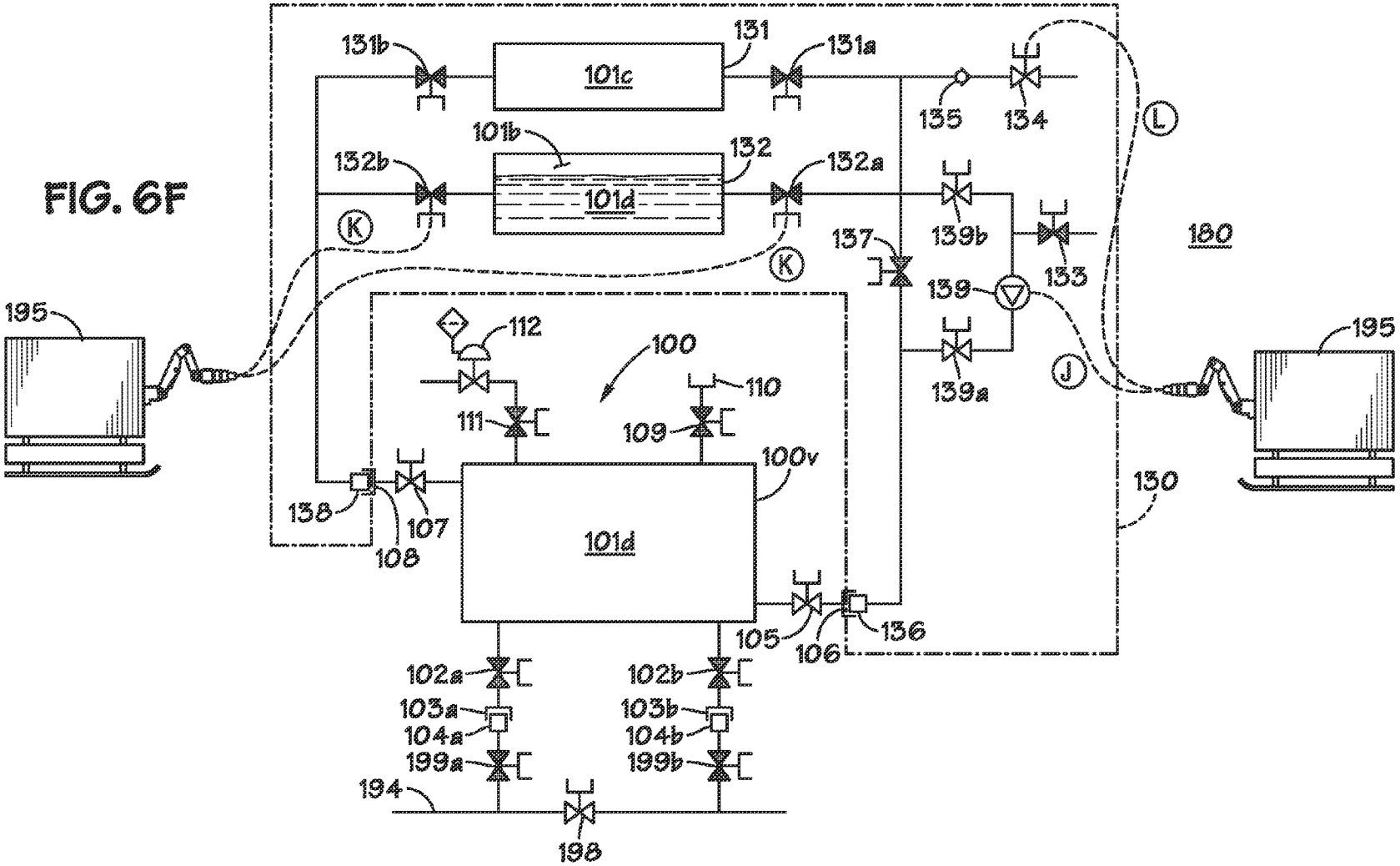
Figure 6G:
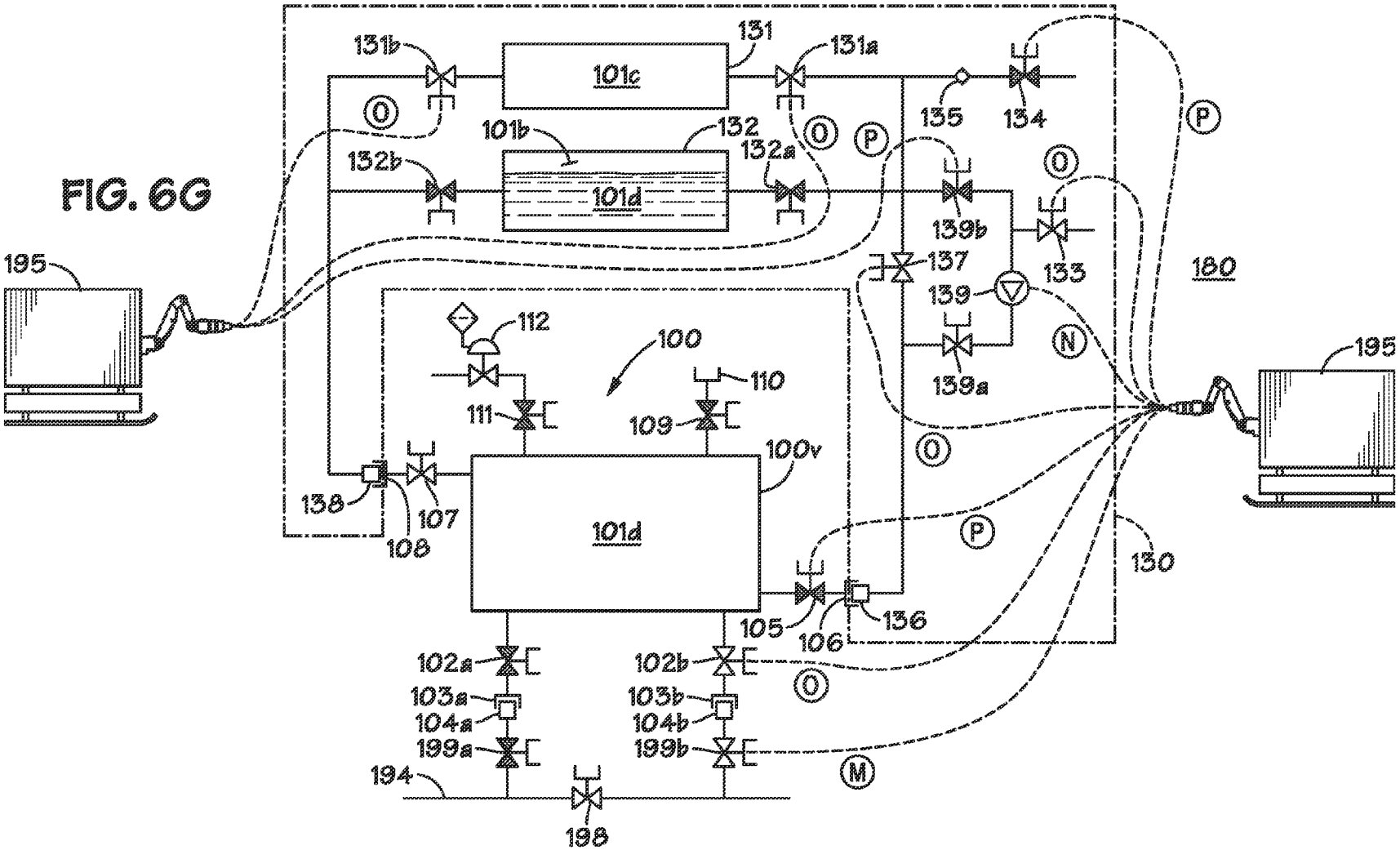

FIGS. 6F and 6G schematically illustrates some additional method steps that may be performed once substantially most of the separated gas 101*b* has been transferred to the separator vessel 132 and in preparation for flushing the mixture 101*d* contained in the subsea equipment package 100 into the flowline 194. In some embodiments, these steps may include:

J. Shut down operation of the circulation pump 139 by operation of an ROV 195.

K. Close the first and second separator isolation valves 132*a/b* by operation of an ROV 195.

L. Open second inlet valve 134 by operation of an ROV 195.

M. Open the second flowline isolation valve 199*b* by operation of an ROV 195.

N. Restart operation of the circulation pump 139 by operation of an ROV 195.

In certain embodiments, the circulation pump 139 may be operated until pressure is substantially equalized across the second equipment isolation valve 102*b*, i.e., between the subsea processing package 130 and the subsea equipment package 100 on one side, and the flowline 194 on the other side. Thereafter, in some embodiments, various additional method steps may be performed so as to substantially flush the mixture 101*d* out of the subsea equipment package 100 and into the flowline 194, which steps may include the following:

O. Open the first and second tank isolation valves 131*a*/b, the first inlet valve 133, the bypass valve 137, and the second equipment isolation valve 102*b* by operation of an ROV 195.

P. Close the lower isolation valve 105, the second inlet valve 134, and the second circulation valve 139*b* by operation of an ROV 195.

Figure 6H:
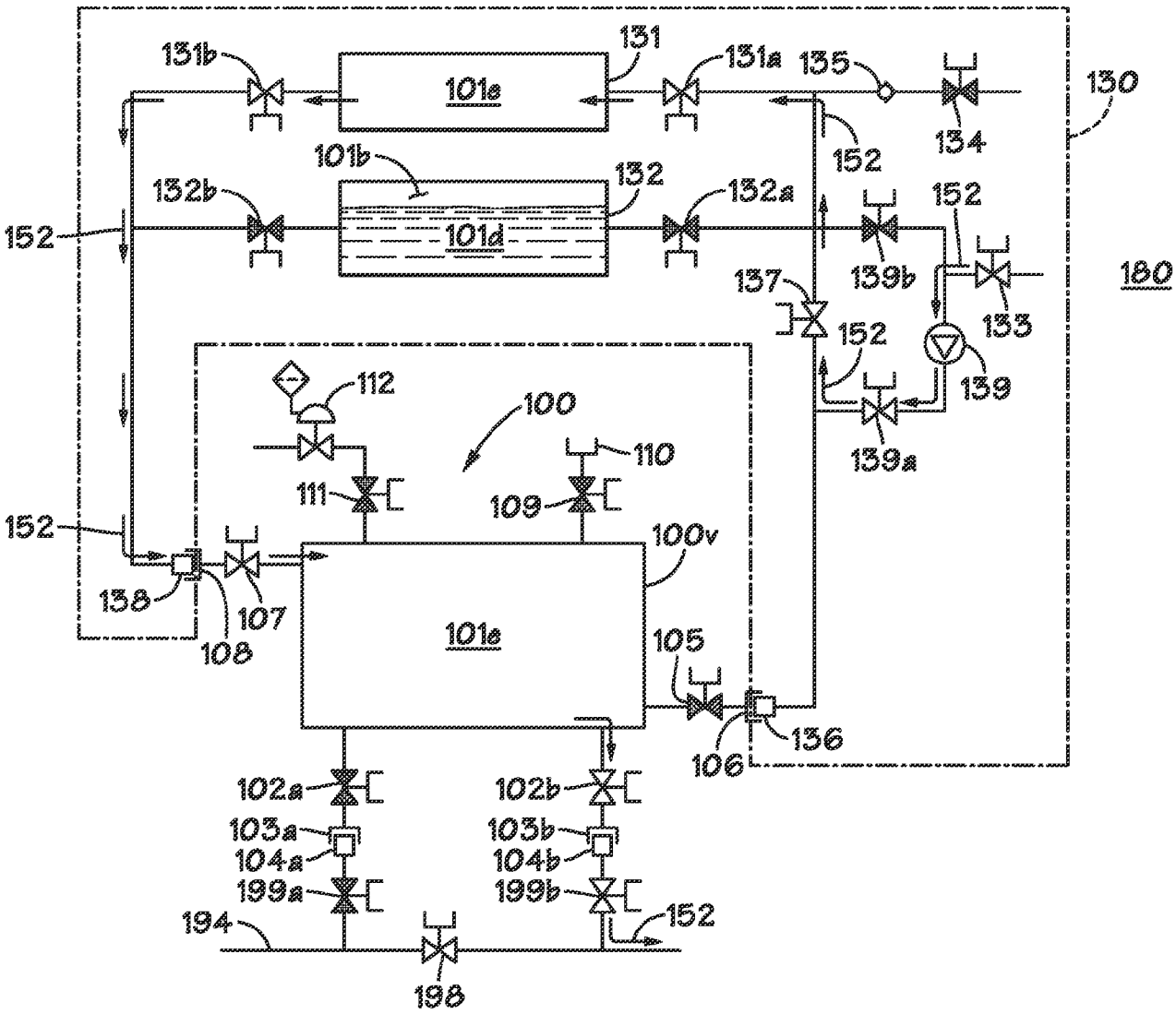
Figure 61:
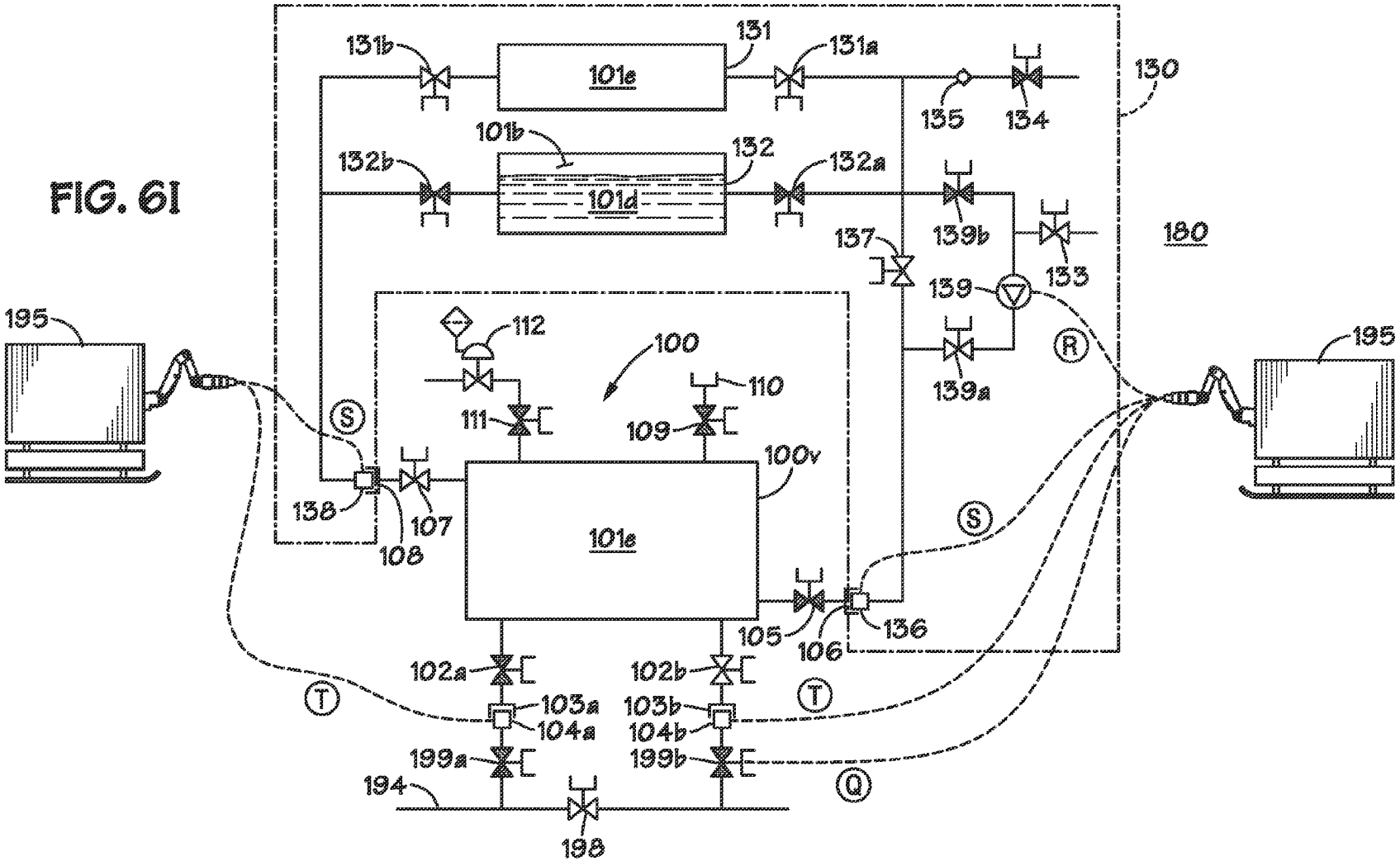

FIG. 6H schematically illustrates the circuit and direction of a fluid flow 152 flowing through the subsea processing package 130, the subsea equipment package 100, and into the flowline 194 after performing the above-listed steps. As shown in FIG. 6H, the fluid flow 152 begins when seawater is drawn through the first inlet valve 133 to the suction side of the circulation pump 139, and continues as it is discharged from the circulation pump 139 to flow through the first circulation valve 139*a*, the bypass valve 137, and the first tank isolation valve 131*a*, after which it enters the tank 131. The fluid flow 152 then exits the tank 131 and flows through the second tank isolation valve 131*b*, the connections 138 and 108, before entering the subsea equipment package 100. Upon leaving the subsea equipment package 100, the fluid flow 152 then flows through the second equipment isolation valve 102*b* and the second flowline isolation valve 199*b*, and exits into the flowline 194.

The fluid flow 152 continues in this manner until substantially all of the flow assurance chemicals 101*c* in the tank 131 and substantially most of the mixture 101*d* in the subsea equipment package 100 have be pumped into the flowline 194 and replaced by the liquid 101*e*. In some embodiments, and depending on the amount of time the circulation pump 139 is run and the fluid flow 152 continues, the liquid 101*e* may be raw seawater, whereas in other embodiments the liquid 101*e* may be a combination of seawater mixed with some amount of flow assurance chemicals 101*c*, or even a small quantity of liquid phase hydrocarbons.

FIG. 6I schematically illustrates the subsea equipment package 100 and the subsea processing package 130 shown in FIG. 6H after substantially most of the mixture 101*d* has been flushed into the flowline 194 in the manner described above. Furthermore, FIG. 6I also illustrates at least some additional steps that may be performed in conjunction with certain exemplary methods disclosed herein so as to separate the subsea equipment package 100 from both the subsea processing package 130 and the flowline 194 in preparation for retrieving the subsea equipment package 100 to the surface 191 (see, FIG. 1). In some embodiments, these additional steps may include, among other things, the following:

Q. Close the second flowline isolation valve 199*b* by operation of an ROV 195.

R. Shut down operation of the circulation pump 139 by operation of an ROV 195.

S. Disconnect the first package connection 136 from the lower connection 106 and the second package connection 138 from the upper connection 108 by operation of an ROV 195.

T. Disconnect the first equipment connection 103*a* from the first flowline connection 104*a* and the second equipment connection 103*b* from the second flowline connection 104*b* by operation of an ROV 195.

In some embodiments, after the second flowline isolation valve 199*b* has been closed (Step Q), the subsea equipment package 100 may be substantially isolated from the flowline 194. Furthermore, in certain embodiments, after the operation of the circulation pump 139 has been shut down (Step R), the pressure in the subsea equipment package 100 and the subsea processing package 130 may be allowed to substantially equalize to the local hydrostatic pressure of the subsea environment 180 through the first inlet valve 133. The subsea equipment package 100 may then be separated from the subsea processing package 130 at the connections 138/108 and 136/106, and separated from the flowline 194 at the connections 103*a*/104*a* and 103*b*/104*b*. Thereafter, the subsea equipment package 100—which may now contain fluid 101*e* (e.g., seawater or a mixture of seawater and flow assurance chemicals 101*c*) at local hydrostatic conditions—may now be retrieved in accordance with any appropriate equipment retrieval method disclosed herein.

Furthermore, it should be appreciated that, in at least some embodiments disclosed herein, the subsea processing package 130 may be sometimes be left adjacent to the subsea equipment installation position of the subsea equipment package 100, e.g., at or near the sea floor 192 (see, FIG. 1) after the package 100 has been retrieved to the surface 191 (see, FIG. 1). Moreover, in certain illustrative embodiments, some or all of the hydrocarbons that may have been removed from the subsea equipment package 100 and stored in the separator vessel 132 of the subsea processing package 130, such as separated gas 101*b* and the like, may be re-injected into a replacement subsea equipment package, such as one of the replacement subsea equipment packages 200 shown in FIGS. 3A-3J, upon deployment of the replacement subsea equipment package to the respective subsea equipment installation position that may have been previously occupied by the subsea equipment package 100.

FIGS. 7A-7I schematically depict additional illustrative embodiments of the present subject matter, wherein a separate subsea pump package 140 may be used in conjunction with various disclosed methods the remove hydrocarbons from a subsea equipment package 100 prior to depressurizing the package 100 and retrieving the package 100 to an intervention vessel 190 at the surface 191 (see, FIG. 1). In the illustrative embodiment shown in FIG. 7A, the subsea equipment package 100 may be substantially similar to any one of the subsea equipment packages 100 disclosed herein. Furthermore, in the operational configuration shown in FIG. 7A, the various valve positions may be configured for normal operation of the subsea equipment package 100, such that substantially the entirety of production flow from the flowline 194 passes through the package 100. Accordingly, the subsea equipment package 100 may contain, among other things, a separated liquid 101*a* and a separated gas 101*b*, as has been previously described with respect to other illustrative embodiments.

Figure 7A:
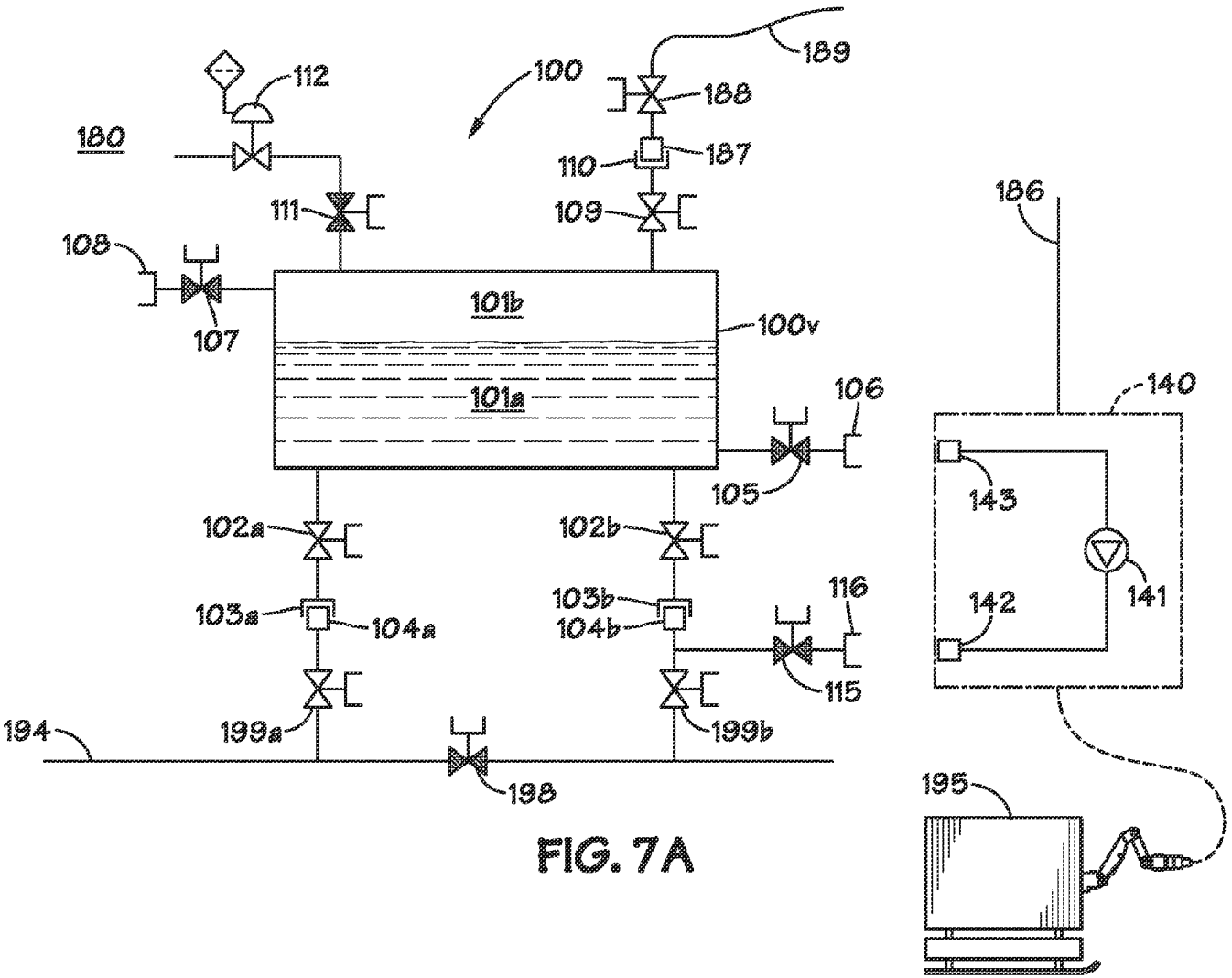

FIG. 7A further depicts an exemplary embodiment wherein an auxiliary flowline connection 116 may be located between the second flowline connection 104*b* and the second flowline isolation valve 199*b*. Furthermore, an auxiliary isolation valve 115 may be used to separate the auxiliary flowline connection 116 from the second flowline connection 104*b* and the second flowline isolation valve 199*b*.

Also shown in FIG. 7A is a schematic depiction of a subsea pump package 140, which, as noted above, may be used in conjunction with at least some methods disclosed herein for removing at least some hydrocarbons from the subsea equipment package 100. In some embodiments, the subsea pump package 140 may include, among other things, a pump 141 having a pump discharge connection 142 and pump suction connection 143. In some illustrative embodiments, the pump 141 may be, for example, a high differential pressure pump, such as a positive displacement pump and the like, and which may be used pump the separated liquid 101*a* and separated gas 101*b* from the subsea equipment package 100 into the flowline 194, and furthermore may operable by an ROV 195.

In certain embodiments, the subsea pump package 140 may be configured so as to bypass the second equipment isolation valve 102*b*. More specifically, in at least some embodiments, the pump suction connection 143 may be adapted to connect to and sealingly engage with the lower connection 106 on the subsea equipment package 100, whereas the pump discharge connection 142 may be adapted to similarly connect to and sealingly engage with the auxiliary flowline connection 116, thereby allowing the subsea pump package 140 to bypass the second equipment isolation valve 102*b* during the operation of the pump 141.

As shown in FIG. 7A, in at least some embodiments, the subsea pump package 140 may be lowered from the surface 191 (see, FIG. 1) and into the subsea environment 180 near the subsea equipment package 100 using the lift line 186. Additionally, an ROV 195 may be used to position the subsea pump package 140 adjacent to the subsea equipment package 100, so that the subsea pump package 140 can be attached to the subsea equipment package 100 and the flowline 194 as described below.

Figure 7B:
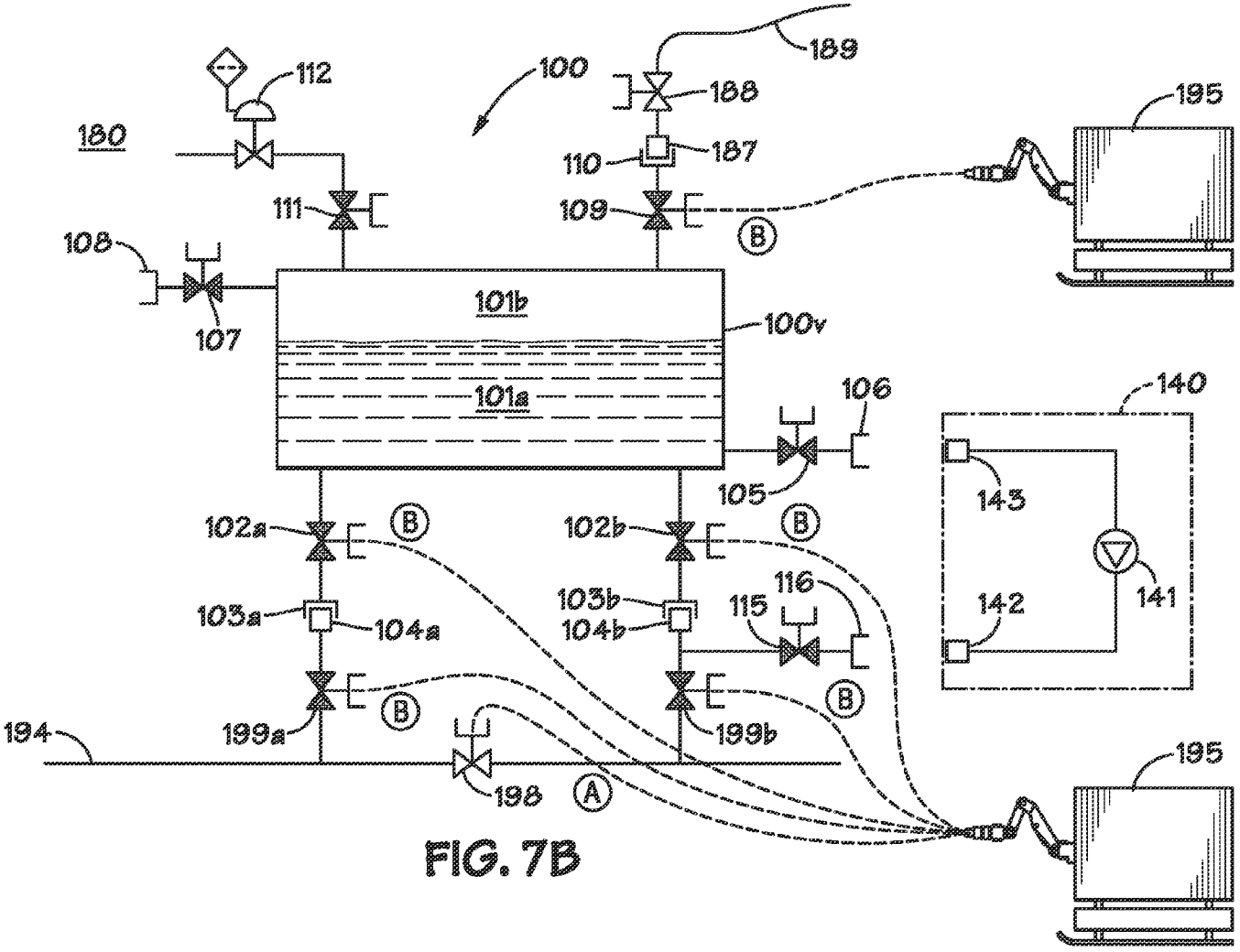

FIG. 7B schematically illustrates the subsea equipment package 100 shown in FIG. 7A after the subsea pump package 140 has been positioned adjacent to the subsea equipment package 100 using the lift line 186 and/or an ROV 195. FIG. 7B further depicts some initial method steps that may be performed so as to isolate the subsea equipment package 100 from the flowline 194 in preparation for attaching the subsea pump package 140, which may then be used to remove at least some of the separated liquid 101*a* and/or separated gas 101*b* from the subsea equipment package 100. In certain embodiments, these initial method steps may include, among other things, the following:

A. Open the bypass valve 198 by operation of an ROV 195.

B. Close the first and second flowline isolation valves 199*a/b*, the first and second equipment isolation valves 102*a/b*, and the chemical injection valve 109 by operation of an ROV 195.

Figure 7C:
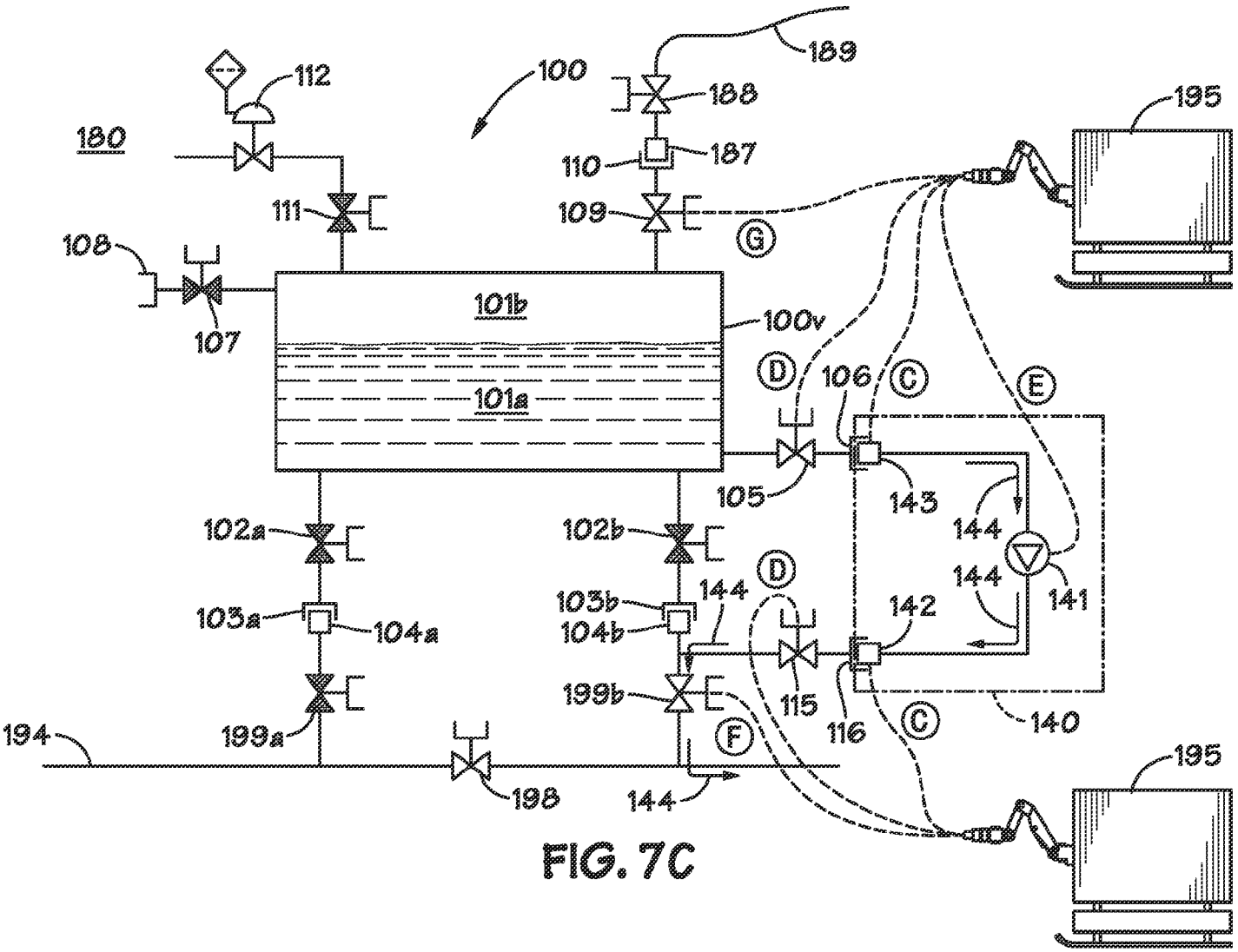

After completion of the above-described steps, the subsea equipment package 100 may be isolated from the flowline 194, so that all of the production flow may flow through flowline bypass valve 198, and none passes through the package 100. FIG. 7C schematically depicts further illustrative method steps that may be used to attached the subsea pump package 140 to the subsea equipment package 100 and the flowline 194, and to operate the pump package 140 so as to generate a flow 144 of the separated liquid 101*a* and separated gas 101*b* from the separator vessel 100*v* to the flowline 194. In some embodiments, these steps may include the following:

C. Connect the pump suction and discharge connections 143 and 142 to the lower connection 106 and the auxiliary flowline connection 116, respectively, by operation of an ROV 195.

D. Open the lower isolation valve 105 and the auxiliary isolation valve 115 by operation of an ROV 195.

E. Start operation of the pump 141 by operation of an ROV 195.

F. Open the second flowline isolation valve 199*b* by operation of an ROV 195.

In at least some embodiments, after the pump 141 has been started (Step E) and the lower isolation valve 105, auxiliary isolation valve 115, and second flowline isolation valve 199*b* has been opened (Steps D and F), the subsea equipment package 100 is then in fluid communication with the flowline 194, such that pump 141 may then operate until substantially the entirety of the contents of the package 100, e.g., the separated liquid 101*a* and separated gas 101*b*, have been pumped into the flowline 194. In certain embodiments, the pump 141 may be operated by an ROV, such as the ROV 195, which may supply hydraulic, pneumatic, electric, or other power so as to drive the pump 141. Furthermore, as noted above, the pump 141 may be, for example, a positive displacement pump and the like, which in some embodiments may be equipped with a cycle counter or flow meter and the like, so as to be able determine when substantially the entire volume of the subsea equipment package 100 has been evacuated.

In certain embodiments, pressure may be drawn down in the subsea equipment package 100 as the separated liquid 101*a* and separated gas 101*b* are evacuated from the package 100 by by operation of the pump 141. Furthermore, in some embodiments, the pressure in the subsea equipment package 100 may approach vacuum conditions during this operation while at least a portion of the contents of the package 100 may not have been fully removed. In such embodiments, at least the following additional step may be performed so as to facilitate the removal of any remaining portions of the separated liquid 101*a* and separated gas 101*b* from the package 100:

G. Open the chemical injection valve 109 by operation of an ROV 195.

After the chemical injection valve 109 has been opened (Step G), a quantity of flow assurance chemicals may be injected into the subsea equipment package 100 so to substantially wash any remaining hydrocarbons out of the package 100 and into the flowline 194. Furthermore, in at least some embodiments, the injection of flow assurance chemicals into the subsea equipment package 100 through the chemical injection connection 110 may also serve to maintain at least a small level of pressure in the package 100, thereby guarding against a potential collapse condition on any of the various equipment components that make up the subsea equipment package 100 while the pump 141 is operating. After substantially all of the separated liquid 101*a* and separated gas 101*b* have been removed from the subsea equipment package 100 and pumped into the flowline 194, the following further step shown in FIG. 7D may then be performed:

H. Stop operation of the pump 141 by operation of an ROV 195.

Figure 7D:
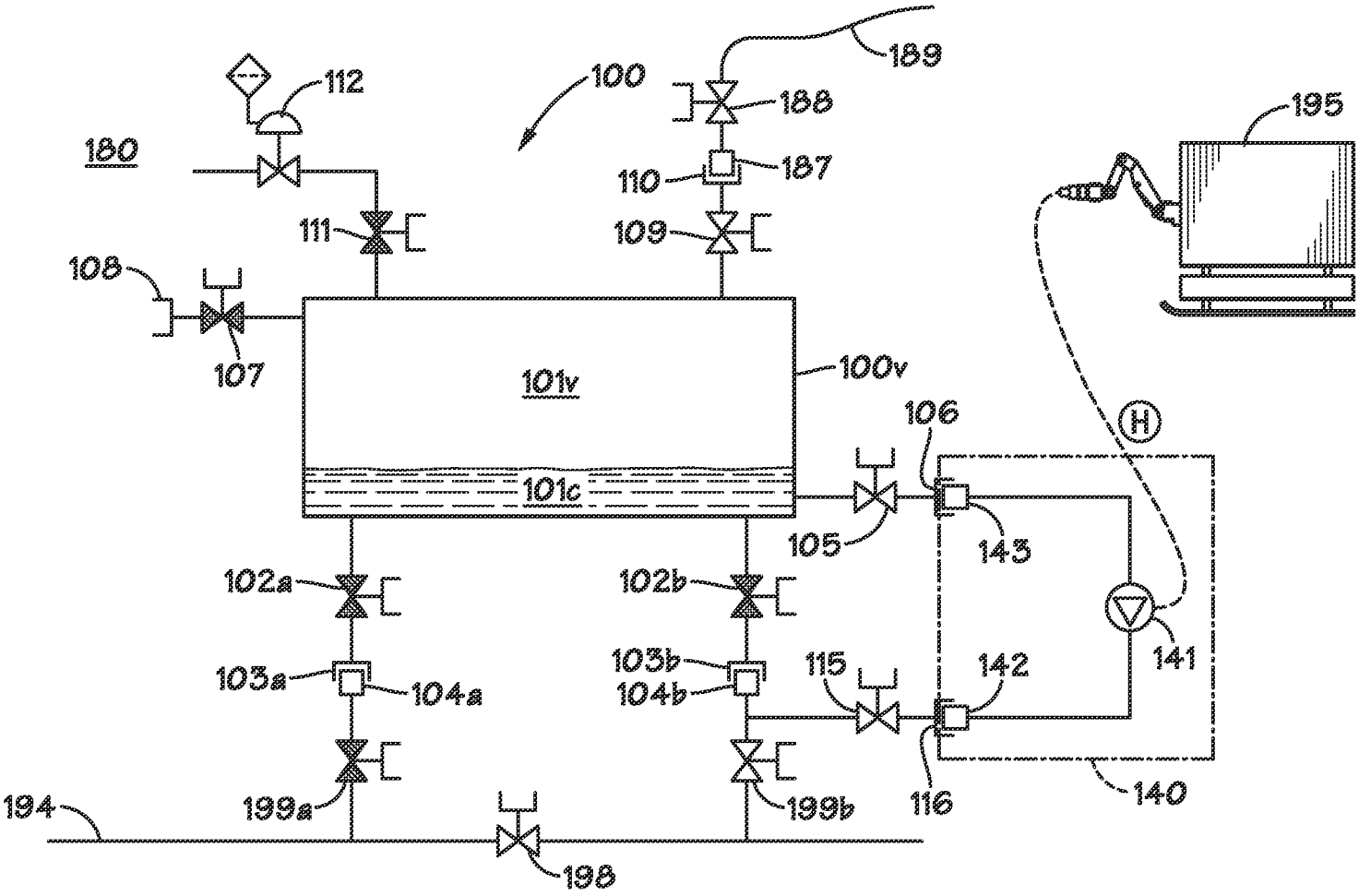

In some illustrative embodiments, once the pump 141 has been stopped (Step H), the subsea equipment package 100 may contain at least some amount of the flow assurance chemicals 101*c* that may have been injected into the package 100 through the chemical injection connection 110 during the previous operations, as shown in FIG. 7D. Furthermore, in certain embodiments, the subsea equipment package 100 may also contain a quantity of gas 101*v*, which may be made up of a portion of the separated gas 101*b* and any remaining vapor pressure of the separated liquid 101*a* previously removed from the package 100. In certain embodiments, the pressure of the subsea equipment package 100 may then be equalized with the local hydrostatic pressure of the subsea environment 180 by any method previously described herein, such as by adjusting the pressure in the package 100 by injection additional flow assurance chemicals 101*c* through the chemical injection connection 110 by operation of a chemical injection system (not shown), and the like.

Figure 7E:
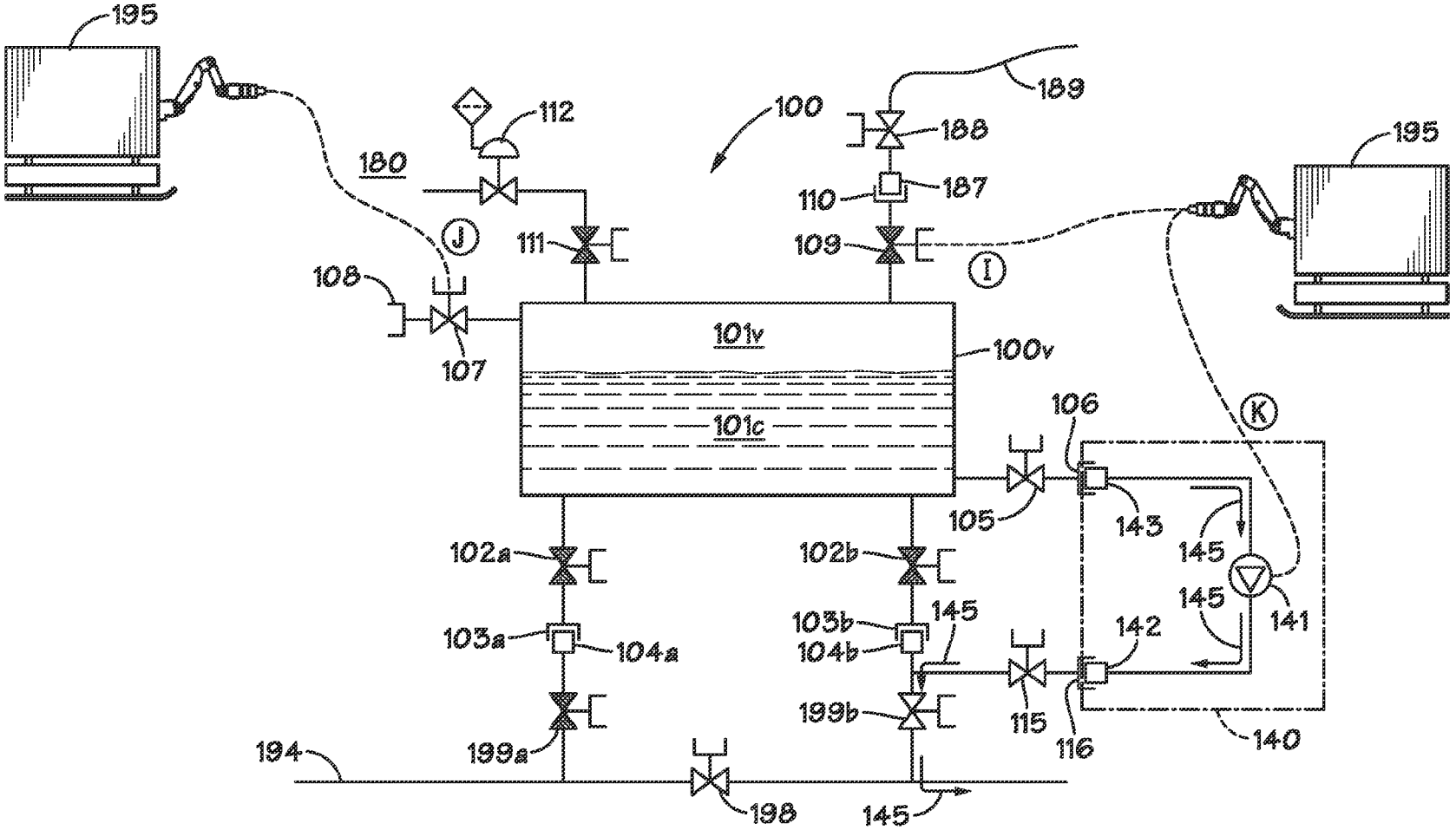

FIG. 7E schematically illustrates the subsea equipment package 100 shown in FIG. 7D after the pressure within the package 100 has been equalized with local hydrostatic pressure. In some embodiments, the subsea equipment package 100 may contain a larger quantity of flow assurance chemicals 101*c* as shown in FIG. 7E, whereas the volume of gas 101*v* may have been reduced as the pressure in the package 100 was equalized during the previously performed pressure equalization steps. In other embodiments, the subsea equipment package 100 may be substantially filled with the flow assurance chemicals 101*c*, depending on the vapor pressure of the gas 101*v* in the package 100 prior to pressure. Furthermore, FIG. 7E also depicts some additional method steps that may be performed in accordance with some illustrative embodiments disclosed herein so as to further prepare the subsea equipment package 100 for separation from the flowline 194 and retrieval to the surface 191 (see, FIG. 1). In certain embodiments, these additional preparation steps may include, among other things, the following:

I. Close the chemical injection isolation valve 109 by operation of an ROV 195.

J. Open the upper isolation valve 107 by operation of an ROV 195.

K. Restart operation of the pump 141 by operation of an ROV 195.

In some embodiments, after the upper isolation 107 valve has been opened (Step J) and the pump 141 has been restarted (Step K), the pump 141 may be operated so as to draw seawater through the upper connection 108 and the open upper isolation valve 107 and into the subsea equipment package 100 so as to mix with the contents of the package 100, e.g., flow assurance chemicals 101*c* and/or gas 101*v*, and to generate a flow 145 that will flush the mixture into the flowline 194 through the auxiliary isolation valve 115 and the second flowline isolation valve 199*b*. In certain embodiments, a cycle counter or flow meter and the like on the pump 141 may be monitored so that the pump 141 can be stopped prior to injecting raw seawater—i.e., seawater that is not mixed with at least an amount of flow assurance chemicals 101*c* that is necessary to prevent hydrate formation—into the flowline 194.

Figure 7F:
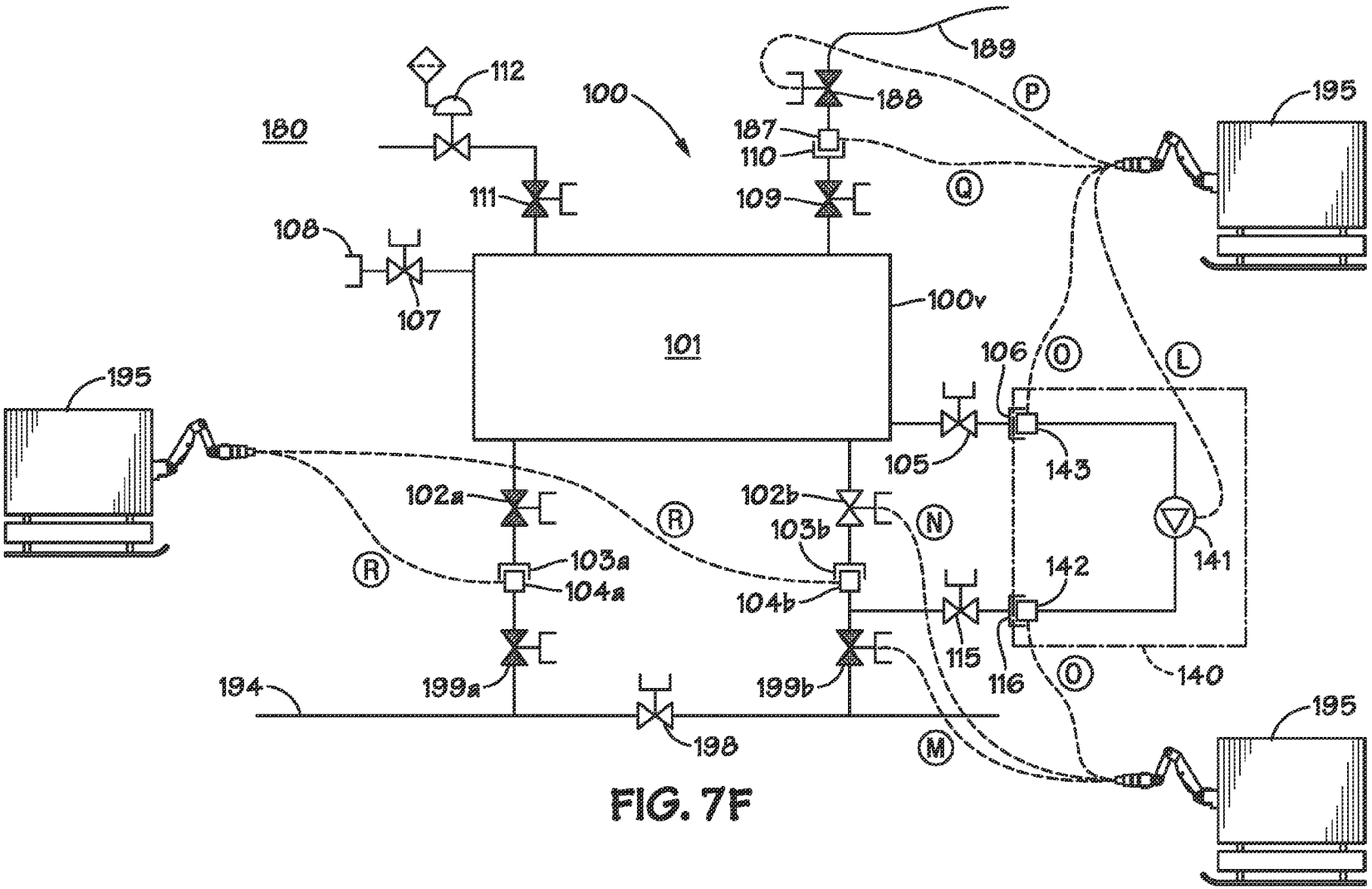

FIG. 7F schematically depicts the subsea equipment package 100 of FIG. 7E after the contents of the package 100 have been flushed into the flowline 194 as described above. In some embodiments, the subsea equipment package 100 may have been substantially filled with seawater 101 during the previous flushing operations. In other embodiments, the seawater 101 may be mixed with some amount of flow assurance chemicals 101*c*, depending on how long the pump 141 may be operated during the flushing operation. FIG. 7F also shows some further additional method steps that may be performed in accordance with other illustrative embodiments so as to separate the subsea equipment package 100 from the flowline 194 prior to retrieving the package 100 to the surface. In certain embodiments, these separation steps may include the following:

L. Shut down operation of the pump 141 by operation of an ROV 195.

M. Close the second flowline isolation valve 199*b* by operation of an ROV 195.

N. Open the second equipment isolation valve 102*b* by operation of an ROV 195.

O. Disconnect the pump suction and discharge connections 143 and 142 from the lower connection 106 and the auxiliary flowline connection 116, respectively, by operation of an ROV 195.

P. Close the chemical injection line isolation valve 188 by operation of an ROV 195.

Q. Disconnect the chemical injection flowline connection 187 from the chemical injection connection 110 by operation of an ROV 195.

R. Disconnect the first and second equipment connections 103*a/b* from the first and second flowline connections 104*a/b* by operation of an ROV 195.

As noted above, in some embodiments, operation of the pump 141 may be shut down (Step L) based upon an evaluation of the amount of fluid that has been pumped out of the subsea equipment package 100, e.g., by monitoring a cycle counter on a positive displacement pump and the like, so as to substantially avoid pumping raw seawater into the flowline 194.

Figure 7G:
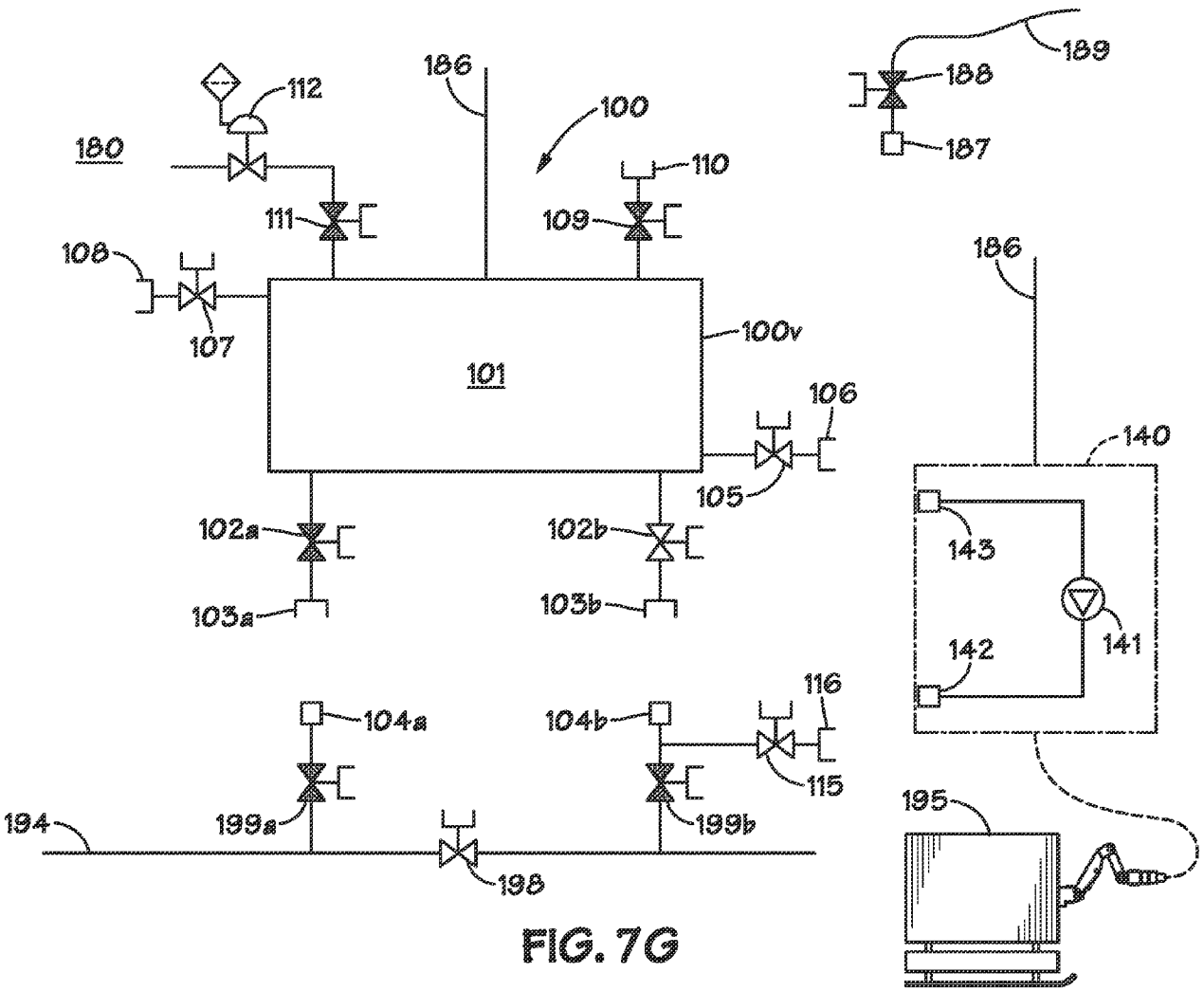

FIG. 7G schematically illustrates the subsea equipment package 100 shown in FIG. 7F after completion of the above-listed steps, wherein the package 100 is substantially filled with seawater 101 and is being lifted away from the flowline 194 and up to the surface 191 (see, FIG. 1) using the lift line 186. Depending the desired retrieval strategy, the subsea equipment package 100 may be lifted to the surface 191 in accordance with any appropriate equipment retrieval method disclosed herein. For example, as shown in FIG. 7G, one or more of the valves on the subsea equipment package 100, e.g., valves 105, 107, and/or 109, may be left open so that the pressure in the subsea equipment package 100 can equalize with the local hydrostatic pressure of the subsea environment 180, thereby reaching the surface 191 at substantially ambient pressure conditions. Also as shown in FIG. 7G, the subsea pump package 140 may also be retrieved to the surface 191 using the lift line 186, an ROV 195, or a combination of both.

Figure 7H:
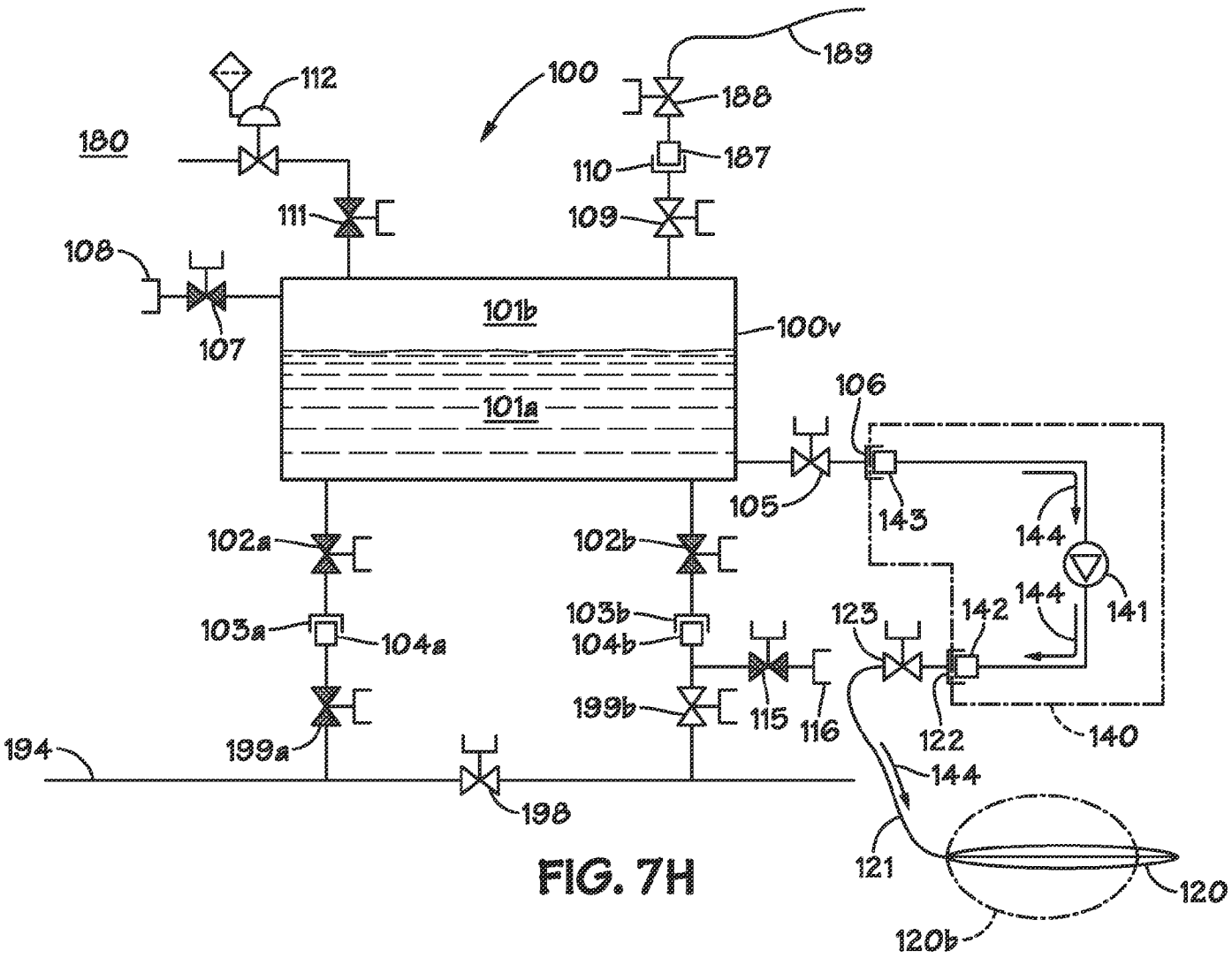
Figure 71:
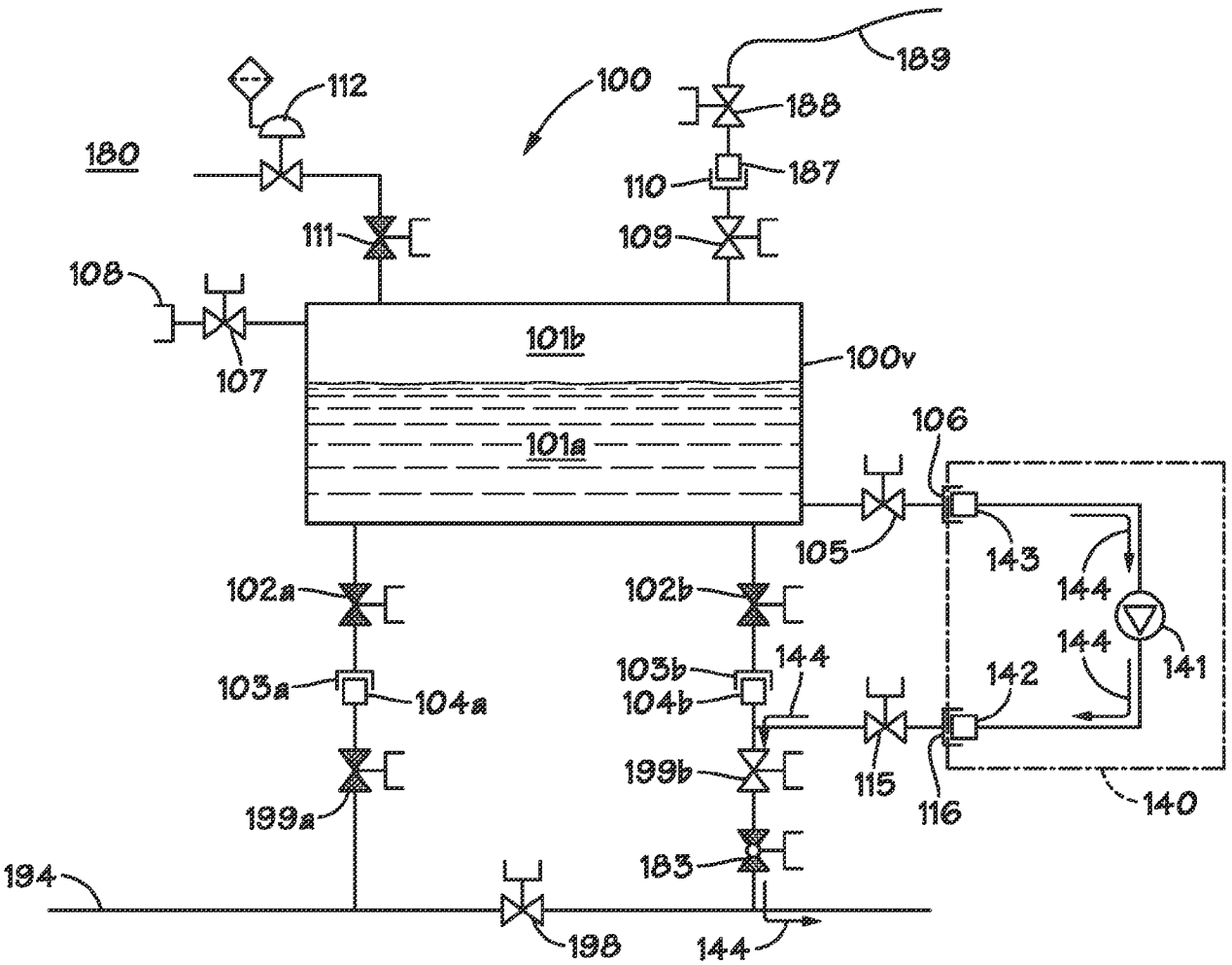

FIG. 7H schematically illustrates an exemplary alternative method of evacuating the contents of the subsea equipment package 100, e.g., the separated liquid 101*a* and separated gas 101*b*, which may be used in conjunction with the subsea pump package 140 and the method steps illustrated in FIGS. 7B-7G. More specifically, FIG. 7H shows a combined configuration of the subsea equipment package 100 and the subsea pump package 140 that is similar to the configuration illustrated in FIG. 7C and described above, wherein however the pump discharge connection 142 of the pump package 140 may not be connected to the auxiliary flowline connection 116. Instead, as shown in the illustrative embodiment depicted in FIG. 7H, the pump discharge connection 142 may be connected to an adjustable-volume subsea containment structure 120 by way of a containment structure connection 122. In some embodiments, the adjustable-volume subsea containment structure 120 shown in FIG. 7H may be configured in substantially the same fashion as any other adjustable-volume subsea containment structure 120 disclosed herein, e.g., wherein liquid may flow into the structure 120 through a containment structure isolation valve 122 and a containment structure flowline 121. Accordingly, during operation of the pump 141, the flow 144 of the contents of the subsea equipment package 100 that is generated by the pump 141 may be pumped into the adjustable-volume subsea containment structure 120 instead of into the flowline 194, thus expanding the structure 120 as is indicated by the dashed-line containment structure outline 120*b*. In this way, the separated liquid 101*a* and separated gas 101*b* that are removed from the subsea equipment package 100 may be re-injected into a replacement subsea equipment package, such as the replacement subsea equipment package 200, using one of the exemplary methods disclosed herein. See, e.g., FIGS. 3A-3J and the associated descriptions set forth above.

FIG. 7I schematically depicts yet a further exemplary equipment configuration that may be used to evacuate the contents of a subsea equipment package 100 in conjunction with one or more of the various methods illustrated in FIGS. 7A-7G and described above. More specifically, FIG. 7I shows a combined configuration of the subsea equipment package 100 and the subsea pump package 140 that is similar to the configuration illustrated in FIG. 7C and described above, wherein however a flowline ball valve 183 has been positioned between the second flowline connection 104*b* and the flowline 194, i.e., in addition to the second flowline isolation valve 199*b*. In at least some illustrative embodiments, the flowline ball valve 183 may be maintained in a closed position, as shown in FIG. 7I, during the operation of the high differential pressure pump 141, e.g., a positive displacement pump 141. In certain embodiments, the closed flowline ball valve 183 may act as a high pressure check valve, such that the ball in the closed flowline ball valve 183 may be offset from its seats by the flow 144 that is generated during each high pressure stroke of the positive displacement pump 141, thereby allowing some amount of fluid to bypass the ball, which may thereafter reseat. This unseating/reseating action of the ball in the closed flowline ball valve 183, which is sometimes referred to as a "pump through" ball valve, cyclically repeats so long as the positive displacement pump 141 is operating.

In certain illustrative embodiments, such as those embodiments wherein the local hydrostatic pressure of the subsea environment 180 is greater than the operating pressure of the flowline 194, the flowline ball valve 183 may be positioned between the second flowline isolation valve 199*b* and the flowline 194 as shown in FIG. 7I, i.e., downstream of the second flowline isolation valve 199*b*. In this configuration, the second flowline isolation valve 199*b* may be closed against the subsea environment 180, thereby preventing the local hydrostatic pressure—which is greater than the pressure in the flowline 194—from unseating the "flow through" flowline ball valve 183, thus substantially preventing seawater ingress into the flowline 194 after the subsea equipment package 100 has been removed from service.

In other illustrative embodiments, such as those embodiments wherein the operating pressure of the flowline 194 is greater than the local hydrostatic pressure of the subsea environment 180, the positions of the flowline ball valve 183 and the second flowline isolation valve 199*b* may be reversed from the configuration illustrated in FIG. 7I, such that the flowline ball valve 183 is upstream of the second flowline isolation valve 199*b*. In this configuration, the second flowline isolation valve 199*b* may be closed against the flowline 194, thereby preventing the flowline pressure—which is greater than the local hydrostatic pressure of subsea environment 180—from unseating the "flow through" flowline ball valve 183, thus substantially preventing the production fluid in the flowline 194, e.g., hydrocarbons, from being inadvertently released into the subsea environment 180.

Figure 8A:
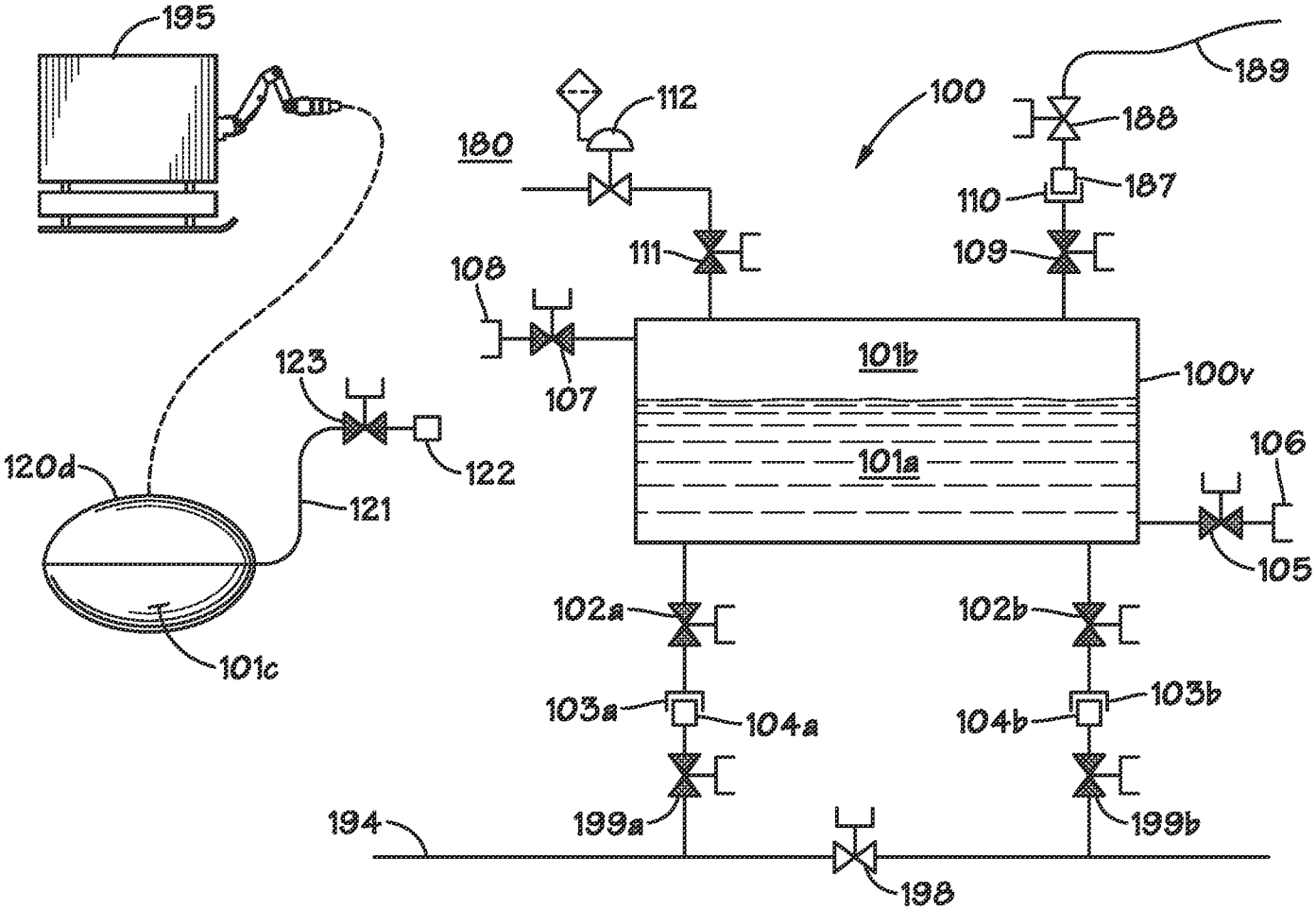
FIGS. 8A-8E schematically depict additional illustrative methods that may be used according to some exemplary embodiments of the disclosed subject matter to retrieve subsea equipment.

FIGS. 8A-8E schematically depict further exemplary methods that be used in accordance with some embodiments disclosed herein to retrieve a subsea equipment package 100, wherein the blow-down or operating pressure in the flowline 194 and the package 100 may be lower than the local hydrostatic pressure of the subsea environment 180. For example, FIG. 8A shows an illustrative subsea equipment package 100 that may, in certain embodiments, be configured in a similar fashion to any subsea equipment package 100 disclosed herein. Furthermore, as shown in FIG. 8A, the various valves on the subsea equipment package 100 may be configured as depicted, for example, in FIG. 2B and described above, such that the package 100 may be isolated from the flowline 194.

In some embodiments of the presently disclosed method, an ROV 195 may be used to deploy and position an adjustable-volume subsea containment structure 120*d* adjacent to the subsea equipment package 100 so as to facilitate the flushing and depressurization of the package 100. In certain embodiments, the adjustable-volume subsea containment structure 120*d* may be at least partially filled, i.e., pre-charged, at the surface 191 (see, FIG. 1) prior to deployment with a quantity of flow assurance chemicals 101*c*, such as MeOH or MEG and the like. In at least some embodiments, the adjustable-volume subsea containment structure 120*d* may be used during a subsequent stage to flush at least a portion of the contents of the subsea equipment package 100, e.g., separated liquid 101*a* and separated gas 101*b*, from the package 100 and into the flowline 194, as will be further described below.

Figure 8B:
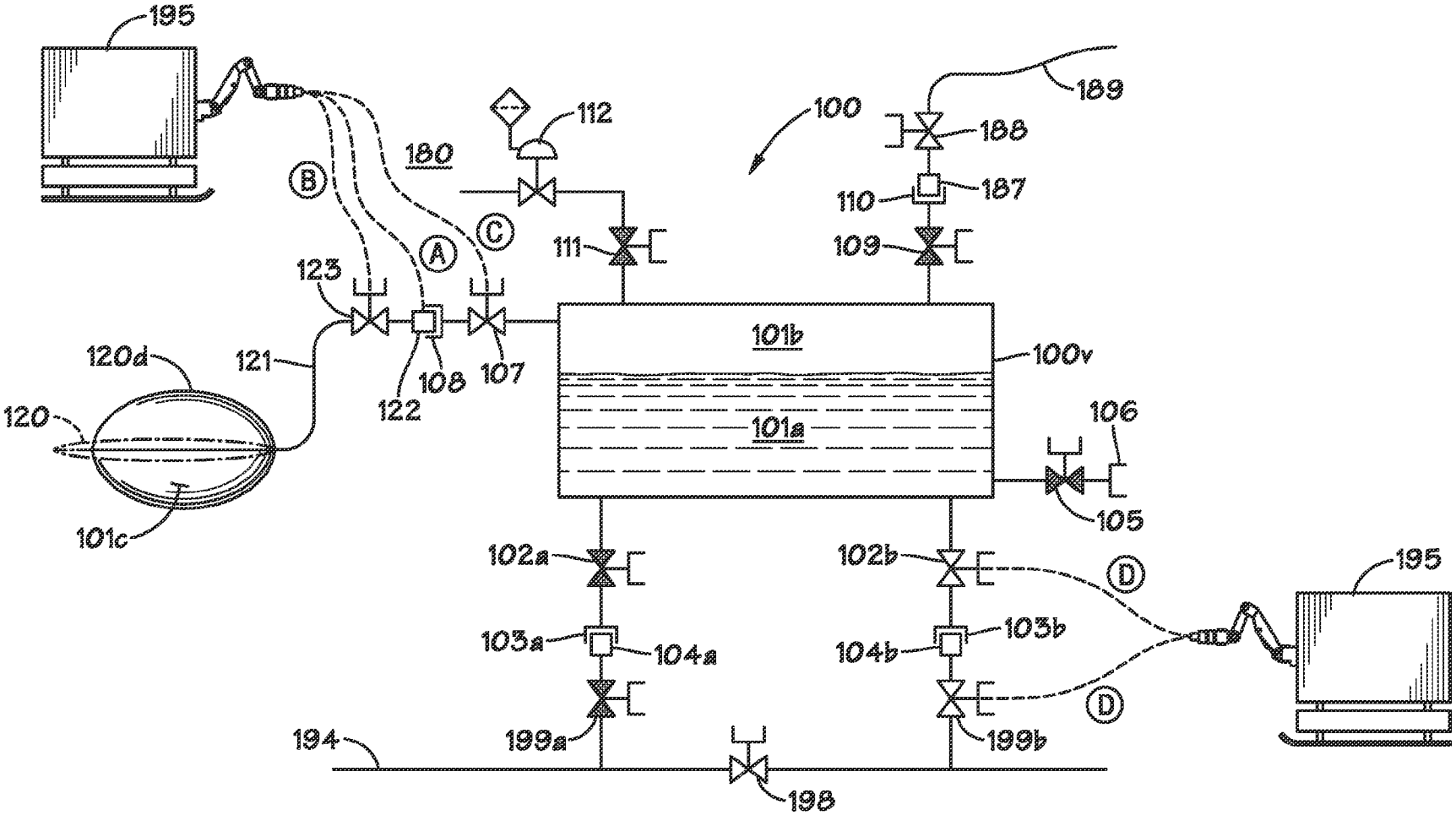

FIG. 8B schematically illustrates some initial method steps that may be performed in accordance with at least some exemplary embodiments in preparation for flushing the separated liquid 101*a* and separated gas 101*b* out of the subsea equipment package 100, which steps may include, among other things, the following:

A. Connect the containment structure connection 122 of the adjustable-volume subsea containment structure 120*b* containing flow assurance chemicals 101*c* to the upper connection 108 by operation of an ROV 195.

B. Open the containment structure isolation valve 123 by operation of an ROV 195.

C. Open the upper isolation valve 107 by operation of an ROV 195.

D. Open the second equipment isolation valve 102*b* and the second flowline isolation valve 199*b* by operation of an ROV 195.

In certain embodiments, after the adjustable-volume subsea containment structure 120 has been connected to the subsea equipment package 100 (Step A) and the containment structure isolation valve 123, upper isolation valve 107, and the second flowline and equipment isolation valves 102*b* and 199*b* have all been opened (Steps B, C and D), the structure 120*b* may then be in fluid communication with the flowline 194. In this configuration, the local hydrostatic pressure of the subsea environment 180—which, as noted above, may be greater than the operating pressure of the flowline 194 and the subsea equipment package 100—may therefore cause the adjustable-volume subsea containment structure 120*d* to collapse and the flow assurance chemicals 101*c* contained therein to be transferred into the package 100. Furthermore, any pre-charged pressure on the adjustable-volume subsea containment structure 120*d* may also facilitate the flow of flow assurance chemicals 101*c* out of the structure 120*d*. Concurrently, the flow assurance chemicals 101*c* flowing into the subsea equipment package 100 may displace at least a portion of the separated liquid 101*a* and separated gas 101*b* out of the subsea equipment package 100 and into the flowline 194. Furthermore, in certain illustrative embodiments, the adjustable-volume subsea containment structure 120*d* may be appropriately sized and pre-charged at the surface 191 (see, FIG. 1) with a sufficient volume of flow assurance chemicals so that substantially most of the separated liquid 101*a* and separated gas 101*b* is forced into the flowline 194. Accordingly, during this operation, the adjustable-volume subsea containment structure 120*d* may collapse to a substantially empty condition, as is indicated by the dashed-line containment structure outline 120 shown in FIG. 8B, and the subsea equipment package 100 may therefore be substantially filled with the flow assurance chemicals 101*c*.

Figure 8C:
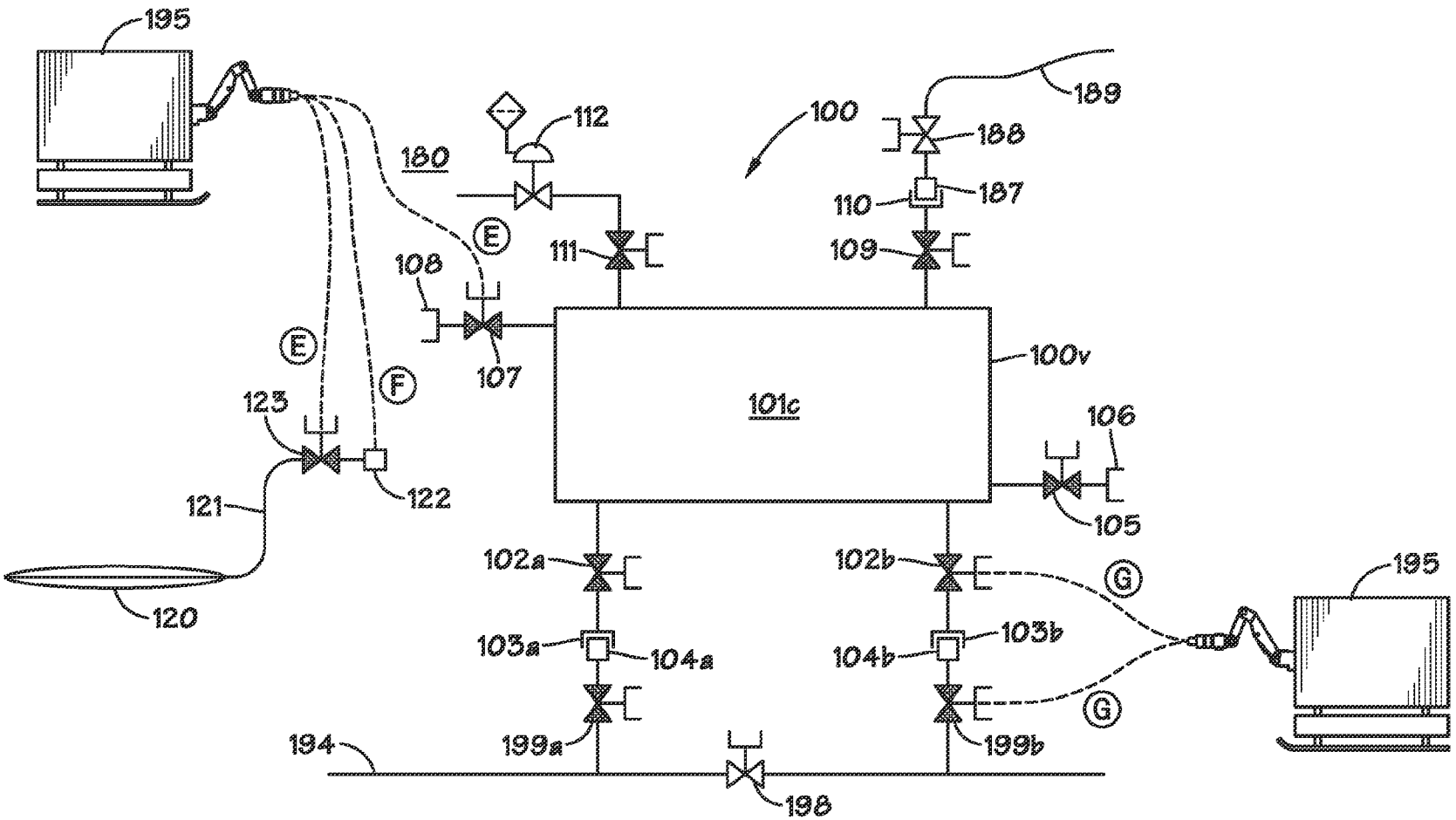
Figure 8D:
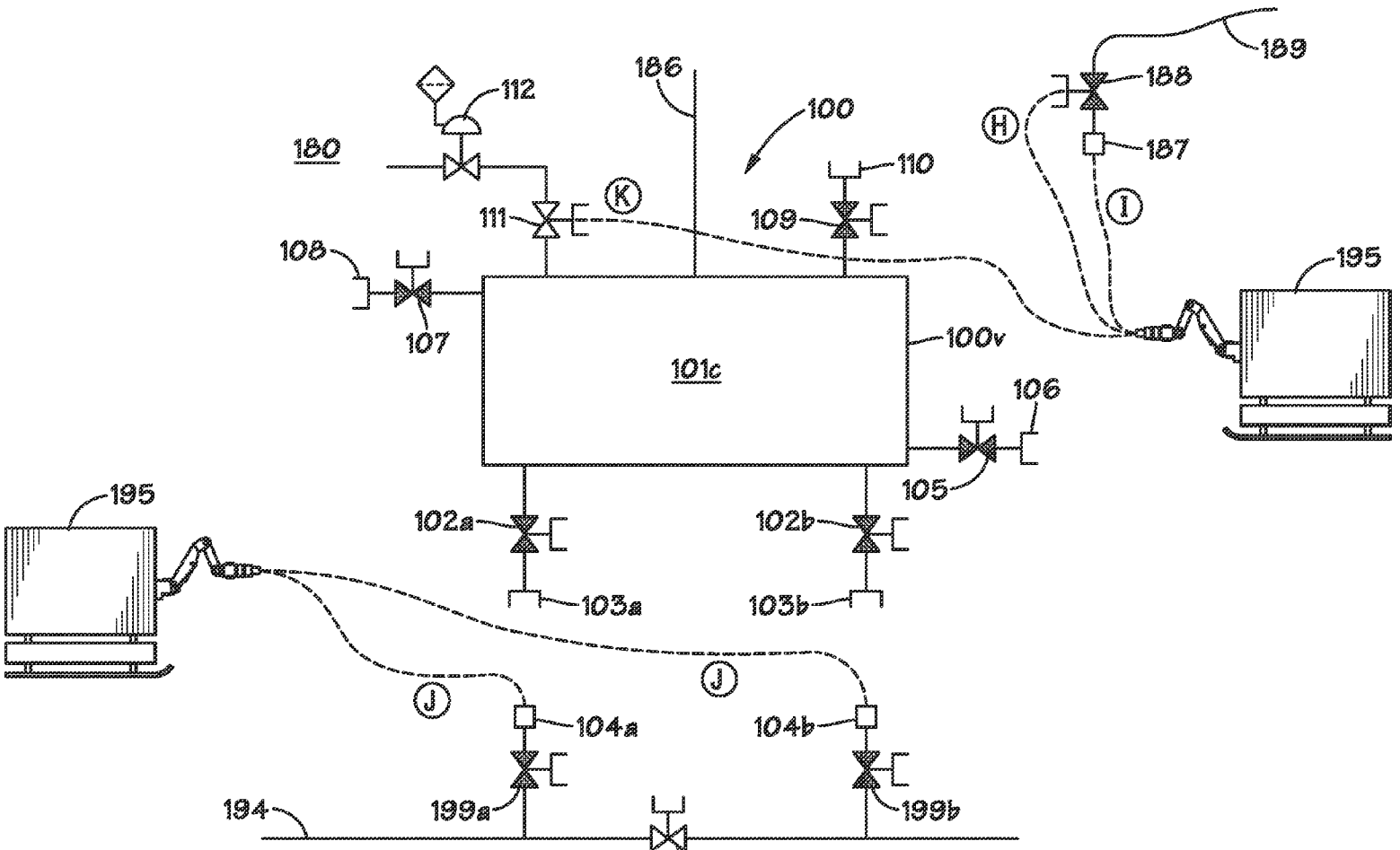

FIG. 8C schematically illustrates the subsea equipment package 100 shown in FIG. 8B after completion of the above-described steps. As shown in FIG. 8C, the subsea equipment package 100 may now be substantially filled with flow assurance chemicals 101*c*, although it should be understood that a small portion of the separated liquid 101*a* and/or the separated gas 101*b* may still be present in the package 100. Additionally, FIGS. 8C and 8D depict some further illustrative steps that may be performed so as to separate the subsea equipment package 100 from the flowline 194 and retrieve the package 100 to the surface. In some embodiments, these further separation and retrieval steps may include, among other things, the following:

E. Close the upper isolation valve 107 by operation of an ROV 195. Alternatively, the containment structure isolation valve 123 on the now-substantially empty adjustable-volume subsea containment structure 120 may also be closed by operation of an ROV 195.

F. Disconnect the containment structure connection 122 from the upper connection 108 by operation of an ROV 195.

G. Close the second equipment and flowline isolation valves 102*b* and 199*b* by operation of an ROV 195.

H. Close the chemical injection line isolation valve 188 by operation of an ROV 195.

I. Disconnect the chemical injection line connection 187 from the chemical injection connection 110 by operation of an ROV 195.

J. Disconnect the first and second equipment connections 103*a/b* from the first and second flowline connections 104*a/b* by operation of an ROV 195.

After the first and second equipment connections 103*a/b* have been disconnected from the respective first and second flowline connections 104*a/b* (Step J), the subsea equipment package 100 may then be raised to the surface 191 (see, FIG. 1) with the lift line 186 by using any appropriate equipment retrieval process disclosed herein. For example, in the illustrative embodiment shown in FIG. 8D, each of the valves 102*a/b*, 105, 107 and 108 are in a closed position prior to raising the subsea equipment package 100 to the surface 191, such that the pressure in the package 100 is trapped. Also as shown in FIG. 8D, the following additional step may be performed prior to raising the subsea equipment package 100 from its position near the sea floor 192 (see, FIG. 1) so as to handle the trapped pressure:

K. Open the relief isolation valve 111 by operation of an ROV 195.

When the relief isolation valve 111 is opened prior to raising the subsea equipment package 100 to the surface 191 (Step K), the pressure inside of the package 100 may be controllably reduced by the pressure relief valve 112 as the package 100 is being raised. Furthermore, any gas that may still be present in the subsea equipment package 100 prior to lift, or that may expand out of any liquid phase hydrocarbons as the local hydrostatic pressure of the surrounding subsea environment 180 decreases during the lift, may be vented by the pressure relief valve 112 in a highly controllable manner, such as is previously described with respect to FIG. 2F above.

Figure 8E:
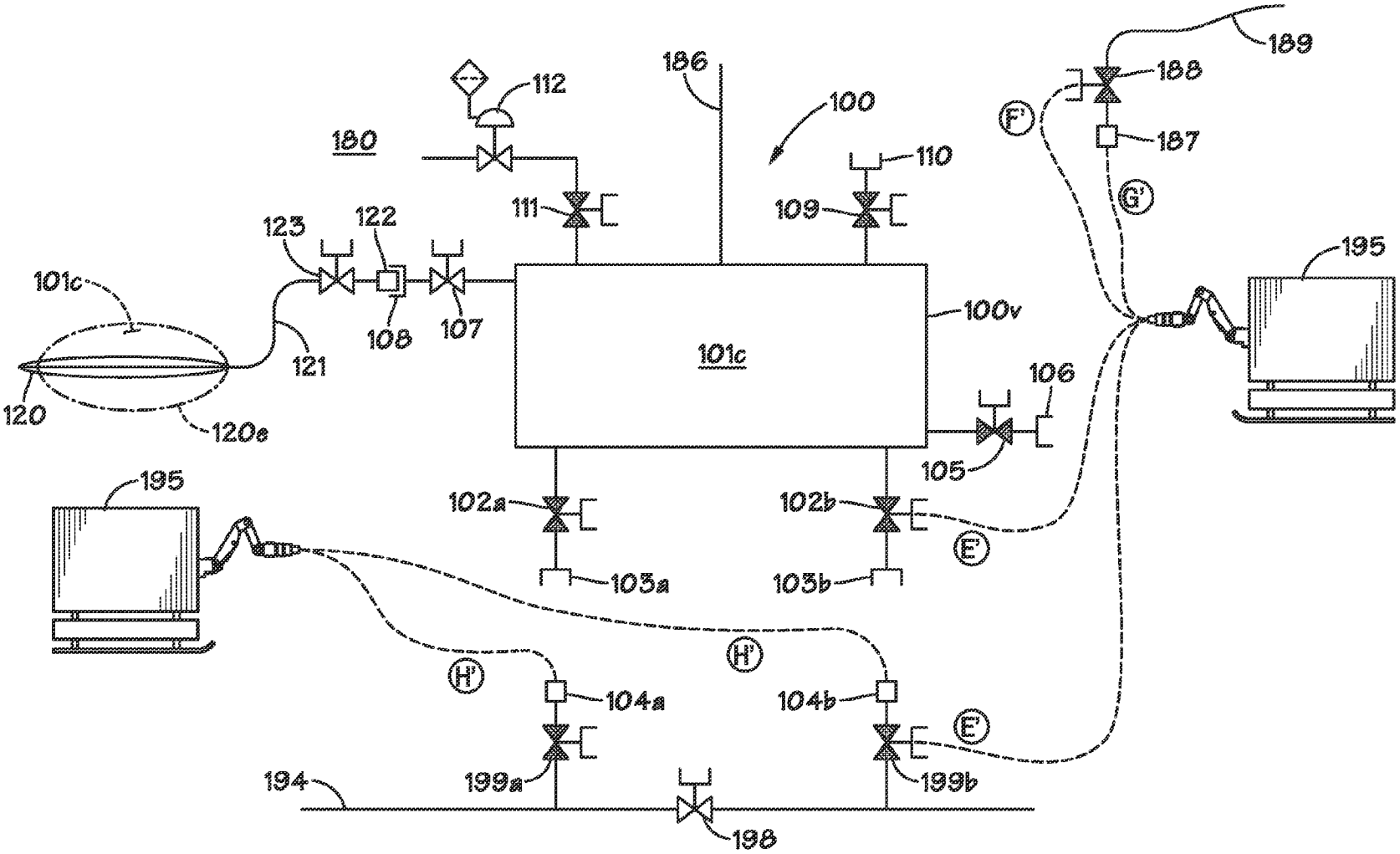

FIG. 8E schematically depicts at least some alternative method steps that may be performed so as to retrieve the illustrative subsea equipment package 100 shown FIGS. 8A and 8B, in lieu of the steps depicted in FIGS. 8C and 8D. For example, in some embodiments, the following alternative Steps E' through H' illustrated in FIG. 8E may be performed in lieu of performing Steps E though K shown in FIGS. 8C and 8D and described above:

E'. Close the second equipment and flowline isolation valves 102*b* and 199*b* by operation of an ROV 195.

F'. Close the chemical injection line isolation valve 188 by operation of an ROV 195.

G'. Disconnect the chemical injection line connection 187 from the chemical injection connection 110 by operation of an ROV 195.

H'. Disconnect the first and second equipment connections 103*a/b* from the first and second flowline connections 104*a/b* by operation of an ROV 195.

It should therefore be appreciated from the list of alternative steps shown above that, in certain illustrative embodiments, the steps of isolating the collapsed adjustable-volume subsea containment structure 120 and disconnecting the structure 120 from the subsea equipment package 100 (see, Steps E and F of FIG. 8C) may be skipped, and instead the collapsed adjustable-volume subsea containment structure 120 may be left in place and retrieved back to surface 191 (see, FIG. 1) together with the package 100, as shown in FIG. 8E. In some embodiments, the collapsed adjustable-volume subsea containment structure 120 may act to equalize the pressure that is trapped in the subsea equipment package 100 with the local hydrostatic pressure of the surrounding subsea environment 180 as the package and the structure 120 are retrieved to the surface 191. Furthermore, should any separated liquid 101*a* and/or separated gas 101*b* still be present with the flow assurance chemicals 101*c* in the subsea equipment package 100 before the package is raised, any gases expanding out of the package 100 during the retrieval process may be captured in and contained by the adjustable-volume subsea containment structure 120, as is indicated by the dashed-line containment structure outline 120*e* shown in FIG. 8E.

As a result of the above-described subject matter, various illustrative methods are disclosed which may be used to facilitate the retrieval and/or replacement of oil and gas production and/or processing equipment from a subsea environment substantially without releasing liquid hydrocarbons into the subsea environment. For example, certain illustrative methods are disclosed wherein produced fluids, such as hydrocarbons and produced water and the like, may be removed from the subsea equipment before it is retrieved from the subsea environment. Other exemplary methods are disclosed wherein the produced fluids present in the subsea equipment are injected into the adjacent subsea equipment, such as subsea flowlines and the like, prior to retrieving the subsea equipment to the surface. In still other embodiments, illustrative methods are disclosed wherein the pressure on the subsea equipment may also be relieved prior to or during equipment retrieval. In further illustrative embodiments, various disclosed methods may be used to deploy replacement subsea equipment while substantially preventing the release of liquid hydrocarbons into the subsea environment. For example, in accordance with some illustrative methods of the present disclosure, produced fluids that may have been previously removed from a piece of subsea equipment prior to its retrieval from the subsea environment may be stored in the subsea environment and in an appropriate containment vessel for later re-injection into replacement subsea equipment.

The particular embodiments disclosed above are illustrative only, as the invention may be modified and practiced in different but equivalent manners apparent to those skilled in the art having the benefit of the teachings herein. For example, the process steps set forth above may be performed in a different order. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed:

1. A method, comprising:

positioning subsea equipment in a subsea environment adjacent to a subsea equipment installation;

connecting a subsea containment structure to said subsea equipment, said subsea containment structure containing a stored quantity of at least a production fluid; and generating a flow of at least a portion of said stored quantity of production fluid into said subsea equipment so as to displace contents of said subsea equipment, wherein pressure in said subsea equipment is reduced below hydrostatic pressure of said subsea environment prior to generating said flow of said at least said portion of said stored quantity of production fluid into said subsea equipment.

2. The method of claim 1, wherein positioning said subsea equipment in said subsea environment comprises connecting said subsea equipment to said subsea equipment installation.

3. The method of claim 1, further comprising pumping a quantity of flow assurance chemicals into said subsea equipment prior to injecting said at least said portion of said stored quantity of production fluid into said subsea equipment.

4. The method of claim 1, wherein said contents of said subsea equipment are displaced into one of a chemical injection line, an umbilical line, and a flowline of said subsea equipment installation.

5. The method of claim 1, wherein said contents of said subsea equipment comprises at least one of seawater, flow assurance chemicals, and nitrogen gas.

6. The method of claim 1, further comprising using hydrostatic pressure of said subsea environment to generate said flow of said at least said portion of said stored quantity of production fluid into said subsea equipment.

7. A method, comprising:

connecting a subsea processing package to subsea equipment, said subsea processing package comprising a separator vessel and a circulation pump, wherein said separator vessel contains a first quantity of flow assurance chemicals, and wherein said subsea equipment is operatively connected to a subsea equipment installation in a subsea environment and contains at least a quantity of a trapped production fluid;

circulating, with said circulation pump, a first flow of a fluid mixture through said subsea equipment and said subsea processing package, said fluid mixture comprising at least said first quantity of flow assurance chemicals and said at least said quantity of said trapped production fluid; and separating, with said separator vessel, at least a portion of a gas portion of said quantity of said trapped production fluid from said first flow.

8. The method of claim 7, further comprising recovering, with said separator vessel, at least a portion of said first quantity of flow assurance chemicals while separating said at least said portion of said gas portion.

9. The method of claim 7, wherein, after separating at least said portion of said gas portion from said first flow, said subsea equipment contains a mixture comprising at least a portion of said first quantity of flow assurance chemicals and at least a portion of a liquid portion of said quantity of said trapped production fluid.

10. The method of claim 9, further comprising, after separating at least said portion of said gas portion flushing at least a portion of said mixture from said subsea equipment.

11. The method of claim 10, wherein flushing said at least said portion of said mixture from said subsea equipment comprises pumping, with said circulation pump, a second flow to said subsea equipment, said second flow comprising at least a second quantity of flow assurance chemicals from a tank comprising said subsea processing package.

12. The method of claim 11, wherein said second flow bypasses said separator vessel.

13. The method of claim 10, further comprising flushing said at least said portion of said mixture into a flowline of said subsea equipment installation.

14. The method of claim 10, further comprising, after flushing said at least said portion of said mixture from said subsea equipment, disconnecting said subsea equipment from said subsea equipment installation and retrieving said subsea equipment to a surface.

15. A method, comprising:

deploying a subsea containment structure containing a quantity of flow assurance chemicals from a surface to a subsea environment, said subsea containment structure comprising an adjustable-volume subsea containment structure;

connecting said subsea containment structure to subsea equipment in said subsea environment; and generating a flow of at least a portion of said quantity of flow assurance chemicals from said subsea containment structure to said subsea equipment so as to displace at least a portion of a trapped quantity of a production fluid from said subsea equipment and into a subsea flowline connected to said subsea equipment.

16. The method of claim 15, wherein generating said flow of said at least said portion of said quantity of flow assurance chemicals comprises using hydrostatic pressure of said subsea environment to generate said flow of said at least said portion said quantity of flow assurance chemicals from said adjustable-volume subsea containment structure to said subsea equipment.

17. The method of claim 15, further comprising preventing a flow of said production fluid flowing through said subsea flowline from flowing through said subsea equipment prior to displacing said at least said portion of said trapped quantity of a production fluid into said subsea flowline.

18. The method of claim 15, wherein a volume of said quantity of said flow assurance chemicals is greater than a volume of said trapped quantity of said production fluid, the method further comprising displacing a quantity of said trapped quantity of said production fluid from said subsea equipment.

19. The method of claim 18, further comprising displacing substantially all of said trapped quantity of said production fluid and substantially filling said subsea equipment with said flow assurance chemicals.

20. The method of claim 15, further comprising disconnecting said subsea equipment from said subsea flowline and raising said subsea equipment to said surface with at least said portion of said quantity of flow assurance chemicals contained therein.

21. The method of claim 20, further comprising raising said subsea equipment while said subsea containment structure is attached thereto.

22. The method of claim 21, further comprising using said subsea containment structure to regulate a pressure of said subsea equipment while raising said subsea equipment to said surface.

23. The method of claim 15, wherein said adjustable-volume subsea containment structure is a flexible subsea containment bag.

24. The method of claim 23, wherein generating said flow of said at least said portion of said quantity of flow assurance chemicals comprises using a subsea pump to generate said flow of said at least said portion of said quantity of flow assurance chemicals from said separator vessel to said subsea equipment.

25. A method, comprising:

disconnecting first subsea equipment from a subsea equipment installation positioned in a subsea environment;

retrieving said first subsea equipment from said subsea environment to a surface;

positioning replacement subsea equipment in said subsea environment adjacent to said subsea equipment installation, wherein said replacement subsea equipment is configured substantially the same as said first subsea equipment;

connecting a subsea containment structure to said replacement subsea equipment, said subsea containment structure containing a stored quantity of at least a production fluid; and generating a flow of at least a portion of said stored quantity of production fluid into said replacement subsea equipment so as to displace contents of said replacement subsea equipment.

* * * * *